US008296115B2

(12) United States Patent
Chen

(10) Patent No.: US 8,296,115 B2
(45) **Date of Patent: *Oct. 23, 2012**

(54) METHODS AND SYSTEMS FOR DESIGNING AND/OR SELECTING DRILLING EQUIPMENT USING PREDICTIONS OF ROTARY DRILL BIT WALK

(75) Inventor: Shilin Chen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 78 days.

This patent is subject to a terminal disclaimer.

(21) Appl. No.: 12/857,268

(22) Filed: Aug. 16, 2010

(65) Prior Publication Data

US 2010/0300758 A1 Dec. 2, 2010

Related U.S. Application Data

(63) Continuation of application No. 11/462,898, filed on Aug. 7, 2006, now Pat. No. 7,778,777.

(60) Provisional application No. 60/706,321, filed on Aug. 8, 2005, provisional application No. 60/738,431, filed on Nov. 21, 2005, provisional application No. 60/706,323, filed on Aug. 8, 2005, provisional application No. 60/738,453, filed on Nov. 21, 2005.

(51) Int. Cl.
*G06F 17/50* (2006.01)
*G06G 7/48* (2006.01)

(52) U.S. Cl. ..... 703/10; 703/2; 703/7; 175/24; 175/45; 175/341; 175/406; 175/408; 700/117; 702/9

(58) Field of Classification Search ..... 703/2, 7, 703/10; 702/2, 9; 175/331, 341, 24, 45, 175/406, 408; 700/117
See application file for complete search history.

(56) References Cited

U.S. PATENT DOCUMENTS

| | | | |
|---|---|---|---|
| 1,209,299 | A | 12/1916 | Hughes |
| 1,263,802 | A | 4/1918 | Reed |
| 1,394,769 | A | 10/1921 | Sorensen |
| 1,847,981 | A | 3/1932 | Reed |
| 2,038,386 | A | 4/1936 | Scott et al. |
| 2,117,679 | A | 5/1938 | Reed |
| 2,122,759 | A | 7/1938 | Scott |

(Continued)

FOREIGN PATENT DOCUMENTS

CN 2082755 8/1991

(Continued)

OTHER PUBLICATIONS

Drawing No. A46079 Rock Bit and Hole Opener; Security Engineering Co., Inc., Whittier, California, Sep. 14, 1946.

(Continued)

*Primary Examiner* — Thai Phan
(74) *Attorney, Agent, or Firm* — Baker Botts L.L.P.

(57) ABSTRACT

Methods and systems may be provided simulating forming a wide variety of directional wellbores including wellbores with variable tilt rates and/or relatively constant tilt rates. The methods and systems may also be used to simulate forming a wellbore in subterranean formations having a combination of soft, medium and hard formation materials, multiple layers of formation materials and relatively hard stringers disposed throughout one or more layers of formation material. Values of bit walk rate from such simulations may be used to design and/or select drilling equipment for use in forming a directional wellbore.

3 Claims, 20 Drawing Sheets

U.S. PATENT DOCUMENTS 2,132,498 A 10/1938 Smith
2,165,584 A 7/1939 Smith
2,230,569 A 2/1941 Howard et al.
2,496,421 A 2/1950 Stokes
2,728,559 A 12/1955 Boice et al.
2,851,253 A 9/1958 Boice et al.
3,269,470 A 8/1966 Kelly, Jr.
4,056,153 A 11/1977 Miglierini
4,187,922 A 2/1980 Phelps
4,285,409 A 8/1981 Allen
4,334,586 A 6/1982 Schumacher
4,343,371 A 8/1982 Baker et al.
4,343,372 A 8/1982 Kinzer
4,393,948 A 7/1983 Fernandez
4,408,671 A 10/1983 Munson
4,427,081 A 1/1984 Crawford
4,455,040 A 6/1984 Shinn
4,512,426 A 4/1985 Bidegaray ..... 175/329
4,611,673 A 9/1986 Childers et al.
4,627,276 A 12/1986 Burgess et al.
4,657,093 A 4/1987 Schumacher
4,738,322 A 4/1988 Hall et al.
4,776,413 A 10/1988 Forsberg
4,804,051 A 2/1989 Ho
4,815,342 A 3/1989 Brett et al.
4,845,628 A 7/1989 Gray et al. ..... 702/9
4,848,476 A 7/1989 Deane et al.
4,884,477 A 12/1989 Smith et al.
4,889,017 A 12/1989 Fuller et al.
5,004,057 A 4/1991 Tibbitts ..... 175/408
5,010,789 A 4/1991 Brett et al.
5,027,913 A 7/1991 Nguyen
5,042,596 A 8/1991 Brett et al.
5,099,929 A 3/1992 Keith et al. ..... 175/61
5,131,478 A 7/1992 Brett et al.
5,131,480 A 7/1992 Lockstedt et al.
5,137,097 A 8/1992 Fernandez
5,197,555 A 3/1993 Estes
5,216,917 A 6/1993 Detournay
5,224,560 A 7/1993 Fernandez
RE34,435 E 11/1993 Warren et al.
5,258,755 A 11/1993 Kuckes ..... 340/853.5
5,285,409 A 2/1994 Hwangbo et al.
5,291,807 A 3/1994 Vanderford
5,305,836 A 4/1994 Holbrook et al.
5,311,958 A 5/1994 Isbell et al.
5,318,136 A 6/1994 Rowsell et al.
5,341,890 A 8/1994 Cowthorne et al.
5,351,770 A 10/1994 Cawthorne et al.
5,370,234 A 12/1994 Sommer, Jr. et al.
5,372,210 A 12/1994 Harrell
5,394,952 A 3/1995 Johns et al.
5,415,030 A 5/1995 Jogi et al.
5,416,697 A 5/1995 Goodman
5,421,423 A 6/1995 Huffstutler
5,423,389 A 6/1995 Warren et al.
5,435,403 A 7/1995 Tibbitts et al.
5,456,141 A 10/1995 Ho
5,465,799 A 11/1995 Ho
5,513,711 A 5/1996 Williams
5,579,856 A 12/1996 Bird
5,595,252 A 1/1997 O'Hanlon
5,595,255 A 1/1997 Huffstutler
5,605,198 A 2/1997 Tibbitts et al.
5,607,024 A 3/1997 Keith et al. ..... 175/431
5,608,162 A * 3/1997 Ho ..... 73/152.48
5,636,700 A 6/1997 Shamburger, Jr.
5,697,994 A 12/1997 Packer et al.
5,704,436 A 1/1998 Smith et al.
5,715,899 A 2/1998 Liang et al.
5,730,234 A 3/1998 Putot
5,767,399 A 6/1998 Smith et al.
5,787,022 A 7/1998 Tibbitts et al. ..... 364/578
5,794,720 A 8/1998 Smith et al.
5,812,068 A 9/1998 Wisler et al.
5,813,480 A 9/1998 Zaleski, Jr. et al.
5,813,485 A 9/1998 Portwood
5,839,526 A 11/1998 Cisneros et al.
5,853,245 A 12/1998 Price
5,937,958 A 8/1999 Mensa-Wilmot et al. .... 175/398
5,950,747 A 9/1999 Tibbitts et al. ..... 175/432
5,960,896 A 10/1999 Barr et al. ..... 175/431
5,967,245 A 10/1999 Garcia et al.
5,967,247 A 10/1999 Pressier
6,002,985 A 12/1999 Stephenson
6,003,623 A 12/1999 Miess
6,012,015 A 1/2000 Tubel
6,021,377 A 2/2000 Dubinsky et al.
6,021,859 A 2/2000 Tibbitts et al. ..... 175/431
6,029,759 A 2/2000 Sue et al.
6,044,325 A 3/2000 Chakravarthy et al.
6,057,784 A 5/2000 Schaaf et al.
6,095,262 A 8/2000 Chen
6,095,264 A 8/2000 Dillard
6,109,368 A 8/2000 Goldman et al.
6,119,797 A 9/2000 Hong et al.
6,123,160 A 9/2000 Tibbitts et al.
6,123,161 A 9/2000 Taylor
6,138,780 A 10/2000 Beuershausen
6,142,247 A 11/2000 Pessier
6,164,390 A * 12/2000 Murdock et al. ..... 175/24
6,173,797 B1 1/2001 Dykstra et al. ..... 175/374
6,176,329 B1 1/2001 Portwood et al.
6,186,251 B1 2/2001 Butcher
6,206,117 B1 3/2001 Tibbitts et al. ..... 175/399
6,213,225 B1 4/2001 Chen
6,241,034 B1 6/2001 Steinke et al.
6,260,635 B1 7/2001 Crawford
6,260,636 B1 7/2001 Cooley et al.
6,269,892 B1 8/2001 Boulton et al.
6,302,223 B1 10/2001 Sinor
6,308,790 B1 10/2001 Mensa-Wilmot et al.
6,348,110 B1 2/2002 Evans
6,349,595 B1 2/2002 Civolani et al.
6,349,780 B1 2/2002 Beuershausen
6,374,930 B1 4/2002 Singh et al.
6,401,839 B1 6/2002 Chen
6,412,577 B1 7/2002 Chen
6,424,919 B1 7/2002 Moran et al. ..... 702/6
6,499,547 B2 12/2002 Scott et al.
6,516,293 B1 2/2003 Huang et al.
6,527,068 B1 3/2003 Singh et al.
6,533,051 B1 3/2003 Singh et al.
6,550,548 B2 4/2003 Taylor ..... 175/45
6,581,699 B1 6/2003 Chen et al.
6,607,047 B1 8/2003 Swadi et al.
6,619,411 B2 9/2003 Singh et al.
6,640,913 B2 11/2003 Lockstedt et al.
6,729,420 B2 5/2004 Mensa-Wilmot
6,785,641 B1 8/2004 Huang ..... 703/7
6,848,518 B2 2/2005 Chen et al.
6,856,949 B2 2/2005 Singh et al.
6,873,947 B1 3/2005 Huang et al. ..... 703/10
6,879,947 B1 4/2005 Glass
7,020,597 B2 3/2006 Oliver et al.
7,059,430 B2 6/2006 Singh et al.
7,079,996 B2 7/2006 Stewart et al.
7,139,689 B2 11/2006 Huang ..... 703/7
7,147,066 B2 12/2006 Chen et al.
7,251,590 B2 7/2007 Huang et al. ..... 703/2
7,455,125 B2 11/2008 Sinor et al.
7,827,014 B2 * 11/2010 Chen ..... 703/10
7,899,658 B2 * 3/2011 Oliver et al. ..... 703/10
2001/0030063 A1 10/2001 Dykstra et al.
2001/0042642 A1 11/2001 King
2004/0045742 A1 3/2004 Chen
2004/0069531 A1 4/2004 McCormick et al. ..... 175/57
2004/0104053 A1 6/2004 Chen
2004/0143427 A1 7/2004 Huang et al. ..... 703/10
2004/0167762 A1 8/2004 Chen
2004/0216926 A1 11/2004 Dykstra et al. ..... 175/57
2004/0244982 A1 12/2004 Chitwood et al. ..... 166/347
2004/0254664 A1 12/2004 Centala et al.
2005/0015230 A1 1/2005 Centala et al.
2005/0096847 A1 5/2005 Huang ..... 702/9
2005/0133272 A1 6/2005 Huang et al. ..... 175/327
2005/0145417 A1 7/2005 Radford et al. ..... 175/57

| | | | | |
|---|---|---|---|---|
| 2005/0273302 | A1 | 12/2005 | Huang et al. | |
| 2005/0273304 | A1 | 12/2005 | Oliver et al. | 703/10 |
| 2006/0032674 | A1 | 2/2006 | Chen | |
| 2006/0048973 | A1 | 3/2006 | Brackin et al. | 175/57 |
| 2006/0074616 | A1 | 4/2006 | Chen | |
| 2006/0076132 | A1 | 4/2006 | Nold, III et al. | 166/264 |
| 2006/0149518 | A1 | 7/2006 | Oliver et al. | |
| 2007/0005316 | A1 | 1/2007 | Paez | 703/10 |
| 2007/0021857 | A1 | 1/2007 | Huang | |
| 2007/0029111 | A1 | 2/2007 | Chen | 175/24 |
| 2007/0029113 | A1 | 2/2007 | Chen | |
| 2007/0185696 | A1 | 8/2007 | Moran et al. | 703/10 |
| 2007/0192071 | A1 | 8/2007 | Huang et al. | 703/2 |
| 2007/0205024 | A1* | 9/2007 | Mensa-Wilmot | 175/408 |
| 2009/0055135 | A1 | 2/2009 | Tang et al. | 703/1 |
| 2009/0090556 | A1* | 4/2009 | Chen | 175/45 |

FOREIGN PATENT DOCUMENTS

| | | | |
|---|---|---|---|
| EP | 193361 | | 10/1989 |
| EP | 0384734 | A1 | 8/1990 |
| EP | 0511547 | A2 | 4/1992 |
| EP | 0511547 | A3 | 4/1992 |
| EP | 0511547 | B1 | 4/1992 |
| EP | 1006256 | | 6/2000 |
| GB | 2186715 | | 8/1987 |
| GB | 2241266 | A | 8/1991 |
| GB | 2300208 | A | 10/1996 |
| GB | 2305195 | A | 4/1997 |
| GB | 2327962 | A | 2/1999 |
| GB | 2363409 | A | 12/2001 |
| GB | 2365899 | A | 2/2002 |
| GB | 2367578 | A | 4/2002 |
| GB | 2367579 | A | 4/2002 |
| GB | 2367626 | | 4/2002 |
| GB | 2384567 | | 7/2003 |
| GB | 2388857 | A | 11/2003 |
| GB | 2400696 | | 10/2004 |
| SU | 1654515 | A1 | 3/1988 |
| SU | 1691497 | A1 | 5/1988 |
| SU | 1441051 | A2 | 11/1988 |
| SU | 1768745 | A1 | 10/1992 |
| WO | 2007/022185 | | 2/2007 |

OTHER PUBLICATIONS

H.G. Benson, "*Rock Bit Design, Selection and Evaluation*", presented at the sprint meeting of the pacific coast district, API Division of Production, Los Angeles, May 1956.

W.C. Maurer, "*The Pefect-Cleaning Theory of Rotary Drilling*", Journal of Petroleum Technology, SPE, pp. 1270-1274, Nov. 1962.

Composite Catalog of Oil Field Equipment & Services, 27th Revision 1666-67 vol. 3 (.0281), 1966.

J.C. Estes, "*Selecting the Proper Rotary Rock Bit*", JPT, pp. 1359-1367, Nov. 1971.

Sikarskie, et al., "*Penetration Problems in Rock Mechanics*", ASME Rock Mechanics Symposium, 1973.

"Machino Export", Russia, 4 pages, 1974.

L.E. Hibbs, Jr., et al, "*Diamond Compact Cutter Studies for Geothermal Bit Design*", Journal of the Pressure Vessel Technology, vol. 100, pp. 406-416, Nov. 1978.

"*Longer Useful Lives for Roller Bits Cuts Sharply into Drilling Costs*", South African Mining & Engineering Journal, vol. 90, pp. 39-43, (.0281), Mar. 1979.

R.K. Dropek, "*A Study to Determine Roller Cone Cutter Offset Effects at Various Drilling Depths*"American Society of Mechanical Engineers, 10 pages, Aug. 1979.

Lecture Handouts entitled: "*Rock Bit Design, Dull grading, Selection and Application*", presented by Reed Rock bit Company,(.0281), Oct. 16, 1980.

"*Making Hole*", part of Rotary Drilling Series, edited by Charles Kirkley, 1983.

T.M. Warren, "*Factors Affecting Torque for a Roller Cone Bit*", JPT J PET Technol., vol. 36, No. 10, pp. 1500-1508, XP002266078, Sep. 1984.

"*Drilling Mud*", part of Rotary Drilling Series, edited by Charles Kirkley (1984).

Rabia, H., "*Oilwell Drilling Engineering: Priciples and Practice*", University of Newcastle upon Tyne, 331 pages, (1985).

D.K. Ma & S.L. Yang, "*Kinematics of the Cone Bit*", Society of Petroleum Engineers, pp. 321-329 (Jun. 1985).

D. Ma, & J.J. Azar, "*Dynamics of Roller Cone Bits*", Journal of Energy Resources Technology, vol. 107, pp. 543-548 (Dec. 1985).

D.K. Ma, "*New Method forCharacterizing the Scraping-Chiseling Performance of of Rock Bits*", Petroleum Machinery, English translations with original Chinese version attached (Jul. 1988).

M.C. Sheppard, et al., "*Forces at the Teeth of a Drilling Rollercone Bit: Theory and Experiment*", Proceedings: 1988 SPE Annual Technical Conference and Exhibition; Houston, TX, USA, Oct. 2-5, 1988, vol. Delta, 1988, pp. 253-260 18042, XP002266080, Soc. Pet Eng AIME Pap SPE 1988 Publ by Soc of Petroleum Engineers of AIME, Richardson, TX, USA, 1988.

T.M. Warren et al, "*Drag-Bit Performance Modeling*", SPE Drill Eng. vol. 4, No. 2, pp. 119-127 15618, XP002266079, Jun. 1989.

Dakun Ma & J.J. Azar, "*A New Way to Characterize the Gouging-Scraping Action of Roller Cone Bits*", Univ. of Tulsa, SPE 19448, 1989.

B.L. Steklyanov, et al, "*Improving the Effectiveness of Drilling Tools*," Series KhM-3, Oil Industry Machine Building, pub. Central Institute for Scientific and Technical Information and Technical and Economic Research on Chemical and Petroleum Machine Buidling, Tsintikhimneftemash, Moscow, translated from Russian, 1991.

Bourgoyne Jr., Adam T. et al., "*Applied Drilling Engineering*", Society of Petroleum Engineers Textbook Series, 1991.

Specification sheet entitled "*SQAIR Quality Sub-Specification*", Shell Internationale Petroleum Mij. B.V., The Hauge, The Netherlands, (2 Pages) 1991.

Ma, D., et al., "*A New Method for Designing Rock Bit*", SPE Proceedings, vol. 22431, XP008058830, 12 pgs., Mar. 24, 1992.

J.P. Nguyen, "*Oil and Gas Field Development Techniques: Drilling*", (translation 1996, from French original 1993).

F.A.S.T.™ Technology Brochure entitled "*Tech Bits*", Security/Dresser Industries, 1 page, Sep. 17, 1993.

Brochure entitled "*FM2000 Series-Tomorrow's Technolgoies for Today's Drilling*.", Security DBS, Dresser Industries, Inc., 3 pgs, 1994.

Wilson C. Chin, "*Wave Propagation in Petroleum Engineering*", 1994.

Dykstra, et al., "*Experimental Evaluations of Drill String Dynamics*", SPE 28323, 1994.

Kenner and Isbell, "*Dynamic Analysis Reveals Stability of Roller Cone Rock Bits*", SPE 28314, 1994.

Brochure entitled "*Twist & Shout*", (SB2255.1001), 4 pages, 2001.

Shilin Chen, Thesis entited: "*Linear and Nonlinear Dynamics of Drillstrings*", Falculty of Applied Sciences, University of Liege, 1994-1995.

Energy Balanced Series Roller Cone Bits, www.halliburton.com/oil_gas/sd1380.jsp, printed Dec. 24, 2003.

D. Ma, D. Zhou & R. Deng, "*The Computer Simulation of the Interaction Between Roller Bit and Rock*", SPE 2992, 1995.

Ma Dekun, "*The Operational Mechanics of the Rock Bit*," Petroleum Industry Press, Beijing, China, 244 pages, 1996.

Russian bit catalog listing items "III 190,5 T-TsV-1" and "III 109,5 Tkz-TsV", dated orior to 1997.

Brochure entitled "*FS2000 Series-New Steel Body Technology Advances PDC Bit Performance and Efficiency*", Security DBS, Dresser Industries, Inc. (6 pages), 1997.

Ashmore, et al., Stratapax™ Computer Program, Sandia Laboratories, Albuquerque, NM , (76 pages), Apr. 1978.

Sii PLUS Brochure entitled "*The PDC Plus Advantage*", from Smith International (2 pages), 1978.

J.A. Norris, et al., "*Development and Successful Application of Unique Steerable PDC Bits*," Copyright 1998 IADC/SPE Drilling Conference, 14 pgs, Mar. 3, 1998.

U.S. Appl. No. 10/325,650 entitled "*Drilling with Mixed Tooth Types*" by John G. Dennis, Dec. 19, 2002.

D. Stroud et al., "*Development of the Industry's First Slimhole Point-the-Bit Rotary Steerable System*," Society of Petroleum Engineers Inc, 4 pgs, 2003.

Halliburton Revolutionizes PDC Drill Bit Design with the Release of FM3000, 2003 Press Releases, 2 pgs, May 5, 2003.
O. Vincke, et al., "*Interactive Drilling: The Up-To-Date Drilling Technology*," Oil & Gas Science and Technology Rev. IFP, vol. 59, No. 4, pp. 343-356, Jul. 2004.
Communication of a Notice of Opposition filed Oct. 14, 2004, Ref. No. 95 938 b/bl for Application No. 99945376.4-1266/1117894 through the EPO office in Munich, Germany.
Brief Communication Notice of Opposition from European Patent Office regarding EP99945375.6 enclosing letter from the opponent dated Oct. 13, 2004.
Communication of Notice of Opposition filed Oct. 21, 2004, for Application No. 99945375.6-2315/1112433 through the EPO office in Munich, Germany.
Brief Communication from European Patent Office for EP99945375, enclosing letter from the opponent dated Dec. 2, 2004.
Notification of British Search Report for Patent application No. GB 0504304.7, 4 pages, Apr. 22, 2005.
Notification of British Search Report for Patent application No. GB 0503934.2, 3 pgs, May 16, 2005.
Approved Judgment before Ho. Pumfrey, High Court of Justice, Chancery Division, Patents Court, Case HC04C00114, 00689, 00690, (Halliburton v. Smith Internl.), Royal Courts of Justice, Strand, London, (84 pages) signed Jul. 21, 2005.
Notification of Search Report from Great Britian for Application No. GB0516638.4, 4 pgs, mailed Jan. 5, 2006.
Notification of Search Report from Great Britain for Application No. GB0523735.9 (3 pages), mailed Jan. 31, 2006.
Communication of Notice of Opposition for Application No. 99945376.4-1266/1117894 through the EPO office in Munich. Germany, 5 pgs, Feb. 15, 2006.
Notification of European Search Report for Patent application No. 04025562.2-2315, 4 pgs, Feb. 24, 2006.
Communication for EPO for Application No. 04025561.4-2315 Notification of European Search Report, 4 pgs, mailed Feb. 24, 2006.
Decision from EPO revoking EP Pat. No. EP-B-1117894, 16 pgs., mailed May 15, 2006.
Patent Acts 1977: Error in Search Report, Application No. GB0516638.4, 2 pgs., mailed May 24, 2006.
Communication from EPO for Application No. 04025560.6-2315 attaching European Search Report, mailed Feb. 24, 2006.
Notification of European Search Report for Patent application No. 04025235.2-2315, 3 pgs, Apr. 4, 2006.
Notification of European Search Report for Patent application No. 04025232.5-2315, 4 pages, Feb. 24, 2006.
Notification of European Search Report for Patent application No. 04025234.8-2315, 3 pages, Apr. 4, 2006.
Notification of European Search Report for Patent application No. 04025233.0-2315, 3 pages, Apr. 11, 2006.
Halliburton catalogue item entitled: *Ez-Pilot (TM) Rotary Steerable System* (1 page), Jul. 24, 2006.
Halliburton catalogue item entitled: *Geo-Pilot (R) Rotary Steerable System* (1 page), Jul. 24, 2006.
Halliburton catalogue item entitled: *SlickBore (R) Matched Drilling System* (1 page), Jul. 24, 2006.
International Search Report, PCT/US/2006/030804, 11 pgs., mailing Dec. 19, 2006.
International Search Report, PCT/US/2006/030830, 11 pgs., mailing Dec. 19, 2006.
International Search Report, PCT/US/2006/030803, 11 pgs., mailing Dec. 19, 2006.
Pastusek et al., A Fundamental Model for Prediction of Hole Curvature and Build Rates With Steerable Bottomhole Assemblies, 7 pgs, 2005.
Southerland et al. "Development & Application of Versatile and Economical 3D Rotary Steering System," AADE, Emerging Technology, pp. 2-16, 2001.
Bannerman "Walk Rate Prediction of Alwyn North Field by Means of Data Analysis and 3D Computer Model" SPE 20933 (pp. 471-476), Oct. 24, 1990.
Barton "Development of Stable PDC Bits for Specific Use on Rotary Steerable Systems" IADC/SPE 62779 (pp. 1-13), Sep. 13, 2000.
Behr et al. "3D PDC Bit Model Predicts Higher Cutter Loads" SPE Drilling & Completion (pp. 253-258), Dec. 1993.
Behr et al. "Three-Dimensional Modeling of PDC Bits" SPE/IADC 21928 (pp. 273-281), Mar. 14, 1991.
Final Technical Report, "P.A.B. Bit.": Predetermined azimuthal Behavior of PDC bits, Contract Number: OG/222/97, Gerth, SecurityDBS, Armines and TotalFinaElf (pp. 1-45), Jan. 1998.
Glowka "Use of Single-Cutter Data in the Analysis of PDC Bit Designs: Part 1-Development of a PDC Cutting Force Model" SPE, Sandia Natl. Laboratories (pp. 797-849), Aug. 1989.
Glowka "Development of a Method for Predicting the Performance and Wear of PDC Drill Bits" Sandia Natl. Laboratories (205 pp.), Sep. 1987.
Hanson et al. "Dynamics Modeling of PDC Bits" SPE/IADC 29401 (pp. 589-604), Mar. 2, 1995.
Langeveld "PDC Bit Dynamics (Supplement to IADC/SPE 23867)" IADC/SPE 23873 (pp. 1-5), Feb. 21, 1992.
Langeveld "PDC Bit Dynamics" IADC/SPE 23867 (pp. 227-241), Feb. 21, 1992.
Menand et al. "How Bit Profile and Gauges Affect Well Trajectory" SPE Drilling & Completion (pp. 34-41), Mar. 2003.
Menand et al. Classification of PDC Bits According to their Steerability SPE Drilling Conference 79795 (pp. 1-13), Feb. 21, 2003.
Menand et al. "How the Bit Profile and Gages Affect the Well Trajectory" IADC/SPE 74459 (pp. 1-13), Feb. 28, 2002.
Menand et al. "PDC Bit Classification According to Steerability" SPE Drilling & Completion (pp. 5-12), Mar. 2004.
Millhiem et al. "Side Cutting Characteristics of Rock Bits and Stabilizers While Drilling" SPE 7518 (8 pages), Oct. 3, 1978.
Modeling of the Directional Behavior of Monobloc Drilling Bits in Anisotropic Formations (40 pages), 2002.
Perry, C.J., "Directional Drilling With PDC Bits in the Gulf of Thailand" SPE 15616 (9 pages), Oct. 8, 1986.
O'Hare et al., Design Index: A Systematic Method of PDC Drill Bit Selection, IADC/SPE 59112, 15 pages, 2000.
H.S. Ho, General Formulation of Drillstring Under Large Deformation and Its Use in BHA Analysis, SPE 15562, 12 pages, 1996.
Chen et al., Maximizing Drilling Performance With State-of-the-Art BHA Program, PSE/IADC 104502, 13 pages, 2007.
Chen et al., Modeling of the Effects of Cutting Structure, Impact Arrestor, and Gage Geometry on PDS Bit Steerability, AADE-07-NTC-10, 10 pages, 2007.
Chen et al., "Reexamination of PDC Bit Walk in Directional and Horizontal Wells," IADC/SPE 112641, 12 pgs, Mar. 4, 2008.
International Preliminary Report on Patentability, PCT/US2006/030804, 5 pages, Mailing Date Feb. 21, 2008.
Official Action for EP06800931.5, 4 pgs, mailed Oct. 13, 2008.
International Preliminary Report on Patentability, PCT/2006/030803, 6 pgs, mailed Mar. 3, 2008.
Official Action for EP06789543.3, 3 pgs, mailed Oct. 13, 2008.
International Search Report and Written Opinion, PCT/2008/058097, 10 pgs, mailed Aug. 7, 2008.
International Search Report and Written Opinion, PCT/2008/064862, 10 pgs, mailed Sep. 2, 2008.
TransFormation Bits; Sharp Solutions; ReedHycalog; www.ReedHycalog.com; pp. 8, 2004.
International Search Report and Written Opinion; PCT/US 08/86586; pp. 9, Jan. 30, 2009.
"Down Hole Tools", Halliburton Security DBS, © 2003 Halliburton, 8 pages, Mar. 1, 2003.
"HyperSteer™ and FullDrift® Bits for Rotary Steerable Applications", Halliburton, Security DBS Drill Bits, Drilling and Formation Evaluation, © 2006 Halliburton, 6 pages, Jan. 1, 2006.
European Office Action, Application No. 06 800 931.5, 3 pgs, Aug. 13, 2009.
European Office Action, Application No. 06 789 544.1, 3 pgs, Aug. 12, 2009.
PCT International Preliminary Report on Patentability, PCT/US2008/060468, 7 pages, Oct. 29, 2009.
Plaintiffs Original Complaint for Patent Infringement and Jury Demand, filed Sep. 6, 2002 in the United States District Court for the Eastern District of Texas, Sherman Division, Civil Action No.

4-02CV269, *Halliburton Energy Services, Inc.* v. *Smith International, Inc.*, 4 pages, Sep. 6, 2002.
Answer and Counterclaim of Smith International, filed Mar. 14, 2003, in the United States District Court for the Eastern District of Texas, Sherman Division, Civil Action No. 4-02CV269, *Halliburton Energy Services, Inc.* v. *Smith International, Inc.*, 6 pages, Mar. 14, 2003.
Response of Plaintiff and Counterclaim Defendant to Defendant's Counterclaim of Declaratory Judgment, filed Apr. 3, 2003, in the United States District Court for the Eastern District of Texas, Sherman Division, Civil Action No. 4-02CV269, *Halliburton Energy Services, Inc.* v. *Smith International, Inc.*, 3 pages, Apr. 3, 2003.
First Amended Answer and Counterclaim of Smith International, filed Oct. 9, 2003, in the United States District Court for the Eastern District of Texas, Sherman Division, Civil Action No. 4-02CV269, *Halliburton Energy Services, Inc.* v. *Smith International, Inc.*, 8 pages, Oct. 9, 2003.
Memorandum Opinion of Judge Davis, signed Feb. 13, 2004, in the United States District Court for the Eastern District of Texas, Sherman Division, Civil Action No. 4-02CV269, *Halliburton Energy Services, Inc.* v. *Smith International, Inc.*, 37 pages (including fax coversheet), Feb. 19, 2004.
Final Judgment of Judge Davis, signed Aug. 13, 2004, in the United States District Court for the Eastern district of Texas, Sherman Division, civil Action No. 4-02CV269, *Halliburton Energy Services, Inc.* v. *Smith International, Inc.* (3 pages), Aug. 13, 2004.
Sworn written statement of Stephen Steinke and Exhibits SS-1 to SS-6, Oct. 13, 2004.

* cited by examiner

METHODS AND SYSTEMS FOR DESIGNING AND/OR SELECTING DRILLING EQUIPMENT USING PREDICTIONS OF ROTARY DRILL BIT WALK

RELATED APPLICATIONS

This application is a Continuation of U.S. patent application Ser. No. 11/462,898 filed Aug. 7, 2006 now U.S. Pat No. 7,778,777, which claims the benefit of provisional Application Ser. No. 60/706,321 filed Aug. 8, 2005;

provisional Application Ser. No. 60/738,431 filed Nov. 21, 2005;

provisional Application Ser. No. 60/706,323 filed Aug. 8, 2005; and provisional Application Ser. No. 60/738,453 filed Nov. 21, 2005, each of which are hereby incorporated in their entirety by reference.

TECHNICAL FIELD

The present disclosure is related to wellbore drilling equipment and more particularly to designing rotary drill bits and/or bottom hole assemblies with desired bit walk characteristics or selecting a rotary drill bit and/or components for an associated bottom hole assembly with desired bit walk characteristics from existing designs.

BACKGROUND

Various types of rotary drill bits have been used to form wellbores or boreholes in downhole formations. Such wellbores are often formed using a rotary drill bit attached to the end of a generally hollow, tubular drill string extending from an associated well surface. Rotation of a rotary drill bit progressively cuts away adjacent portions of a downhole formation by contact between cutting elements and cutting structures disposed on exterior portions of the rotary drill bit. Examples of rotary drill bits include fixed cutter drill bits or drag drill bits and impregnated diamond bits. Various types of drilling fluids are often used in conjunction with rotary drill bits to form wellbores or boreholes extending from a well surface through one or more downhole formations.

Various types of computer based systems, software applications and/or computer programs have previously been used to simulate forming wellbores including, but not limited to, directional wellbores and to simulate the performance of a wide variety of drilling equipment including, but not limited to, rotary drill bits which may be used to form such wellbores. Some examples of such computer based systems, software applications and/or computer programs are discussed in various patents and other references listed on Information Disclosure Statements filed during prosecution of this patent application.

SUMMARY

In accordance with teachings of the present disclosure, rotary drill bits including fixed cutter drill bits may be designed with bit walk characteristics and/or controllability optimized for a desired wellbore profile and/or anticipated downhole drilling conditions. Alternatively, a rotary drill bit including a fixed cutter drill bit with desired bit walk and/or controllability may be selected from existing drill bit designs.

Rotary drill bits designed or selected to form a straight hole or vertical wellbore may require approximately zero or neutral bit walk. Rotary drill bits designed or selected for use with a directional drilling system may have an optimum bit walk rate for a desired wellbore profile and/or anticipated downhole drilling conditions.

One aspect of the present disclosure may include procedures to evaluate walk tendency of a rotary drill bit under a combination of bit motions including, but not limited to, rotation, axial penetration, side penetration, tilt rate and/or transition drilling. For example, methods and systems incorporating teachings of the present disclosure may be used to simulate drilling through inclined formation interfaces and complex formations with hard stringers disposed in softer formation materials and/or alternating layers of hard and soft formation materials.

Drilling a wellbore profile, trajectory, or path using a wide variety of rotary drill bits and bottom hole assemblies may be simulated in three dimensions (3D) using methods and systems incorporating teachings of the present disclosure. Such simulations may be used to design rotary drill bits and/or bottom hole assemblies with optimum bit walk characteristics for drilling a wellbore profile. Such simulation may also be used to select a rotary drill bit and/or components for an associated bottom hole assembly from existing designs with optimum bit walk characteristics for drilling a wellbore profile.

Systems and methods incorporating teachings of the present disclosure may be used to simulate drilling various types of wellbores and segments of wellbores using both push-the-bit directional drilling systems and point-the-bit directional drilling systems.

BRIEF DESCRIPTION OF THE DRAWINGS

A more complete and thorough understanding of the present disclosure and advantages thereof may be acquired by referring to the following description taken in conjunction with the accompanying drawings, in which like reference numbers indicate like features, and wherein.

DETAILED DESCRIPTION OF THE DISCLOSURE

Figure 1A:
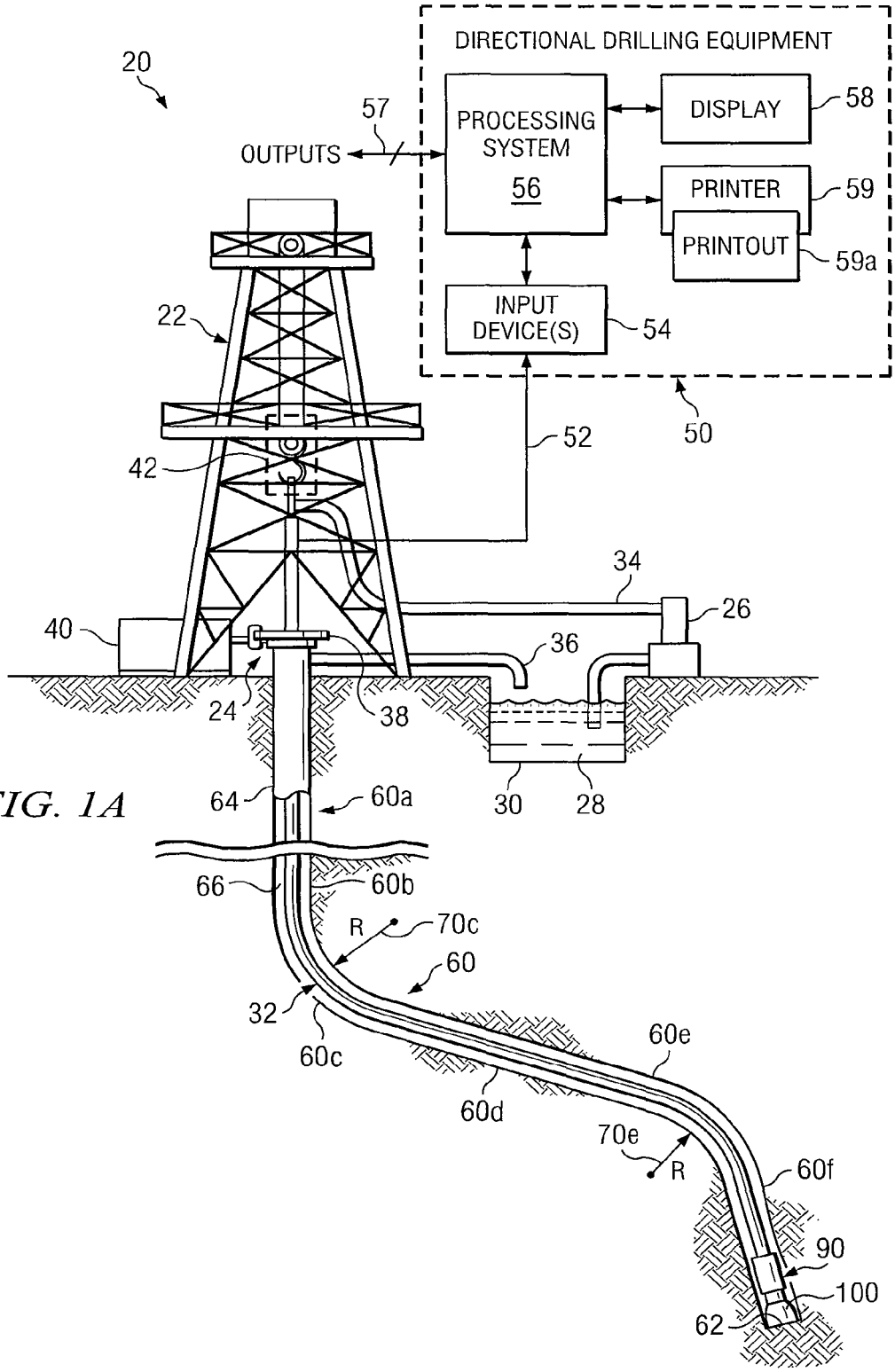
FIG. 1A is a schematic drawing in section and in elevation with portions broken away showing one example of a directional wellbore which may be formed by a drill bit designed in accordance with teachings of the present disclosure or selected from existing drill bit designs in accordance with teachings of the present disclosure.

Preferred embodiments of the present disclosure and their advantages may be understood by referring to FIGS. 1A-17G of the drawings, like numerals may be used for like and corresponding parts of the various drawings.

The term "bottom hole assembly" or "BHA" may be used in this application to describe various components and assemblies disposed proximate to a rotary drill bit at the downhole end of a drill string. Examples of components and assemblies (not expressly shown) which may be included in a bottom hole assembly or BHA include, but are not limited to, a bent sub, a downhole drilling motor, a near bit reamer, stabilizers and down hole instruments. A bottom hole assembly may also include various types of well logging tools (not expressly shown) and other downhole instruments associated with directional drilling of a wellbore. Examples of such logging tools and/or directional drilling equipment may include, but are not limited to, acoustic, neutron, gamma ray, density, photoelectric, nuclear magnetic resonance and/or any other commercially available logging instruments.

The term "cutter" may be used in this application to include various types of compacts, inserts, milled teeth, welded compacts and gage cutters satisfactory for use with a wide variety of rotary drill bits. Impact arrestors, which may be included as part of the cutting structure on some types of rotary drill bits, sometimes function as cutters to remove formation materials from adjacent portions of a wellbore. Impact arrestors or any other portion of the cutting structure of a rotary drill bit may be analyzed and evaluated using various techniques and procedures as discussed herein with respect to cutters. Polycrystalline diamond compacts (PDC) and tungsten carbide inserts are often used to form cutters for rotary drill bits. A wide variety of other types of hard, abrasive materials may also be satisfactorily used to form such cutters.

The terms "cutting element" and "cutlet" may be used to describe a small portion or segment of an associated cutter which interacts with adjacent portions of a wellbore and may be used to simulate interaction between the cutter and adjacent portions of a wellbore. As discussed later in more detail, cutters and other portions of a rotary drill bit may also be meshed into small segments or portions sometimes referred to as "mesh units" for purposes of analyzing interaction between each small portion or segment and adjacent portions of a wellbore.

The term "cutting structure" may be used in this application to include various combinations and arrangements of cutters, face cutters, impact arrestors and/or gage cutters formed on exterior portions of a rotary drill bit. Some fixed cutter drill bits may include one or more blades extending from an associated bit body with cutters disposed of the blades. Various configurations of blades and cutters may be used to form cutting structures for a fixed cutter drill bit.

The term "rotary drill bit" may be used in this application to include various types of fixed cutter drill bits, drag bits and matrix drill bits operable to form a wellbore extending through one or more downhole formations. Rotary drill bits and associated components formed in accordance with teachings of the present disclosure may have many different designs and configurations.

Simulating drilling a wellbore in accordance with teachings of the present disclosure may be used to optimize the design of various features of a rotary drill bit including, but not limited to, the number of blades or cutter blades, dimensions and configurations of each cutter blade, configuration and dimensions of junk slots disposed between adjacent cutter blades, the number, location, orientation and type of cutters and gages (active or passive) and length of associated gages. The location of nozzles and associated nozzle outlets may also be optimized.

Various teachings of the present disclosure may also be used with other types of rotary drill bits having active or passive gages similar to active or passive gages associated with fixed cutter drill bits. For example, a stabilizer (not expressly shown) located relatively close to a roller cone drill bit (not expressly shown) may function similar to a passive gage portion of a fixed cutter drill bit. A near bit reamer (not expressly shown) located relatively close to a roller cone drill bit may function similar to an active gage portion of a fixed cutter drill bit.

For fixed cutter drill bits one of the differences between a "passive gage" and an "active gage" is that a passive gage will generally not remove formation materials from the sidewall of a wellbore or borehole while an active gage may at least partially cut into the sidewall of a wellbore or borehole during directional drilling. A passive gage may deform a sidewall plastically or elastically during directional drilling. Mathematically, if we define aggressiveness of a typical face cutter as one (1.0), then aggressiveness of a passive gage is nearly zero (0) and aggressiveness of an active gage may be between 0 and 1.0, depending on the configuration of respective active gage elements.

Aggressiveness of various types of active gage elements may be determined by testing and may be inputted into a simulation program such as represented by FIGS. 17A-17G. Similar comments apply with respect to near bit stabilizers and near bit reamers contacting adjacent portions of a wellbore. Various characteristics of active and passive gages will be discussed in more detail with respect to FIGS. 7A-8D.

The term "straight hole" may be used in this application to describe a wellbore or portions of a wellbore that extends at generally a constant angle relative to vertical. Vertical wellbores and horizontal wellbores are examples of straight holes.

The terms "slant hole" and "slant hole segment" may be used in this application to describe a straight hole formed at a substantially constant angle relative to vertical. The constant angle of a slant hole is typically less than ninety (90) degrees and greater than zero (0) degrees.

Most straight holes such as vertical wellbores and horizontal wellbores with any significant length will have some variation from vertical or horizontal based in part on characteristics of associated drilling equipment used to form such wellbores. A slant hole may have similar variations depending upon the length and associated drilling equipment used to form the slant hole.

The term "directional wellbore" may be used in this application to describe a wellbore or portions of a wellbore that extend at a desired angle or angles relative to vertical. Such angles are greater than normal variations associated with straight holes. A directional wellbore sometimes may be described as a wellbore deviated from vertical.

Sections, segments and/or portions of a directional wellbore may include, but are not limited to, a vertical section, a kick off section, a building section, a holding section and/or a dropping section. A vertical section may have substantially no change in degrees from vertical. Holding sections such as slant hole segments and horizontal segments may extend at respective fixed angles relative to vertical and may have substantially zero rate of change in degrees from vertical. Transition sections formed between straight hole portions of a wellbore may include, but are not limited to, kick off segments, building segments and dropping segments. Such transition sections generally have a rate of change in degrees greater than zero. Building segments generally have a positive rate of change in degrees. Dropping segments generally have a negative rate of change in degrees. The rate of change in degrees may vary along the length of all or portions of a transition section or may be substantially constant along the length of all or portions of the transition section.

The term "kick off segment" may be used to describe a portion or section of a wellbore forming a transition between the end point of a straight hole segment and the first point where a desired DLS or tilt rate is achieved. A kick off segment may be formed as a transition from a vertical wellbore to an equilibrium wellbore with a constant curvature or tilt rate. A kick off segment of a wellbore may have a variable curvature and a variable rate of change in degrees from vertical (variable tilt rate).

A building segment having a relatively constant radius and a relatively constant change in degrees from vertical (constant tilt rate) may be used to form a transition from vertical segments to a slant hole segment or horizontal segment of a wellbore. A dropping segment may have a relatively constant radius and a relatively constant change in degrees from vertical (constant tilt rate) may be used to form a transition from a slant hole segment or a horizontal segment to a vertical segment of a wellbore. See FIG. 1A. For some applications a transition between a vertical segment and a horizontal segment may only be a building segment having a relatively constant radius and a relatively constant change in degrees from vertical. See FIG. 1B. Building segments and dropping segments may also be described as "equilibrium" segments.

The terms "dogleg severity" or "DLS" may be used to describe the rate of change in degrees of a wellbore from vertical during drilling of the wellbore. DLS is often measured in degrees per one hundred feet (°/100 ft). A straight hole, vertical hole, slant hole or horizontal hole will generally have a value of DLS of approximately zero. DLS may be positive, negative or zero.

Tilt angle (TA) may be defined as the angle in degrees from vertical of a segment or portion of a wellbore. A vertical wellbore has a generally constant tilt angle (TA) approximately equal to zero. A horizontal wellbore has a generally constant tilt angle (TA) approximately equal to ninety degrees (90°).

Tilt rate (TR) may be defined as the rate of change of a wellbore in degrees (TA) from vertical per hour of drilling. Tilt rate may also be referred to as "steer rate."

$$TR=d(TA)/dt$$

Where t=drilling time in hours

Tilt rate (TR) of a rotary drill bit may also be defined as DLS times rate of penetration (ROP).

$$TR=DLS\times ROP/100=(\text{degrees/hour})$$

Bit tilting motion is often a critical parameter for accurately simulating drilling directional wellbores and evaluating characteristics of rotary drill bits and other downhole tools used with directional drilling systems. Prior two dimensional (2D) and prior three dimensional (3D) bit models and hole models are often unable to consider bit tilting motion due to limitations of Cartesian coordinate systems or cylindrical coordinate systems used to describe bit motion relative to a wellbore. The use of spherical coordinate system to simulate drilling of directional wellbore in accordance with teachings of the present disclosure allows the use of bit tilting motion and associated parameters to enhance the accuracy and reliability of such simulations.

Various aspects of the present disclosure may be described with respect to modeling or simulating drilling a wellbore or portions of a wellbore. Dogleg severity (DLS) of respective segments, portions or sections of a wellbore and corresponding tilt rate (TR) may be used to conduct such simulations. Appendix A lists some examples of data including parameters such as simulation run time and simulation mesh size which may be used to conduct such simulations.

Various features of the present disclosure may also be described with respect to modeling or simulating drilling of a wellbore based on at least one of three possible drilling modes. See for example, FIG. 17A. A first drilling mode (straight hole drilling) may be used to simulate forming segments of a wellbore having a value of DLS approximately equal to zero. A second drilling mode (kick off drilling) may be used to simulate forming segments of a wellbore having a value of DLS greater than zero and a value of DLS which varies along portions of an associated section or segment of the wellbore. A third drilling mode (building or dropping) may be used to simulate drilling segments of a wellbore having a relatively constant value of DLS (positive or negative) other than zero.

The terms "downhole data" and "downhole drilling conditions" may include, but are not limited to, wellbore data and formation data such as listed on Appendix A.

The terms "downhole data" and "downhole drilling conditions" may also include, but are not limited to, drilling equipment operating data such as listed on Appendix A.

The terms "design parameters," "operating parameters," "wellbore parameters" and "formation parameters" may sometimes be used to refer to respective types of data such as listed on Appendix A. The terms "parameter" and "parameters" may be used to describe a range of data or multiple ranges of data. The terms "operating" and "operational" may sometimes be used interchangeably.

Directional drilling equipment may be used to form wellbores having a wide variety of profiles or trajectories. Directional drilling system 20 and wellbore 60 as shown in FIG. 1A may be used to describe various features of the present disclosure with respect to simulating drilling all or portions of a wellbore and designing or selecting drilling equipment such as a rotary drill bit based at least in part on such simulations.

Directional drilling system 20 may include land drilling rig 22. However, teachings of the present disclosure may be satisfactorily used to simulate drilling wellbores using drilling systems associated with offshore platforms, semi-submersible, drill ships and any other drilling system satisfactory for forming a wellbore extending through one or more downhole formations. The present disclosure is not limited to directional drilling systems or land drilling rigs.

Drilling rig 22 and associated directional drilling equipment 50 may be located proximate well head 24. Drilling rig 22 also includes rotary table 38, rotary drive motor 40 and other equipment associated with rotation of drill string 32 within wellbore 60. Annulus 66 may be formed between the exterior of drill string 32 and the inside diameter of wellbore 60.

For some applications drilling rig 22 may also include top drive motor or top drive unit 42. Blow out preventors (not expressly shown) and other equipment associated with drilling a wellbore may also be provided at well head 24. One or more pumps 26 may be used to pump drilling fluid 28 from fluid reservoir or pit 30 to one end of drill string 32 extending from well head 24. Conduit 34 may be used to supply drilling mud from pump 26 to the one end of drilling string 32 extending from well head 24. Conduit 36 may be used to return drilling fluid, formation cuttings and/or downhole debris from the bottom or end 62 of wellbore 60 to fluid reservoir or pit 30. Various types of pipes, tube and/or conduits may be used to form conduits 34 and 36.

Drill string 32 may extend from well head 24 and may be coupled with a supply of drilling fluid such as pit or reservoir 30. Opposite end of drill string 32 may include bottom hole assembly 90 and rotary drill bit 100 disposed adjacent to end 62 of wellbore 60. As discussed later in more detail, rotary drill bit 100 may include one or more fluid flow passageways with respective nozzles disposed therein. Various types of drilling fluids may be pumped from reservoir 30 through pump 26 and conduit 34 to the end of drill string 32 extending from well head 24. The drilling fluid may flow through a longitudinal bore (not expressly shown) of drill string 32 and exit from nozzles formed in rotary drill bit 100.

At end 62 of wellbore 60 drilling fluid may mix with formation cuttings and other downhole debris proximate drill bit 100. The drilling fluid will then flow upwardly through annulus 66 to return formation cuttings and other downhole debris to well head 24. Conduit 36 may return the drilling fluid to reservoir 30. Various types of screens, filters and/or centrifuges (not expressly shown) may be provided to remove formation cuttings and other downhole debris prior to returning drilling fluid to pit 30.

Bottom hole assembly 90 may include various components associated with a measurement while drilling (MWD) system that provides logging data and other information from the bottom of wellbore 60 to directional drilling equipment 50. Logging data and other information may be communicated from end 62 of wellbore 60 through drill string 32 using MWD techniques and converted to electrical signals at well surface 24. Electrical conduit or wires 52 may communicate the electrical signals to input device 54. The logging data provided from input device 54 may then be directed to a data processing system 56. Various displays 58 may be provided as part of directional drilling equipment 50.

For some applications printer 59 and associated printouts 59*a* may also be used to monitor the performance of drilling string 32, bottom hole assembly 90 and associated rotary drill bit 100. Outputs 57 may be communicated to various components associated with operating drilling rig 22 and may also be communicated to various remote locations to monitor the performance of directional drilling system 20.

Wellbore 60 may be generally described as a directional wellbore or a deviated wellbore having multiple segments or sections. Section 60*a* of wellbore 60 may be defined by casing 64 extending from well head 24 to a selected downhole location. Remaining portions of wellbore 60 as shown in FIG. 1A may be generally described as "open hole" or "uncased."

Teachings of the present disclosure may be used to simulate drilling a wide variety of vertical, directional, deviated, slanted and/or horizontal wellbores. Teachings of the present disclosure are not limited to simulating drilling wellbore 60, designing drill bits for use in drilling wellbore 60 or selecting drill bits from existing designs for use in drilling wellbore 60.

Wellbore 60 as shown in FIG. 1A may be generally described as having multiple sections, segments or portions with respective values of DLS. The tilt rate for rotary drill bit 100 during formation of wellbore 60 will be a function of DLS for each segment, section or portion of wellbore 60 times the rate of penetration for rotary drill bit 100 during formation of the respective segment, section or portion thereof. The tilt rate of rotary drill bit 100 during formation of straight hole sections or vertical section 80*a* and horizontal section 80*c* will be approximately equal to zero.

Section 60*a* extending from well head 24 may be generally described as a vertical, straight hole section with a value of DLS approximately equal to zero. When the value of DLS is zero, rotary drill bit 100 will have a tile rate of approximately zero during formation of the corresponding section of wellbore 60.

A first transition from vertical section 60*a* may be described as kick off section 60*b*. For some applications the value of DLS for kick off section 60*b* may be greater than zero and may vary from the end of vertical section 60*a* to the beginning of a second transition segment or building section 60*c*. Building section 60*c* may be formed with relatively constant radius 70*c* and a substantially constant value of DLS. Building section 60*c* may also be referred to as third section 60*c* of wellbore 60.

Fourth section 60*d* may extend from build section 60*c* opposite from second section 60*b*. Fourth section 60*d* may be described as a slant hole portion of wellbore 60. Section 60*d* may have a DLS of approximately zero. Fourth section 60*d* may also be referred to as a "holding" section.

Fifth section 60*e* may start at the end of holding section 60*d*. Fifth section 60*e* may be described as a "drop" section having a generally downward looking profile. Drop section 60*e* may have relatively constant radius 70*e*.

Sixth section 60*f* may also be described as a holding section or slant hole section with a DLS of approximately zero. Section 60*f* as shown in FIG. 1A is being formed by rotary drill bit 100, drill string 32 and associated components of drilling system 20.

Figure 1B:
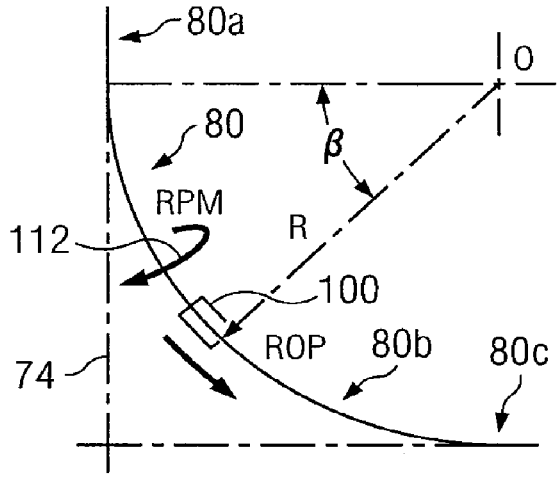
FIG. 1B is a schematic drawing showing a graphical representation of a directional wellbore having a constant bend radius between a generally vertical section and a generally horizontal section which may be formed by a drill bit designed in accordance with teachings of the present disclosure or selected from existing drill bit designs in accordance with teachings of the present disclosure.

FIG. 1B is a graphical representation of a specific type of directional wellbore represented by wellbore 80. For this example wellbore 80 may include three segments or three sections—vertical section 80*a*, building section 80*b* and horizontal section 80*c*. Vertical section 80*a* and horizontal section 80*c* may be straight holes with a value of DLS approximately equal to zero. Building section 80*b* may have a constant radius corresponding with a constant rate of change in degrees from vertical and a constant value of DLS. Tilt rate during formation building section 80*b* may be constant if ROP of a drill bit forming build section 80*b* remains constant.

Figure 15A:
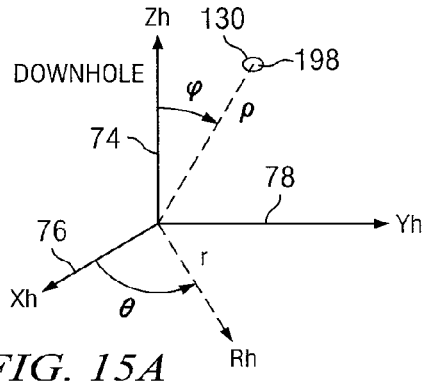
FIG. 15A is a schematic drawing showing a graphical representation of a spherical coordinate system which may be used to describe motion of a rotary drill bit and also describe the bottom of a wellbore in accordance with teachings of the present disclosure.
Figure 16:
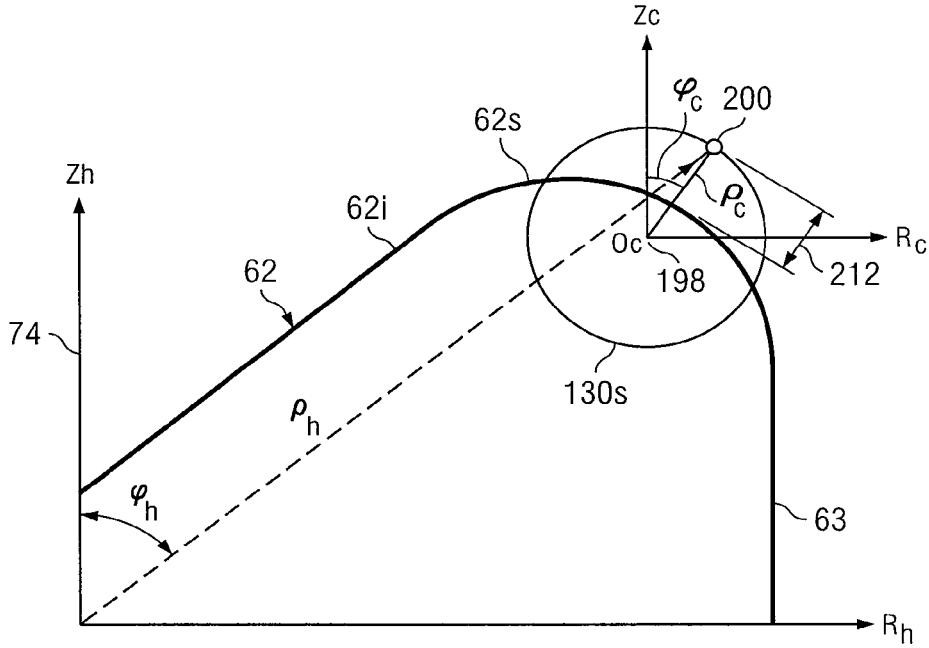
FIG. 16 is a graphical representation of one example of calculations used to estimate cutting depth of a cutter disposed on a rotary drill bit in accordance with teachings of the present disclosure.

Movement or motion of a rotary drill bit and associated drilling equipment in three dimensions (3D) during formation of a segment, section or portion of a wellbore may be defined by a Cartesian coordinate system (X, Y, and Z axes) and/or a spherical coordinate system (two angles $\phi$ and $\theta$ and a single radius $\rho$) in accordance with teachings of the present disclosure. Examples of Cartesian coordinate systems are shown in FIGS. 2A and 3A-3C. Examples of spherical coordinate systems are shown in FIGS. 15A and 16. Various aspects of the present disclosure may include translating the location of downhole drilling equipment and adjacent portions of a wellbore between a Cartesian coordinate system and a spherical coordinate system. FIG. 15A shows one example of translating the location of a single point between a Cartesian coordinate system and a spherical coordinate system.

Figure 1C:
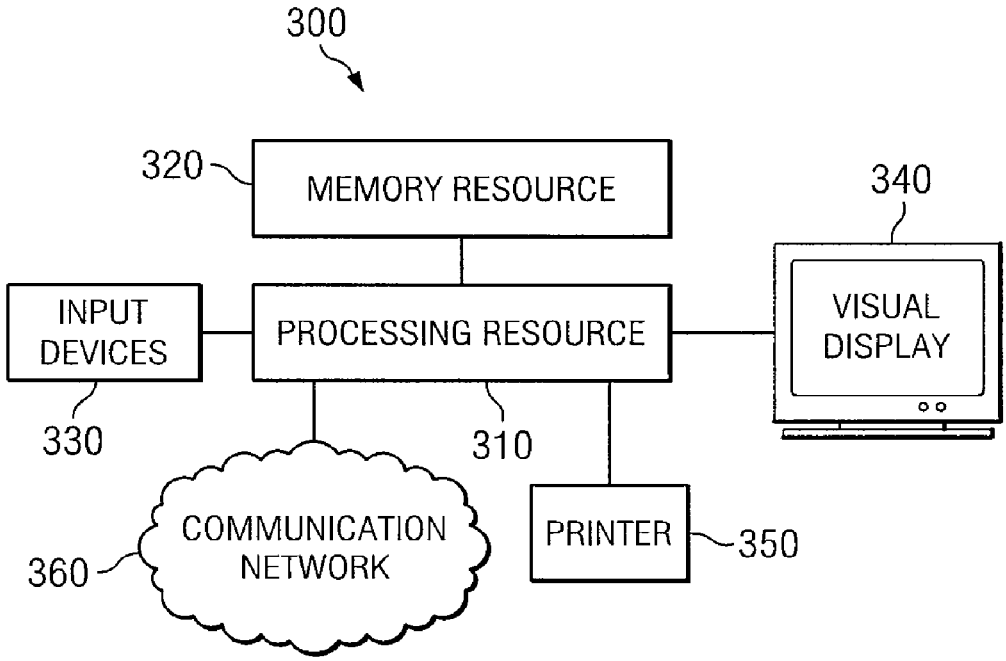
FIG. 1C is a schematic drawing showing one example of a system and associate apparatus operable to simulate drilling a complex, directional wellbore in accordance with teachings of the present disclosure.

FIG. 1C shows one example of a system operable to simulate drilling a complex, directional wellbore in accordance with teachings of this present disclosure. System 300 may include one or more processing resources 310 operable to run software and computer programs incorporating teaching of the present disclosure. A general purpose computer may be used as a processing resource. All or portions of software and computer programs used by processing resource 310 may be stored one or more memory resources 320. One or more input devices 330 may be operate to supply data and other information to processing resources 310 and/or memory resources 320. A keyboard, keypad, touch screen and other digital input mechanisms may be used as an input device. Examples of such data are shown on Appendix A.

Processing resources 310 may be operable to simulate drilling a directional wellbore in accordance with teachings of the present disclosure. Processing resources 310 may be operate to use various algorithms to make calculations or estimates based on such simulations.

Display resources 340 may be operable to display both data input into processing resources 310 and the results of simulations and/or calculations performed in accordance with teachings of the present disclosure. A copy of input data and results of such simulations and calculations may also be provided at printer 350.

For some applications, processing resource 310 may be operably connected with communication network 360 to accept inputs from remote locations and to provide the results of simulation and associated calculations to remote locations and/or facilities such as directional drilling equipment 50 shown in FIG. 1A.

Figure 2A:
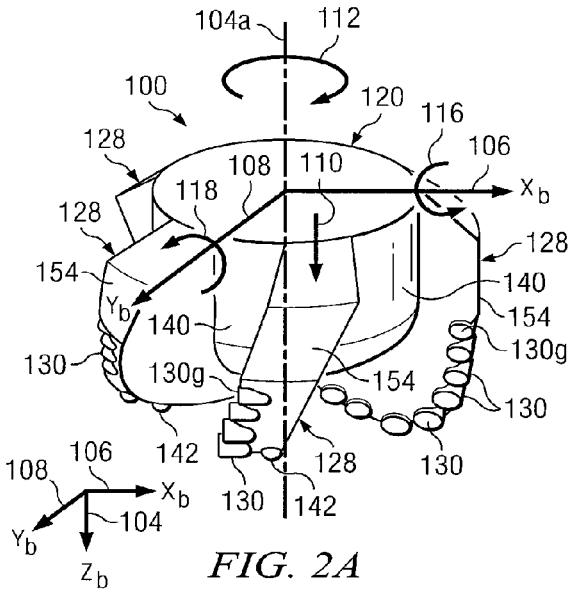
FIG. 2A is a schematic drawing showing an isometric view with portions broken away of a rotary drill bit with six (6) degrees of freedom which may be used to describe motion of the rotary drill bit in three dimensions in a bit coordinate system.
Figure 3A:
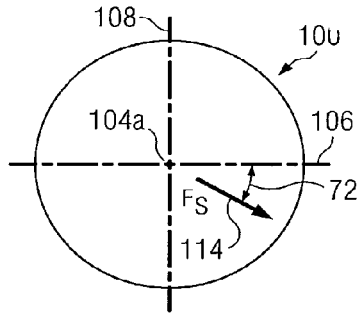
FIG. 3A is a schematic representation showing a side force applied to a rotary drill bit at an instant in time in a two dimensional Cartesian bit coordinate system.
Figure 3B:
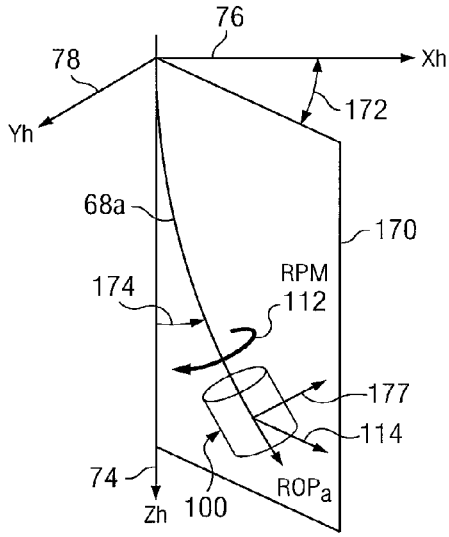
FIG. 3B is a schematic representation showing a trajectory of a directional wellbore and a rotary drill bit disposed in a tilt plane at an instant of time in a three dimensional Cartesian hole coordinate system.
Figure 3C:
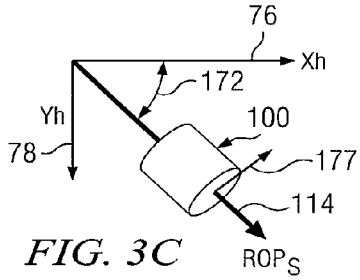
FIG. 3C is a schematic representation showing the rotary drill bit in FIG. 3B at the same instant of time in a two dimensional Cartesian hole coordinate system.

A Cartesian coordinate system generally includes a Z axis and an X axis and a Y axis which extend normal to each other and normal to the Z axis. See for example FIG. 2A. A Cartesian bit coordinate system may be defined by a Z axis extending along a rotational axis or bit rotational axis of the rotary drill bit. See FIG. 2A. A Cartesian hole coordinate system (sometimes referred to as a "downhole coordinate system" or a "wellbore coordinate system") may be defined by a Z axis extending along a rotational axis of the wellbore. See FIG. 3B. In FIG. 2A the X, Y and Z axes include subscript $_{(b)}$ to indicate a "bit coordinate system". In FIGS. 3A, 3B and 3C the X, Y and Z axes include subscript $_{(h)}$ to indicate a "hole coordinate system".

FIG. 2A is a schematic drawing showing rotary drill bit 100. Rotary drill bit 100 may include bit body 120 having a plurality of blades 128 with respective junk slots or fluid flow paths 140 formed therebetween. A plurality of cutting elements 130 may be disposed on the exterior portions of each blade 128. Various parameters associated with rotary drill bit 100 including, but not limited to, the location and configuration of blades 128, junk slots 140 and cutting elements 130. Such parameters may be designed in accordance with teachings of the present disclosure for optimum performance of rotary drill bit 100 in forming portions of a wellbore.

Each blade 128 may include respective gage surface or gage portion 154. Gage surface 154 may be an active gage and/or a passive gage. Respective gage cutter 130*g* may be disposed on each blade 128. A plurality of impact arrestors 142 may also be disposed on each blade 128. Additional information concerning impact arrestors may be found in U.S. Pat. Nos. 6,003,623, 5,595,252 and 4,889,017.

Figure 2B:
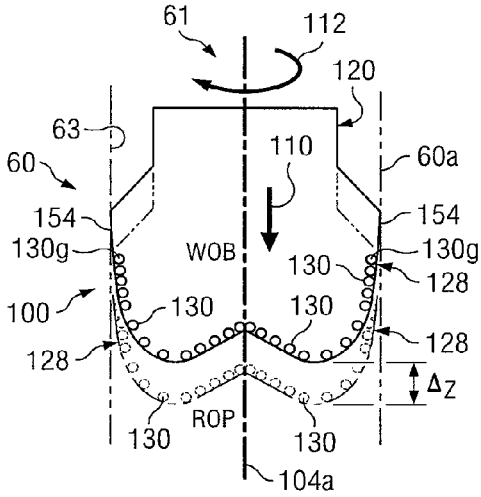
FIG. 2B is a schematic drawing showing forces applied to a rotary drill bit while forming a substantially vertical wellbore.

Rotary drill bit 100 may translate linearly relative to the X, Y and Z axes as shown in FIG. 2A (three (3) degrees of freedom). Rotary drill bit 100 may also rotate relative to the X, Y and Z axes (three (3) additional degrees of freedom). As a result movement of rotary drill bit 100 relative to the X, Y and Z axes as shown in FIGS. 2A and 2B, rotary drill bit 100 may be described as having six (6) degrees of freedom.

Movement or motion of a rotary drill bit during formation of a wellbore may be fully determined or defined by six (6) parameters corresponding with the previously noted six degrees of freedom. The six parameters as shown in FIG. 2A include rate of linear motion or translation of rotary drill bit 100 relative to respective X, Y and Z axes and rotational motion relative to the same X, Y and Z axes. These six parameters are independent of each other.

For straight hole drilling these six parameters may be reduced to revolutions per minute (RPM) and rate of penetration (ROP). For kick off segment drilling these six parameters may be reduced to RPM, ROP, dogleg severity (DLS), bend length ($B_L$) and azimuth angle of an associated tilt plane. See tilt plane 170 in FIG. 3B. For equilibrium drilling these six parameters may be reduced to RPM, ROP and DLS based on the assumption that the rotational axis of the associated rotary drill bit will move in the same vertical plane or tilt plane.

For calculations related to steerability only forces acting in an associated tilt plane are considered. Therefore an arbitrary azimuth angle may be selected usually equal to zero. For calculations related to bit walk forces in the associated tilt plane and forces in a plane perpendicular to the tilt plane are considered.

In a bit coordinate system, rotational axis or bit rotational axis 104*a* of rotary drill bit 100 corresponds generally with Z axis 104 of the associated bit coordinate system. When sufficient force from rotary drill string 32 has been applied to rotary drill bit 100, cutting elements 130 will engage and remove adjacent portions of a downhole formation at bottom hole or end 62 of wellbore 60. Removing such formation materials will allow downhole drilling equipment including rotary drill bit 100 and associated drill string 32 to tilt or move linearly relative to adjacent portions of wellbore 60.

Various kinematic parameters associated with forming a wellbore using a rotary drill bit may be based upon revolutions per minute (RPM) and rate of penetration (ROP) of the rotary drill bit into adjacent portions of a downhole formation. Arrow 110 may be used to represent forces which move rotary drill bit 100 linearly relative to rotational axis 104*a*. Such linear forces typically result from weight applied to rotary drill bit 100 by drill string 32 and may be referred to as "weight on bit" or WOB.

Rotational force 112 may be applied to rotary drill bit 100 by rotation of drill string 32. Revolutions per minute (RPM) of rotary drill bit 100 may be a function of rotational force 112. Rotation speed (RPM) of drill bit 100 is generally defined relative to the rotational axis of rotary drill bit 100 which corresponds with Z axis 104.

Arrow 116 indicates rotational forces which may be applied to rotary drill bit 100 relative to X axis 106. Arrow 118 indicates rotational forces which may be applied to rotary drill bit 100 relative to Y axis 108. Rotational forces 116 and 118 may result from interaction between cutting elements 130 disposed on exterior portions of rotary drill bit 100 and adjacent portions of bottom hole 62 during the forming of wellbore 60. Rotational forces applied to rotary drill bit 100 along X axis 106 and Y axis 108 may result in tilting of rotary drill bit 100 relative to adjacent portions of drill string 32 and wellbore 60.

FIG. 2B is a schematic drawing showing rotary drill bit 100 disposed within vertical section or straight hole section 60*a* of wellbore 60. During the drilling of a vertical section or any other straight hole section of a wellbore, the bit rotational axis of rotary drill bit 100 will generally be aligned with a corresponding rotational axis of the straight hole section. The incremental change or the incremental movement of rotary drill bit 100 in a linear direction during a single revolution may be represented by AZ in FIG. 2B.

Rate of penetration (ROP) of a rotary drill bit is typically a function of both weight on bit (WOB) and revolutions per minute (RPM). For some applications a downhole motor (not expressly shown) may be provided as part of bottom hole assembly 90 to also rotate rotary drill bit 100. The rate of penetration of a rotary drill bit is generally stated in feet per hour.

The axial penetration of rotary drill bit 100 may be defined relative to bit rotational axis 104*a* in an associated bit coordinate system. A side penetration rate or lateral penetration rate of rotary drill bit 100 may be defined relative to an associated hole coordinate system. Examples of a hole coordinate system are shown in FIGS. 3A, 3B and 3C. FIG. 3A is a schematic representation of a model showing side force 114 applied to rotary drill bit 100 relative to X axis 106 and Y axis 108. Angle 72 formed between force vector 114 and X axis 106 may correspond approximately with angle 172 associated with tilt plane 170 as shown in FIG. 3B. A tilt plane may be defined as a plane extending from an associated Z axis or vertical axis in which dogleg severity (DLS) or tilting of the rotary drill bit occurs.

Various forces may be applied to rotary drill bit 100 to cause movement relative to X axis 106 and Y axis 108. Such forces may be applied to rotary drill bit 100 by one or more components of a directional drilling system included within bottom hole assembly 90. See FIGS. 4A, 4B, 5A and 5B. Various forces may also be applied to rotary drill bit 100 relative to X axis 106 and Y axis 108 in response to engagement between cutting elements 130 and adjacent portions of a wellbore.

During drilling of straight hole segments of wellbore 60, side forces applied to rotary drill bit 100 may be substantially minimized (approximately zero side forces) or may be balanced such that the resultant value of any side forces will be approximately zero. Straight hole segments of wellbore 60 as shown in FIG. 1A include, but are not limited to, vertical section 60*a*, holding section or slant hole section 60*d*, and holding section or slant hole section 60*f*.

One of the benefits of the present disclosure may include the ability to design a rotary drill bit having either substantially zero side forces or balanced sided forces while drilling a straight hole segment of a wellbore. As a result, any side forces applied to a rotary drill bit by associated cutting elements may be substantially balanced and/or reduced to a small value such that rotary drill bit 100 will have either substantially zero tendency to walk or a neutral tendency to walk relative to a vertical axis.

During formation of straight hole segments of wellbore 60, the primary direction of movement or translation of rotary drill bit 100 will be generally linear relative to an associated longitudinal axis of the respective wellbore segment and relative to associated bit rotational axis 104*a*. See FIG. 2B. During the drilling of portions of wellbore 60 having a DLS with a value greater than zero or less than zero, a side force ($F_s$) or equivalent side force may be applied to rotary drill bit to cause formation of corresponding wellbore segments 60*b*, 60*c* and 60*e*.

For some applications such as when a push-the-bit directional drilling system is used with a rotary drill bit, an applied side force may result in a combination of bit tilting and side cutting or lateral penetration of adjacent portions of a wellbore. For other applications such as when a point-the-bit directional drilling system is used with an associated rotary drill bit, side cutting or lateral penetration may generally be very small or may not even occur. When a point-the-bit directional drilling system is used with a rotary drill bit, directional portions of a wellbore may be formed primarily as a result of bit penetration along an associated bit rotational axis and tilting of the rotary drill bit relative to a vertical axis.

FIGS. 3A, 3B and 3C are graphical representations of various kinematic parameters which may be satisfactorily used to model or simulate drilling segments or portions of a wellbore having a value of DLS greater than zero. FIG. 3A shows a schematic cross section of rotary drill bit 100 in two dimensions relative to a Cartesian bit coordinate system. The bit coordinate system is defined in part by X axis 106 and Y axis 108 extending from bit rotational axis 104*a*. FIGS. 3B and 3C show graphical representations of rotary drill bit 100 during drilling of a transition segment such as kick off segment 60*b* of wellbore 60 in a Cartesian hole coordinate system defined in part by Z axis 74, X axis 76 and Y axis 78.

A side force is generally applied to a rotary drill bit by an associated directional drilling system to form a wellbore having a desired profile or trajectory using the rotary drill bit. For a given set of drilling equipment design parameters and a given set of downhole drilling conditions, a respective side force must be applied to an associated rotary drill bit to achieve a desired DLS or tilt rate. Therefore, forming a directional wellbore using a point-the-bit directional drilling system, a push-the-bit directional drilling system or any other directional drilling system may be simulated using substantially the same model incorporating teachings of the present disclosure by determining a required bit side force to achieve an expected DLS or tilt rate for each segment of a directional wellbore.

FIG. 3A shows side force 114 extending at angle 72 relative to X axis 106. Side force 114 may be applied to rotary drill bit 100 by directional drilling system 20. Angle 72 (sometimes referred to as an "azimuth" angle) extends from rotational axis 104*a* of rotary drill bit 100 and represents the angle at which side force 114 will be applied to rotary drill bit 100. For some applications side force 114 may be applied to rotary drill bit 100 at a relatively constant azimuth angle.

Side force 114 will typically result in movement of rotary drill bit 100 laterally relative to adjacent portions of wellbore 60. Directional drilling systems such as rotary drill bit steering units shown in FIGS. 4A and 5A may be used to either vary the amount of side force 114 or to maintain a relatively constant amount of side force 114 applied to rotary drill bit 100. Directional drilling systems may also vary the azimuth angle at which a side force is applied to correspond with a desired wellbore trajectory.

Side force 114 may be adjusted or varied to cause associated cutting elements 130 to interact with adjacent portions of a downhole formation so that rotary drill bit 100 will follow profile or trajectory 68*b*, as shown in FIG. 3B, or any other desired profile. Profile 68*b* may correspond approximately with a longitudinal axis extending through kick off segment 60*b*. Rotary drill bit 100 will generally move only in tilt plane 170 during formation of kickoff segment 60*b* if rotary drill bit 100 has zero walk tendency or neutral walk tendency. Tilt plane 170 may also be referred to as an "azimuth plane".

Respective tilting angles (not expressly shown) of rotary drill bit 100 will vary along the length of trajectory 68*b*. Each tilting angle of rotary drill bit 100 as defined in a hole coordinate system ($Z_h$, $X_h$, $Y_h$) will generally lie in tilt plane 170. As previously noted, during the formation of a kickoff segment of a wellbore, tilting rate in degrees per hour as indicated by arrow 174 will also increase along trajectory 68*b*. For use in simulating forming kickoff segment 60*b*, side penetration rate, side penetration azimuth angle, tilting rate and tilt plane azimuth angle may be defined in a hole coordinate system which includes Z axis 74, X axis 76 and Y axis 78.

Arrow 174 corresponds with the variable tilt rate of rotary drill bit 100 relative to vertical at any one location along trajectory 68*b*. During movement of rotary drill bit 100 along profile or trajectory 68*a*, the respective tilt angle at each location on trajectory 68*a* will generally increase relative to Z axis 74 of the hole coordinate system shown in FIG. 3B. For embodiments such as shown in FIG. 3B, the tilt angle at each point on trajectory 68*b* will be approximately equal to an angle formed by a respective tangent extending from the point in question and intersecting Z axis 74. Therefore, the tilt rate will also vary along the length of trajectory 168.

During the formation of kick off segment 60*b* and any other portions of a wellbore in which the value of DLS is either greater than or less than zero and is not constant, rotary drill bit 100 may experience side cutting motion, bit tilting motion and axial penetration in a direction associated with cutting or removing of formation materials from the end or bottom of a wellbore.

For embodiments such as shown in FIGS. 3A, 3B and 3C directional drilling system 20 may cause rotary drill bit 100 to move in the same azimuth plane 170 during formation of kick off segment 60*b*. FIGS. 3B and 3C show relatively constant azimuth plane angle 172 relative to the X axis 76 and Y axis 78. Arrow 114 as shown in FIG. 3B represents a side force applied to rotary drill bit 100 by directional drilling system 20. Arrow 114 will generally extend normal to rotational axis 104*a* of rotary drill bit 100. Arrow 114 will also be disposed in tilt plane 170. A side force applied to a rotary drill bit in a tilt plane by an associate rotary drill bit steering unit or directional drilling system may also be referred to as a "steer force."

During the formation of a directional wellbore such as shown in FIG. 3B, without consideration of bit walk, rotational axis 104*a* of rotary drill bit 100 and a longitudinal axis of bottom hole assembly 90 may generally lie in tilt plane 170. Rotary drill bit 100 will experience tilting motion in tilt plane 170 while rotating relative to rotational axis 104*a*. The tilting motion may result from a side force or steer force applied to rotary drill bit 100 by a directional steering unit such as shown in FIGS. 4A AND 4B or 5A and 5B of an associated directional drilling system. The tilting motion results from a combination of side forces and/or axial forces applied to rotary drill bit 100 by directional drilling system 20.

If rotary drill bit 100 walks, either left or right, bit 100 will generally not move in the same azimuth plane or tilt plane 170 during formation of kickoff segment 60*b*. As discussed later in more detail with respect to FIGS. 9 and 10 rotary drill bit 100 may also experience a walk force ($F_W$) as indicated by arrow 177. Arrow 177 as shown in FIGS. 3B and 3C represents a walk force which will cause rotary drill bit 100 to "walk" left relative to tilt plane 170. Simulations of forming a wellbore in accordance with teachings of the present disclosure may be used to modify cutting elements, bit face profiles, gages and other characteristics of a rotary drill bit to substantially reduce or minimize the walk force represented by arrow 177 or to provide a desired right walk rate or left walk rate.

Various features of the present disclosure will be discussed with respect to directional drilling equipment including rotary drills such as shown in FIGS. 4A, 4B, 51 and 5B. These features may be described with respect to vertical axis 74 or Z axis 74 of a Cartesian hole coordinate system such as shown in FIG. 3B. During drilling of a vertical segment or other types of straight hole segments, vertical axis 74 will generally be aligned with and correspond to an associate longitudinal axis of the vertical segment or straight hole segment. Vertical axis 74 will also generally be aligned with and correspond to an associate bit rotational axis during such straight hole drilling.

Figure 4A:
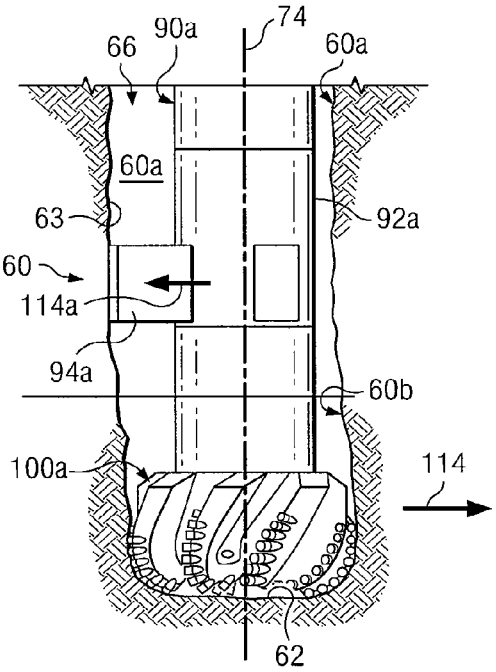
FIG. 4A is a schematic drawing in section and in elevation with portions broken away showing one example of a push-the-bit directional drilling system adjacent to the end of a wellbore.

FIG. 4A shows portions of bottom hole assembly 90*a* disposed in a generally vertical portion 60*a* of wellbore 60 as rotary drill bit 100*a* begins to form kick off segment 60*b*. Bottom hole assembly 90*a* may include rotary drill bit steering unit 92*a* operable to apply side force 114 to rotary drill bit 100*a*. Steering unit 92*a* may be one portion of a push-the-bit directional drilling system.

Push-the-bit directional drilling systems generally require simultaneous axial penetration and side penetration in order to drill directionally. Bit motion associated with push-the-bit directional drilling systems is often a combination of axial bit penetration, bit rotation, bit side cutting and bit tilting. Simulation of forming a wellbore using a push-the-bit directional drilling system based on a 3D model operable to consider bit tilting motion may result in a more accurate simulation. Some of the benefits of using a 3D model operable to consider bit tilting motion in accordance with teachings of the present disclosure will be discussed with respect to FIGS. 6A-6D.

Steering unit 92*a* may extend arm 94*a* to apply force 114*a* to adjacent portions of wellbore 60 and maintain desired contact between steering unit 92*a* and adjacent portions of wellbore 60. Side forces 114 and 114*a* may be approximately equal to each other. If there is no weight on rotary drill bit 100*a*, no axial penetration will occur at end or bottom hole 62 of wellbore 60. Side cutting will generally occur as portions of rotary drill bit 100*a* engage and remove adjacent portions of wellbore 60*a*.

Figure 4B:
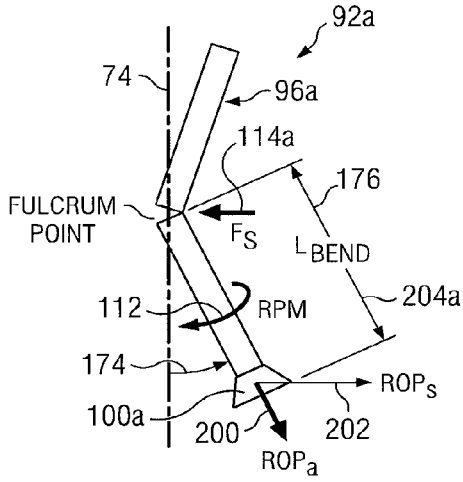
FIG. 4B is a graphical representation showing portions of a push-the-bit directional drilling system forming a directional wellbore.

FIG. 4B shows various parameters associated with a push-the-bit directional drilling system. Steering unit 92*a* will generally include bent subassembly 96*a*. A wide variety of bent subassemblies (sometimes referred to as "bent subs") may be satisfactorily used to allow drill string 32 to rotate drill bit 100*a* while steering unit 92*a* pushes or applies required force to move rotary drill bit 100*a* at a desired tilt rate relative to vertical axis 74. Arrow 200 represents the rate of penetration relative to the rotational axis of rotary drill bit 100*a* ($ROP_a$). Arrow 202 represents the rate of side penetration of rotary drill bit 200 ($ROP_s$) as steering unit 92*a* pushes or directs rotary drill bit 100*a* along a desired trajectory or path.

Tilt rate 174 and associated tilt angle may remain relatively constant for some portions of a directional wellbore such as a slant hole segment or a horizontal hole segment. For other portions of a directional wellbore tilt rate 174 may increase during formation of respective portions of the wellbore such as a kick off segment. Bend length 204*a* may be a function of the distance between arm 94*a* contacting adjacent portions of wellbore 60 and the end of rotary drill bit 100*a*.

Bend length ($L_{Bend}$) may be used as one of the inputs to simulate forming portions of a wellbore in accordance with teachings of the present disclosure. Bend length or tilt length may be generally described as the distance from a fulcrum point of an associated bent subassembly to a furthest location on a "bit face" or "bit face profile" of an associated rotary drill bit. The furthest location may also be referred to as the extreme end of the associated rotary drill bit.

Some directional drilling techniques and systems may not include a bent subassembly. For such applications bend length may be taken as the distance from a first contact point between an associated bottom hole assembly with adjacent portions of the wellbore to an extreme end of a bit face on an associated rotary drill bit.

During formation of a kick off section or any other portion of a deviated wellbore, axial penetration of an associated drill bit will occur in response to weight on bit (WOB) and/or axial forces applied to the drill bit by a downhole drilling motor. Also, bit tilting motion relative to a bent sub, not side cutting or lateral penetration, will typically result from a side force or lateral force applied to the drill bit as a component of WOB and/or axial forces applied by a downhole drilling motor. Therefore, bit motion is usually a combination of bit axial penetration and bit tilting motion.

When bit axial penetration rate is very small (close to zero) and the distance from the bit to the bent sub or bend length is very large, side penetration or side cutting may be a dominated motion of the drill bit. The resulting bit motion may or may not be continuous when using a push-the-bit directional drilling system depending upon the weight on bit, revolutions per minute, applied side force and other parameters associated with rotary drill bit 100*a*.

Figure 4C:
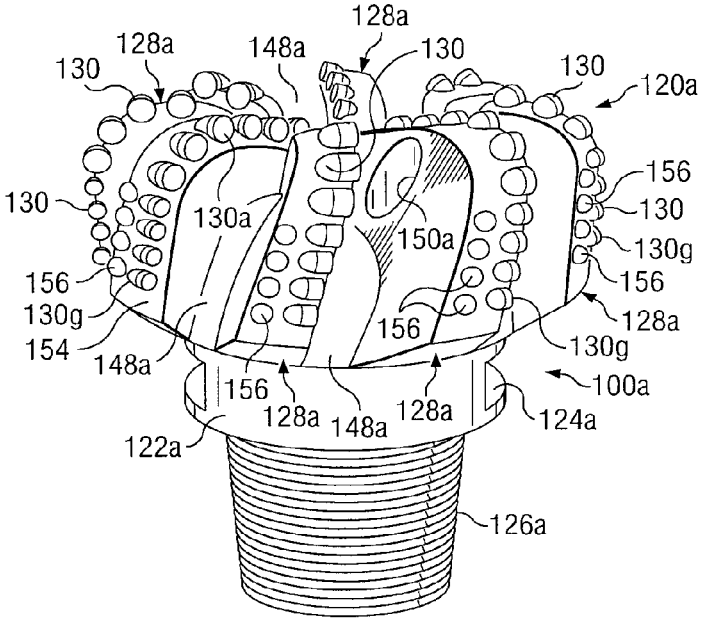
FIG. 4C is a schematic drawing showing an isometric view of a rotary drill bit having various design features which may be optimized for use with a push-the-bit directional drilling system in accordance with teachings of the present disclosure.

FIG. 4C is a schematic drawing showing one example of a rotary drill bit which may be designed in accordance with teachings of the present disclosure for optimum performance in a push-the-bit directional drilling system. For example, a three dimensional model such as shown in FIGS. 17A-17G may be used to design a rotary drill bit with optimum active and/or passive gage length for use with a push-the-bit directional drilling system. Rotary drill bit 100*a* may be generally described as a fixed cutter drill bit. For some applications rotary drill bit 100*a* may also be described as a matrix drill bit, steel body drill bit and/or a PDC drill bit.

Rotary drill bit 100*a* may include bit body 120*a* with shank 122*a*. The dimensions and configuration of bit body 120*a* and shank 122*a* may be substantially modified as appropriate for each rotary drill bit. See FIGS. 5C and 5D.

Shank 122*a* may include bit breaker slots 124*a* formed on the exterior thereof. Pin 126*a* may be formed as an integral part of shank 122*a* extending from bit body 120*a*. Various types of threaded connections, including but not limited to, API connections and premium threaded connections may be formed on the exterior of pin 126*a*.

A longitudinal bore (not expressly shown) may extend from end 121*a* of pin 126*a* through shank 122*a* and into bit body 120*a*. The longitudinal bore may be used to communicate drilling fluids from drilling string 32 to one or more nozzles (not expressly shown) disposed in bit body 120*a*. Nozzle outlet 150*a* is shown in FIG. 4C.

A plurality of cutter blades 128*a* may be disposed on the exterior of bit body 120*a*. Respective junk slots or fluid flow slots 148*a* may be formed between adjacent blades 128*a*. Each blade 128 may include a plurality of cutting elements 130 formed from very hard materials associated with forming a wellbore in a downhole formation. For some applications cutting elements 130 may also be described as "face cutters".

Respective gage cutter 130*g* may be disposed on each blade 128*a*. For embodiments such as shown in FIG. 4C rotary drill bit 100*a* may be described as having an active gage or active gage elements disposed on exterior portion of each blade 128*a*. Gage surface 154 of each blade 128*a* may also include a plurality of active gage elements 156. Active gage elements 156 may be formed from various types of hard abrasive materials sometimes referred to as "hardfacing". Active elements 156 may also be described as "buttons" or "gage inserts". As discussed later in more detail with respect to FIGS. 7B, 8A and 8B active gage elements may contact adjacent portions of a wellbore and remove some formation materials as a result of such contact.

Figure 7A:
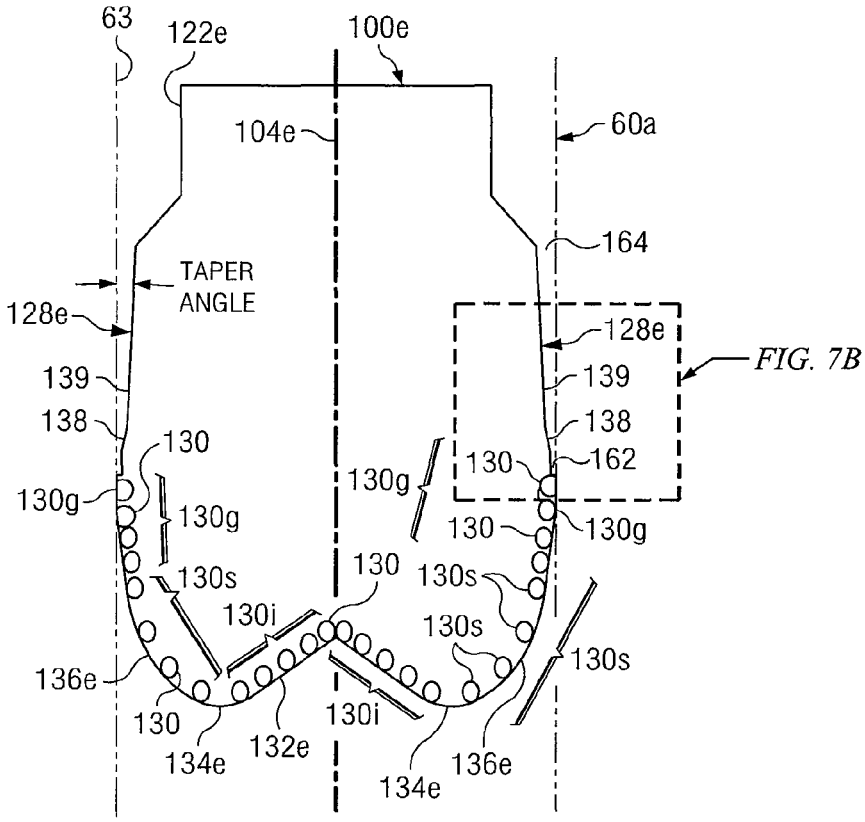
FIG. 7A is a schematic drawing in section with portions broken away showing another example of a rotary drill bit disposed within a wellbore.

Exterior portions of bit body 120*a* opposite from shank 122*a* may be generally described as a "bit face" or "bit face profile." As discussed later in more detail with respect to rotary drill bit 100*e* as shown in FIG. 7A, a bit face profile may include a generally cone-shaped recess or indentation having a plurality of inner cutters and a plurality of shoulder cutters disposed on exterior portions of each blade 128*a*. One of the benefits of the present disclosure includes the ability to design a rotary drill bit having an optimum number of inner cutters, shoulder cutters and gage cutters to provide desired walk rate, bit steerability, and bit controllability.

Figure 5A:
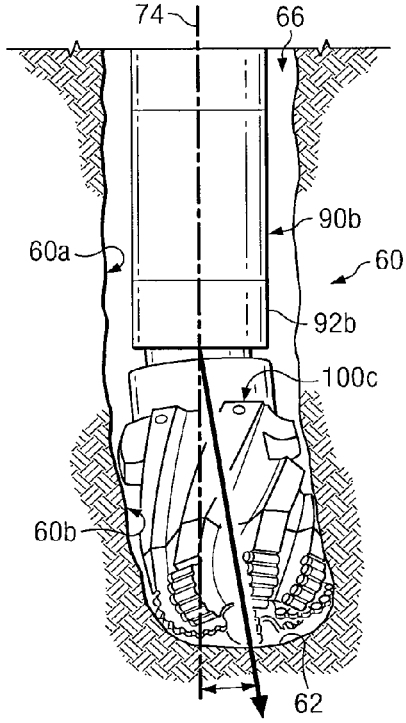
FIG. 5A is a schematic drawing in section and in elevation with portions broken away showing one example of a point-the-bit directional drilling system adjacent to the end of a wellbore.

FIG. 5A shows portions of bottom hole assembly 90*b* disposed in a generally vertical section of wellbore 60*a* as rotary drill bit 100*b* begins to form kick off segment 60*b*. Bottom hole assembly 90*b* includes rotary drill bit steering unit 92*b* which may provide one portion of a point-the-bit directional drilling system.

Point-the-bit directional drilling systems typically form a directional wellbore using a combination of axial bit penetration, bit rotation and bit tilting. Point-the-bit directional drilling systems may not produce side penetration such as described with respect to steering unit 92*b* in FIG. 5A. Therefore, bit side penetration is generally not created by point-the-bit directional drilling systems to form a directional wellbore. It is particularly advantageous to simulate forming a wellbore using a point-the-bit directional drilling system using a three dimensional model operable to consider bit tilting motion in accordance with teachings of the present disclosure. One example of a point-the-bit directional drilling system is the Geo-Pilot® Rotary Steerable System available from Sperry Drilling Services at Halliburton Company.

Figure 5C:
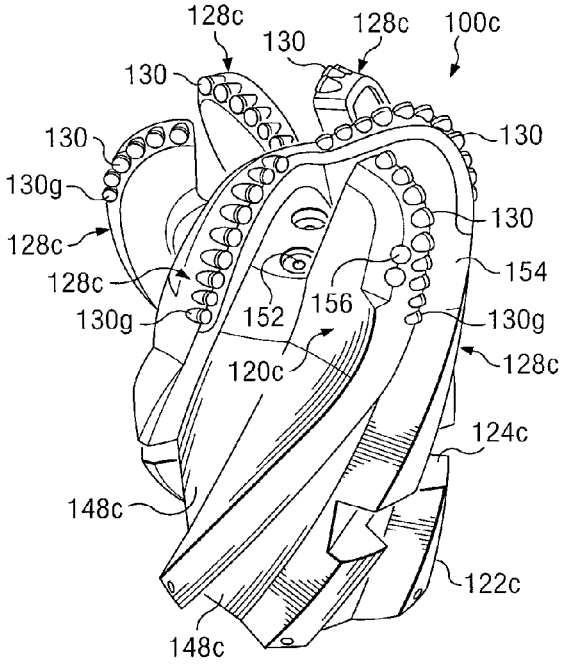
FIG. 5C is a schematic drawing showing an isometric view of a rotary drill bit having various design features which may be optimized for use with a point-the-bit directional drilling system in accordance with teachings of the present disclosure.
Figure 5B:
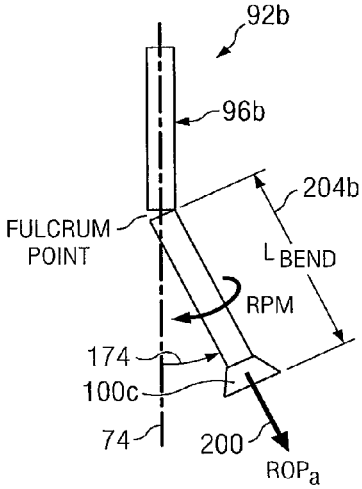
FIG. 5B is a graphical representation showing portions of a point-the-bit directional drilling system forming a directional wellbore.

FIG. 5B is a graphical representation showing various parameters associated with a point-the-bit directional drilling system. Steering unit 92*b* will generally include bent subassembly 96*b*. A wide variety of bent subassemblies may be satisfactorily used to allow drill string 32 to rotate drill bit 100*c* while bent subassembly 96*b* directs or points drill bit 100*c* at angle away from vertical axis 174. Some bent subassemblies have a constant "bent angle". Other bent subassemblies have a variable or adjustable "bent angle". Bend length 204*b* is a function of the dimensions and configurations of associated bent subassembly 96*b*.

As previously noted, side penetration of rotary drill bit will generally not occur in a point-the-bit directional drilling system. Arrow 200 represents the rate of penetration along rotational axis of rotary drill bit 100*c*. Additional features of a model used to simulate drilling of directional wellbores for push-the-bit directional drilling systems and point-the-bit directional drilling systems will be discussed with respect to FIGS. 9-13B.

FIG. 5C is a schematic drawing showing one example of a rotary drill bit which may be designed in accordance with teachings of the present disclosure for optimum performance in a point-the-bit directional drilling system. For example, a three dimensional model such as shown in FIGS. 17A-17F may be used to design a rotary drill bit with an optimum ratio of inner cutters, shoulder cutters and gage cutters in forming a directional wellbore for use with a point-the-bit directional drilling system. Rotary drill bit 100*c* may be generally described as a fixed cutter drill bit. For some applications rotary drill bit 100*c* may also be described as a matrix drill bit steel body drill bit and/or a PDC drill bit. Rotary drill bit 100*c* may include bit body 120*c* with shank 122*c*.

Shank 122*c* may include bit breaker slots 124*c* formed on the exterior thereof. Shank 122*c* may also include extensions of associated blades 128*c*. As shown in FIG. 5C blades 128*c* may extend at an especially large spiral or angle relative to an associated bit rotational axis.

One of the characteristics of rotary drill bits used with point-the-bit directional drilling systems may be increased length of associated gage surfaces as compared with push-the-bit directional drilling systems.

Threaded connection pin (not expressly shown) may be formed as part of shank 122*c* extending from bit body 120*c*. Various types of threaded connections, including but not limited to, API connections and premium threaded connections may be used to releasably engage rotary drill bit 100*c* with a drill string.

A longitudinal bore (not expressly shown) may extend through shank 122*c* and into bit body 120*c*. The longitudinal bore may be used to communicate drilling fluids from an associated drilling string to one or more nozzles 152 disposed in bit body 120*c*.

A plurality of cutter blades 128*c* may be disposed on the exterior of bit body 120*c*. Respective junk slots or fluid flow slots 148*c* may be formed between adjacent blades 128*a*. Each cutter blade 128*c* may include a plurality of cutters 130*d*. For some applications cutters 130*d* may also be described as "cutting inserts". Cutters 130*d* may be formed from very hard materials associated with forming a wellbore in a downhole formation. The exterior portions of bit body

120*c* opposite from shank 122*c* may be generally described as having a "bit face profile" as described with respect to rotary drill bit 100*a*.

Figure 5D:
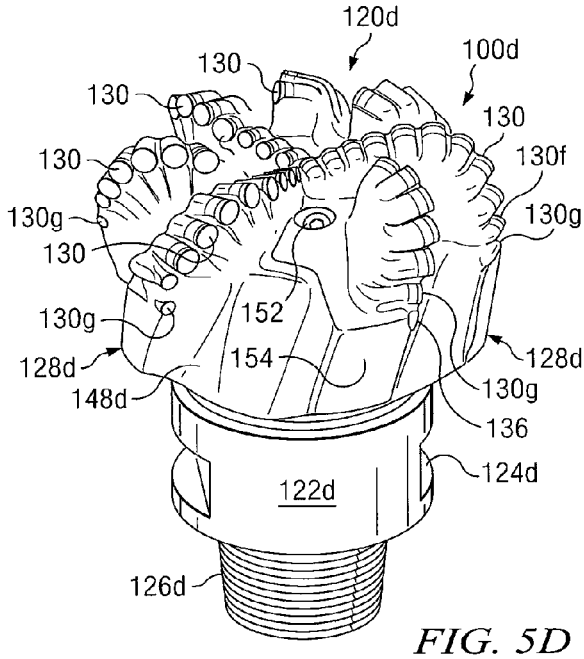
FIG. 5D is a schematic drawing showing an isometric view of a rotary drill bit having various design features which may be optimized for use with a point-the-bit directional drilling system in accordance with teachings of the present disclosure.

FIG. 5D is a schematic drawing showing one example of a rotary drill bit which may be designed in accordance with teachings of the present disclosure for optimum performance in a point-the-bit directional drilling system. Rotary drill bit 100*d* may be generally described as a fixed cutter drill bit. For some applications rotary drill bit 100*d* may also be described as a matrix drill bit and/or a PDC drill bit. Rotary drill bit 100*d* may include bit body 120*d* with shank 122*d*.

Shank 122*d* may include bit breaker slots 124*d* formed on the exterior thereof. Pin threaded connection 126*d* may be formed as an integral part of shank 122*d* extending from bit body 120*d*. Various types of threaded connections, including but not limited to, API connections and premium threaded connections may be formed on the exterior of pin 126*d*.

A longitudinal bore (not expressly shown) may extend from end 121*d* of pin 126*d* through shank 122*c* and into bit body 120*d*. The longitudinal bore may be used to communicate drilling fluids from drilling string 32 to one or more nozzles 152 disposed in bit body 120*d*.

A plurality of cutter blades 128*d* may be disposed on the exterior of bit body 120*d*. Respective junk slots or fluid flow slots 148*d* may be formed between adjacent blades 128*d*. Each cutter blade 128*d* may include a plurality of cutters 130*f*. Respective gage cutters 130*g* may also be disposed on each blade 128*d*. For some applications cutters 130*f* and 130*g* may also be described as "cutting inserts" formed from very hard materials associated with forming a wellbore in a downhole formation. The exterior portions of bit body 120*d* opposite from shank 122*d* may be generally described as having a "bit face profile" as described with respect to rotary drill bit 100*a*.

Blades 128 and 128*d* may also spiral or extend at an angle relative to the associated bit rotational axis. One of the benefits of the present disclosure includes simulating drilling portions of a directional wellbore to determine optimum blade length, blade width and blade spiral for a rotary drill bit which may be used to form all or portions of the directional wellbore. For embodiments represented by rotary drill bits 100*a*, 100*c* and 100*d* associated gage surfaces may be formed proximate one end of blades 128*a*, 128*c* and 128*d* opposite an associated bit face profile.

For some applications bit bodies 120*a*, 120*c* and 120*d* may be formed in part from a matrix of very hard materials associated with rotary drill bits. For other applications bit body 120*a*, 120*c* and 120*d* may be machined from various metal alloys satisfactory for use in drilling wellbores in downhole formations. Examples of matrix type drill bits are shown in U.S. Pat. Nos. 4,696,354 and 5,099,929.

Figure 6A:
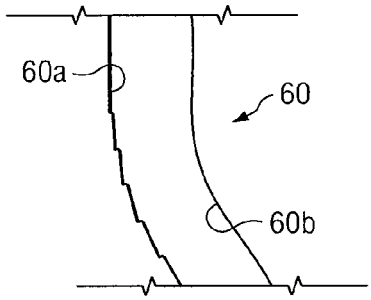
FIG. 6A is a schematic drawing in section with portions broken away showing one simulation of forming a directional wellbore using a simulation model incorporating teachings of the present disclosure.

FIG. 6A is a schematic drawing showing one example of a simulation of forming a directional wellbore using a directional drilling system such as shown in FIGS. 4A and 4B or FIGS. 5A and 5B. The simulation shown in FIG. 6A may generally correspond with forming a transition from vertical segment 60*a* to kick off segment 60*b* of wellbore 60 such as shown in FIGS. 4A and 5B. This simulation may be based on several parameters including, but not limited to, bit tilting motion applied to a rotary drill bit during formation of kick off segment 60*b*. The resulting simulation provides a relatively smooth or uniform inside diameter as compared with the step hole simulation as shown in FIG. 6C.

A rotary drill bit may be generally described as having three components or three portions for purposes of simulating forming a wellbore in accordance with teachings of the present disclosure. The first component or first portion may be described as "face cutters" or "face cutting elements" which may be primarily responsible for drilling action associated with removal of formation materials to form an associated wellbore. For some types of rotary drill bits the "face cutters" may be further divided into three segments such as "inner cutters," "shoulder cutters" and/or "gage cutters". See, for example, FIGS. 6B and 7A. Penetration force ($F_p$) is often the principal or primary force acting upon face cutters.

The second portion of a rotary drill bit may include an active gage or gages responsible for protecting face cutters and maintaining a relatively uniform inside diameter of an associated wellbore by removing formation materials adjacent portions of the wellbore. Active gage cutting elements generally contact and remove partially the sidewall portions of a wellbore.

The third component of a rotary drill bit may be described as a passive gage or gages which may be responsible for maintaining uniformity of the adjacent portions of the wellbore (typically the sidewall or inside diameter) by deforming formation materials in adjacent portions of the wellbore. For active and passive gages the primary force is generally a normal force which extends generally perpendicular to the associated gage face either active or passive.

Gage cutters may be disposed adjacent to active and/or passive gage elements. Gage cutters are not considered as part of an active gage or passive gage for purposes of simulating forming a wellbore as described in this application. However, teachings of the present disclosure may be used to conduct simulations which include gage cutters as part of an adjacent active gage or passive gage. The present disclosure is not limited to the previously described three components or portions of a rotary drill bit.

For some applications a three dimensional (3D) model incorporating teachings of the present disclosure may be operable to evaluate respective contributions of various components of a rotary drill bit to forces acting on the rotary drill bit. The 3D model may be operable to separately calculate or estimate the effect of each component on bit walk rate, bit steerability and/or bit controllability for a given set of downhole drilling parameters. As a result, a model such as shown in FIGS. 17A-17G may be used to design various portions of a rotary drill bit and/or to select a rotary drill bit from existing bit designs for use in forming a wellbore based upon directional behavior characteristics associated with changing face cutter parameters, active gage parameters and/or passive gage parameters. Similar techniques may be used to design or select components of a bottom hole assembly or other portions of a directional drilling system in accordance with teachings of the present disclosure.

Figure 6B:
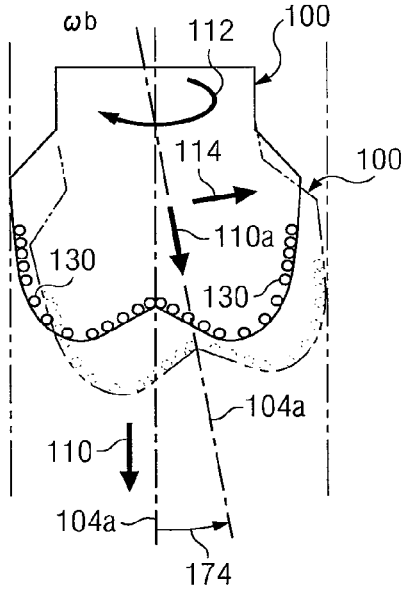
FIG. 6B is a schematic drawing in section with portions broken away showing one example of parameters used to simulate drilling a direction wellbore in accordance with teachings of the present disclosure.
Figure 6C:
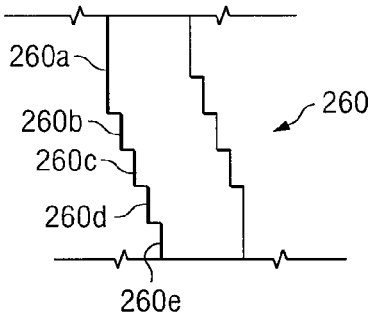
FIG. 6C is a schematic drawing in section with portions broken away showing one simulation of forming a direction wellbore using a prior simulation model.

FIG. 6B shows some of the parameters which would be applied to rotary drill bit 100 during formation of a wellbore. Rotary drill bit 100 is shown by solid lines in FIG. 6B during formation of a vertical segment or straight hole segment of a wellbore. Bit rotational axis 100*a* of rotary drill bit 100 will generally be aligned with the longitudinal axis of the associated wellbore, and a vertical axis associated with a corresponding bit hole coordinate system.

Rotary drill bit 100 is also shown in dotted lines in FIG. 6B to illustrate various parameters used to simulate drilling kick off segment 60*b* in accordance with teachings of the present disclosure. Instead of using bit side penetration or bit side cutting motion, the simulation shown in FIG. 6A is based upon tilting of rotary drill bit 100 as shown in dotted lines relative to vertical axis.

Figure 6D:
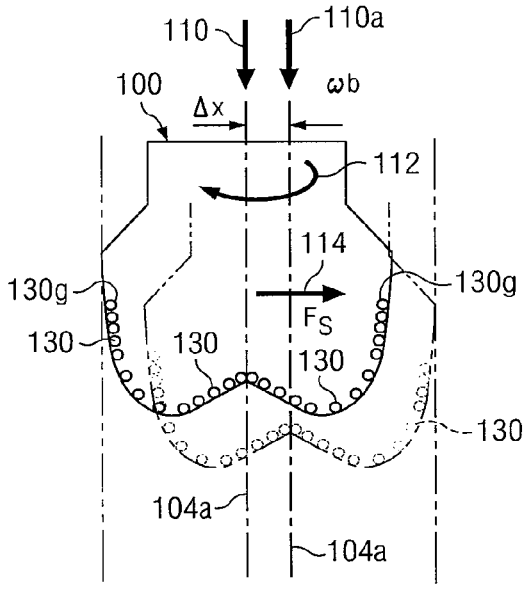
FIG. 6D is a schematic drawing in section with portions broken away showing one example of forces used to simulate drilling a directional wellbore with a rotary drill bit in accordance with the prior simulation model.

FIG. 6C is a schematic drawing showing a typical prior simulation which used side cutting penetration as a step function to represent forming a directional wellbore. For the simulation shown in FIG. 6C, the formation of wellbore 260 is shown as a series of step holes 260*a*, 260*b*, 260*c*, 260*d* and 260*e*. As shown in FIG. 6D the assumption made during this simulation was that rotational axis 104*a* of rotary drill bit 100 remained generally aligned with a vertical axis during the formation of each step hole 260*a*, 260*b*, 260*c*, etc.

Figure 7B:
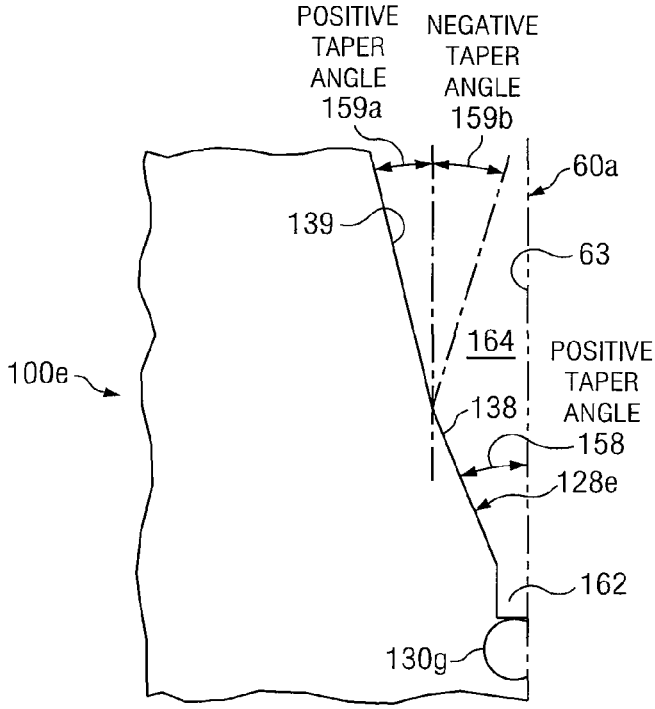
FIG. 7B is a schematic drawing showing various features of an active gage and a passive gage disposed on exterior portions of the rotary drill bit of FIG. 7A.

Simulations of forming directional wellbores in accordance with teachings of the present disclosure have indicated the influence of gage length on bit walk rate, bit steerability and bit controllability. Rotary drill bit 100*e* as shown in FIGS. 7A and 7B may be described as having both an active gage and a passive gage disposed on each blade 128*e*. Active gage portions of rotary drill bit 100*e* may include active elements formed from hardfacing or abrasive materials which remove formation material from adjacent portions of sidewall or inside diameter 63 of wellbore segment 60. See for example active gage elements 156 shown in FIG. 4C.

Rotary drill bit 100*e* as shown in FIGS. 7A and 7B may be described as having a plurality of blades 128*e* with a plurality of cutting elements 130 disposed on exterior portions of each blade 128*e*. For some applications cutting elements 130 may have substantially the same configuration and design. For other applications various types of cutting elements and impact arrestors (not expressly shown) may also be disposed on exterior portions of blades 128*e*. Exterior portions of rotary drill bit 100*e* may be described as forming a "bit face profile".

The bit face profile for rotary drill bit 100*e* as shown in FIGS. 7A and 7B may include recessed portion or cone shaped section 132*e* formed on the end of rotary drill bit 100*e* opposite from shank 122*e*. Each blade 128*e* may include respective nose 134*e* which defines in part an extreme end of rotary drill bit 100*e* opposite from shank 122*e*. Cone section 132*e* may extend inward from respective noses 134*e* toward bit rotational axis 104*e*. A plurality of cutting elements 130*i* may be disposed on portions of each blade 128*e* between respective nose 134*e* and rotational axis 104*e*. Cutters 130*i* may be referred to as "inner cutters".

Each blade 128*e* may also be described as having respective shoulder 136*e* extending outward from respective nose 134*e*. A plurality of cutter elements 130*s* may be disposed on each shoulder 136*e*. Cutting elements 130*s* may sometimes be referred to as "shoulder cutters." Shoulder 136*e* and associated shoulder cutters 130*s* cooperate with each other to form portions of the bit face profile of rotary drill bit 100*e* extending outward from cone shaped section 132*e*.

A plurality of gage cutters 130*g* may also be disposed on exterior portions of each blade 128*e*. Gage cutters 130*g* may be used to trim or define inside diameter or sidewall 63 of wellbore segment 60. Gage cutters 130*g* and associated portions of each blade 128*e* form portions of the bit face profile of rotary drill bit 100*e* extending from shoulder cutters 130*s*.

For embodiments such as shown in FIGS. 7A and 7B each blade 128*e* may include active gage portion 138 and passive gage portion 139. Various types of hardfacing and/or other hard materials (not expressly shown) may be disposed on each active gage portion 138. Each active gage portion 138 may include a positive taper angle 158 as shown in FIG. 7B. Each passive gage portion may include respective positive taper angle 159*a* as shown in FIG. 7B. Active and passive gages on conventional rotary drill bits often have positive taper angles.

Simulations conducted in accordance with teachings of the present disclosure may be used to calculate side forces applied to rotary drill bit 100*e* by each segment or component of a bit face profile. For example inner cutters 130*i*, shoulder cutters 130*s* and gage cutters 130*g* may apply respective side forces to rotary drill bit 100*e* during formation of a directional wellbore. Active gage portions 138 and passive gage portions 139 may also apply respective side forces to rotary drill bit 100*e* during formation of a directional wellbore. A steering difficulty index may be calculated for each segment or component of a bit face profile to determine if design changes should be made to the respective component.

Simulations conducted in accordance with teachings of the present disclosure have indicated that forming a passive gage with a negative taper angle such as angle 159*b* shown in FIG. 7B may provide improved or enhanced steerability when forming a directional wellbore. The size of negative taper angle 159*b* may be limited to prevent undesired contact between an associated passive gage and adjacent portions of a sidewall during drilling of a vertical wellbore or straight hole segments of a wellbore.

Since bend length associated with a push-the-bit directional drilling system is usually relatively large (greater than 20 times associated bit size), most of the cutting action associated with forming a directional wellbore may be a combination of axial bit penetration, bit rotation, bit side cutting and bit tilting. See FIGS. 4A, 4B and 13A. Simulations conducted in accordance with teachings of the present disclosure have indicated that an active gage with a gage gap such as gage gap 162 shown in FIGS. 7A and 7B may significantly reduce the amount of bit side force required to form a directional wellbore using a push-the-bit directional drilling system. A passive gage with a gage gap such as gage gap 164 shown in FIGS. 7A and 7B may also reduce required amounts of bit side force, but the effect is much less than that of an active gage with a gage gap.

Since bend length associated with a point-the-bit directional drilling system is usually relatively small (less than 12 times associated bit size), most of the cutting action associated with forming a directional wellbore may be a combination of axial bit penetration, bit rotation and bit tilting. See FIGS. 5A, 5B and 13B. Simulations conducted in accordance with teachings of the present disclosure have shown that rotary drill bits with positively tapered gages and/or gage gaps may be satisfactorily used with point-the-bit directional drilling systems. Simulations conducted in accordance with teachings of the present disclosure have further indicated that there is an optimum set of tapered gage angles and associated gage gaps depending upon respective bend length of each directional drilling system and required DLS for each segment of a directional wellbore.

Simulations conducted in accordance with teachings of the present disclosure have indicated that forming passive gage 139 with optimum negative taper angle 159*b* may result in contact between portions of passive gage 139 and adjacent portions of a wellbore to provide a fulcrum point to direct or guide rotary drill bit 100*e* during formation of a directional wellbore. The size of negative taper angle 159*b* may be limited to prevent undesired contact between passive gage 139 and adjacent portions of sidewall 63 during drilling of a vertical or straight hole segments of a wellbore. Such simulations have also indicated potential improvements in steerability and controllability by optimizing the length of passive gages with negative taper angles. For example, forming a passive gage with a negative taper angle on a rotary drill bit in accordance with teachings of the present disclosure may allow reducing the bend length of an associated rotary drill bit steering unit. The length of a bend subassembly included as part of the directional steering unit may be reduced as a result of having a rotary drill bit with an increased length in combination with a passive gage having a negative taper angle.

Simulations incorporating teachings of the present disclosure have indicated that a passive gage having a negative taper angle may facilitate tilting of an associated rotary drill bit during kick off drilling. Such simulations have also indicated benefits of installing one or more gage cutters at optimum locations on an active gage portion and/or passive gage portion of a rotary drill bit to remove formation materials from the inside diameter of an associated wellbore during a directional drilling phase. These gage cutters will typically not contact the sidewall or inside diameter of a wellbore while drilling a vertical segment or straight hole segment of the directional wellbore.

Passive gage 139 with an appropriate negative taper angle 159*b* and an optimum length may contact sidewall 63 during formation of an equilibrium portion and/or kick off portion of a wellbore. Such contact may substantially improve steerability and controllability of a rotary drill bit and associated steering difficulty index ($SD_{index}$). Such simulations have also indicated that multiple tapered gage portions and/or variable tapered gage portions may be satisfactorily used with both point-the-bit and push-the-bit directional drilling systems.

Figure 8A:
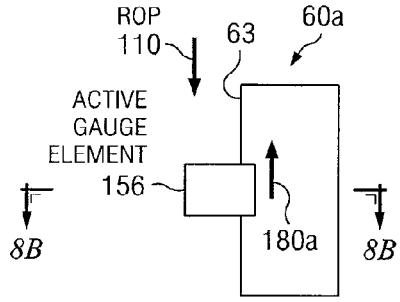
FIG. 8A is a schematic drawing in elevation with portions broken away showing one example of interaction between an active gage element and adjacent portions of a wellbore.
Figure 8C:
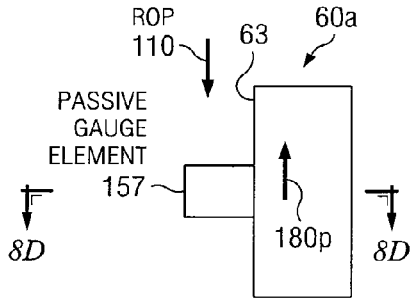
FIG. 8C is a schematic drawing in elevation with portions broken away showing one example of interaction between a passive gage element and adjacent portions of a wellbore.
Figure 8B:
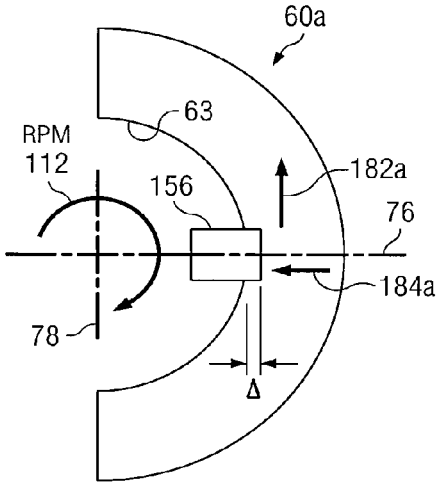
FIG. 8B is a schematic drawing taken along lines 8B-8B of FIG. 8A.
Figure 8D:
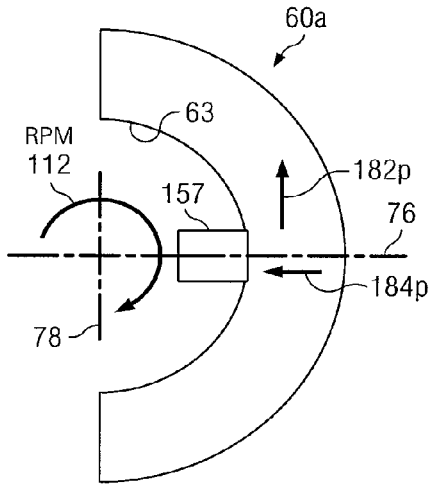
FIG. 8D is a schematic drawing taken along lines 8D-8D of FIG. 8C.

FIGS. 8A and 8B show interaction between active gage element 156 and adjacent portions of sidewall 63 of wellbore segment 60*a*. FIGS. 8C and 8D show interaction between passive gage element 157 and adjacent portions of sidewall 63 of wellbore segment 60*a*. Active gage element 156 and passive gage element 157 may be relatively small segments or portions of respective active gage 138 and passive gage 139 which contacts adjacent portions of sidewall 63. Active and passive gage elements may be used in simulations similar to previously described cutlets.

Arrow 180*a* represents an axial force ($F_a$) which may be applied to active gage element 156 as active gage element engages and removes formation materials from adjacent portions of sidewall 63 of wellbore segment 60*a*. Arrow 180*p* as shown in FIG. 8C represents an axial force ($F_a$) applied to passive gage cutter 130*p* during contact with sidewall 63. Axial forces applied to active gage 130*g* and passive gage 130*p* may be a function of the associated rate of penetration of rotary drill bit 100*e*.

Arrow 182*a* associated with active gage element represents drag force ($F_d$) associated with active gage element 156 penetrating and removing formation materials from adjacent portions of sidewall 63. A drag force ($F_d$) may sometimes be referred to as a tangent force ($F_t$) which generates torque on an associate gage element, cutlet, or mesh unit. The amount of penetration in inches is represented by Δ as shown in FIG. 8B.

Arrow 182*p* represents the amount of drag force ($F_d$) applied to passive gage element 130*p* during plastic and/or elastic deformation of formation materials in sidewall 63 when contacted by passive gage 157. The amount of drag force associated with active gage element 156 is generally a function of rate of penetration of associated rotary drill bit 100*e* and depth of penetration of respective gage element 156 into adjacent portions of sidewall 63. The amount of drag force associated with passive gage element 157 is generally a function of the rate of penetration of associated rotary drill bit 100*e* and elastic and/or plastic deformation of formation materials in adjacent portions of sidewall 63.

Arrow 184*a* as shown in FIG. 8B represents a normal force ($F_n$) applied to active gage element 156 as active gage element 156 penetrates and removes formation materials from sidewall 63 of wellbore segment 60*a*. Arrow 184*p* as shown in FIG. 8D represents a normal force ($F_n$) applied to passive gage element 157 as passive gage element 157 plastically or elastically deforms formation material in adjacent portions of sidewall 63. Normal force ($F_n$) is directly related to the cutting depth of an active gage element into adjacent portions of a wellbore or deformation of adjacent portions of a wellbore by a passive gage element. Normal force ($F_n$) is also directly related to the cutting depth of a cutter into adjacent portions of a wellbore.

The following algorithms may be used to estimate or calculate forces associated with contact between an active and passive gage and adjacent portions of a wellbore. The algorithms are based in part on the following assumptions:

An active gage may remove some formation material from adjacent portions of a wellbore such as sidewall 63. A passive gage may deform adjacent portions of a wellbore such as sidewall 63. Formation materials immediately adjacent to portions of a wellbore such as sidewall 63 may be satisfactorily modeled as a plastic/elastic material.

For each cutlet or small element of an active gage which removes formation material:

$$F_n = ka_1 * \Delta_1 + ka_2 * \Delta_2$$

$$F_a = ka_3 * F_r$$

$$F_d = ka_4 * F_r$$

Where $\Delta_1$ is the cutting depth of a respective cutlet (gage element) extending into adjacent portions of a wellbore, and $\Delta_2$ is the deformation depth of hole wall by a respective cutlet.

$ka_1$, $ka_2$, $ka_3$ and $ka_4$ are coefficients related to rock properties and fluid properties often determined by testing of anticipated downhole formation material.

For each cutlet or small element of a passive gage which deforms formation material:

$$F_n = kp_1 * \Delta p$$

$$F_a = kp_2 * F_r$$

$$F_d = kp_3 * F_r$$

Where Δp is depth of deformation of formation material by a respective cutlet of adjacent portions of the wellbore.

$kp_1$, $kp_2$, $kp_3$ are coefficients related to rock properties and fluid properties and may be determined by testing of anticipated downhole formation material.

Many rotary drill bits have a tendency to "walk" or move laterally relative to a longitudinal axis of a wellbore while forming the wellbore. The tendency of a rotary drill bit to walk or move laterally may be particularly noticeable when forming directional wellbores and/or when the rotary drill bit penetrates adjacent layers of different formation material and/or inclined formation layers. An evaluation of bit walk rates requires consideration of all forces acting on rotary drill bit 100 which extend at an angle relative to tilt plane 170. Such forces include interactions between bit face profile active and/or passive gages associated with rotary drill bit 100 and adjacent portions of the bottom hole may be evaluated.

Figure 9:
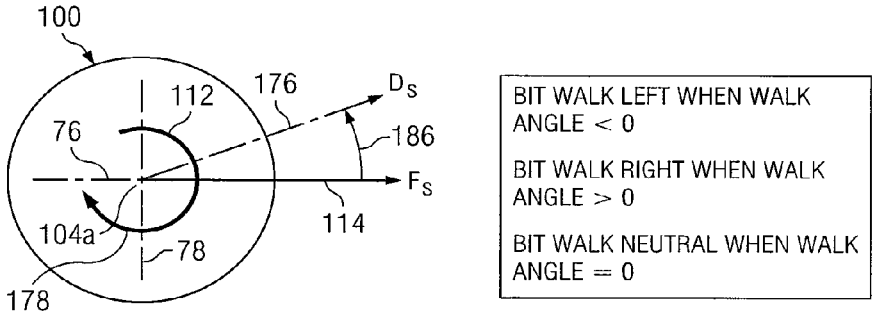
FIG. 9 is a graphical representation of forces used to calculate a walk angle of a rotary drill bit at a downhole location within a wellbore.

FIG. 9 is a schematic drawing showing portions of rotary drill bit 100 in section in a two dimensional hole coordinate system represented by X axis 76 and Y axis 78. Arrow 114 represents a side force applied to rotary drill bit 100 from directional drilling system 20 in tilt plane 170. This side force generally acts normal to bit rotational axis 104*a* of rotary drill bit 100. Arrow 176 represents side cutting or side displacement ($D_s$) of rotary drill bit 100 projected in the hole coordinate system in response to interactions between exterior portions of rotary drill bit 100 and adjacent portions of a downhole formation. Bit walk angle 186 is measured from $F_s$ to $D_s$.

When angle 186 is less than zero (opposite to bit rotation direction represented by arrow 178) rotary drill bit 100 will have a tendency to walk to the left of applied side force 114 and titling plane 170. When angle 186 is greater than zero (the same as bit rotation direction represented by arrow 178) rotary drill bit 100 will have a tendency to walk right relative to applied side force 114 and tilt plane 170. When bit walk angle 186 is approximately equal to zero (0), rotary drill bit 100 will have approximately a zero (0) walk rate or neutral walk tendency.

Figure 10:
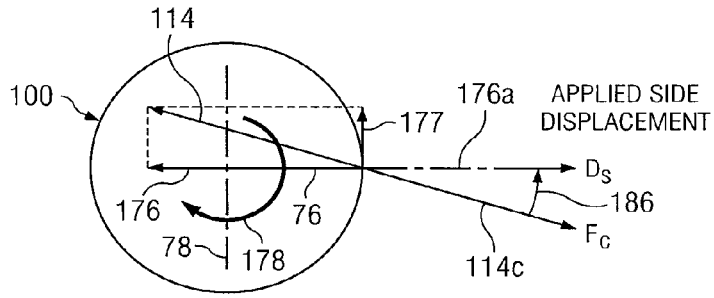
FIG. 10 is a graphical representation of forces used to calculate a walk angle of a rotary drill bit at a respective downhole location in a wellbore.

FIG. 10 is a schematic drawing showing an alternative definition of bit walk angle when a side displacement ($D_s$) or side cutting motion represented by arrow 176*a* is applied to bit 100 during simulation of forming a directional wellbore. An associated force represented by arrow 114*c* required to act on rotary drill bit 100 to produce the applied side displacement ($D_s$) may be calculated and projected in the same hole coordinate system. Applied side displacement ($D_s$) represented by arrow 176*a* and calculated force ($F_c$) represented by arrow 114*c* form bit walk angle 186. Bit walk angle 186 is measured from $F_c$ to $D_s$.

When angle 186 is less than zero (opposite to bit rotation direction represented by arrow 178), rotary drill bit 100 will have a tendency to walk to the left of calculated side force 176 and titling plane 170. When angle 186 is greater than zero (the same as bit rotation direction represented by arrow 178) rotary drill bit 100 will have a tendency to walk right relative to calculated side force 176 and tilt plane 170. When bit walk angle 186 is approximately equal to zero (0), rotary drill bit 100 will have approximately a zero (0) walk rate or neutral walk tendency.

As discussed later in this application both walk force ($F_W$) and walk moment or bending moment ($M_W$) along with an associated bit steer rate and steer force may be used to calculate a resulting bit walk rate. However, the value of walk force and walk moment are generally small compared to an associated steer force and therefore need to be calculated accurately. Bit walk rate may be a function of bit geometry and downhole drilling conditions such as rate of penetration, revolutions per minute, lateral penetration rate, bit tilting rate or steer rate and downhole formation characteristics.

Figure 14A:
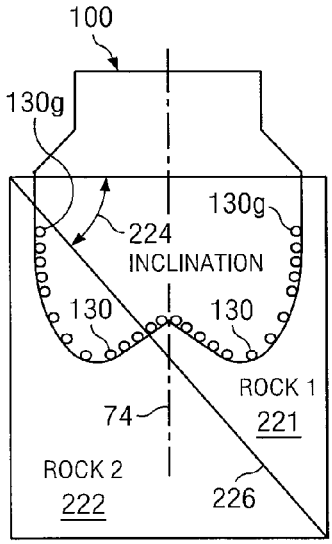
FIG. 14A is a schematic drawing in section with portions broken away showing interaction between a rotary drill bit and two inclined formations during generally vertical drilling relative to the formation.
Figure 14B:
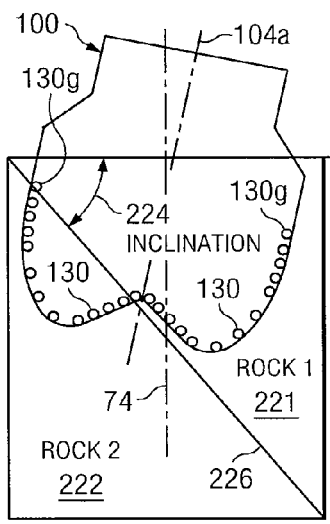
FIG. 14B is a schematic drawing in section with portions broken away showing a graphical representation of a rotary drill bit interacting with two inclined formations during directional drilling relative to the formations.
Figure 14C:
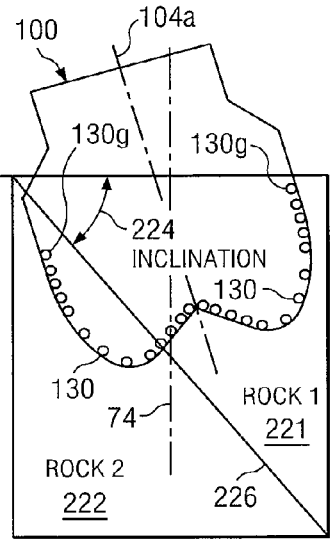
FIG. 14C is a schematic drawing in section with portions broken away showing a graphical representation of a rotary drill bit interacting with two inclined formations during directional drilling of the formations.

Simulations of forming a directional wellbore based on a 3D model incorporating teachings of the present disclosure indicate that for a given axial penetration rate and a given revolutions per minute and a given bottom hole assembly configuration that there is a critical tilt rate. When the tilt rate is greater than the critical tilt rate, the associated drill bit may begin to walk either right or left relative to the associated wellbore. Simulations incorporating teachings of the present disclosure indicate that transition drilling through an inclined formation such as shown in FIGS. 14A, 14B and 14C may change a bit walk tendencies from bit walk right to bit walk left.

For some applications the magnitude of bit side forces required to achieve desired DLS or tilt rates for a given set of drilling equipment parameters and downhole drilling conditions may be used as an indication of associated bit steerability or controllability. See FIG. 11 for one example. Fluctuations in the amount of bit side force, torque on bit (TOB) and/or bit bending moment may also be used to provide an evaluation of bit controllability or bit stability during the formation of various portions of a directional wellbore. See FIG. 12 for one example.

Figure 11:
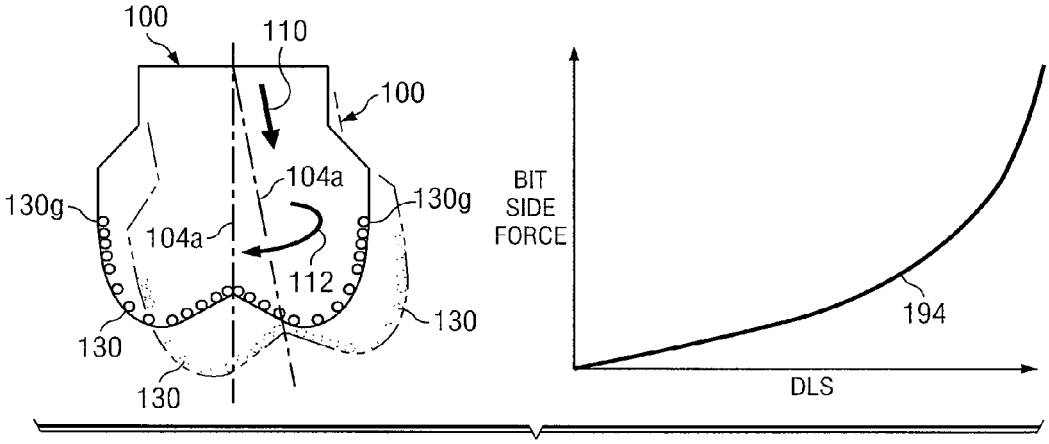
FIG. 11 is a schematic drawing in section with portions broken away of a rotary drill bit showing changes in dogleg severity with respect to side forces applied to a rotary drill bit during drilling of a directional wellbore.

FIG. 11 is a schematic drawing showing rotary drill bit 100 in solid lines in a first position associated with forming a generally vertical section of a wellbore. Rotary drill bit 100 is also shown in dotted lines in FIG. 11 showing a directional portion of a wellbore such as kick off segment 60*a*. The graph shown in FIG. 11 indicates that the amount of bit side force required to produce a tilt rate corresponding with the associated dogleg severity (DLS) will generally increase as the dogleg severity of the deviated wellbore increases. The shape of curve 194 as shown in FIG. 11 may be a function of both rotary drill bit design parameters and associated downhole drilling conditions.

As previously noted fluctuations in drilling parameters such as bit side force, torque on bit and/or bit bending moment may also be used to provide an evaluation of bit controllability or bit stability.

Figure 12:
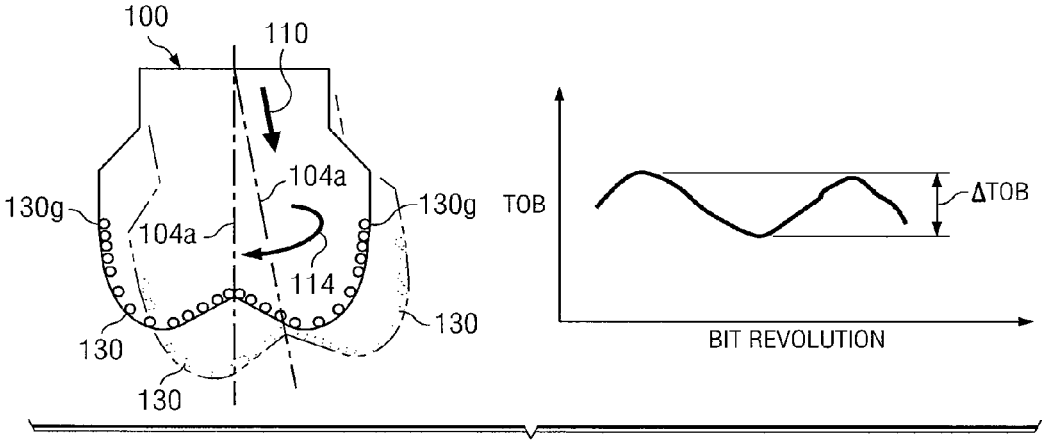
FIG. 12 is a schematic drawing in section with portions broken away of a rotary drill bit showing changes in torque on bit (TOB) with respect to revolutions of a rotary drill bit during drilling of a directional wellbore.

FIG. 12 is a graphical representation showing variations in torque on bit with respect to revolutions per minute during the tilting of rotary drill bit 100 as shown in FIG. 12. The amount of variation or the ΔTOB as shown in FIG. 12 may be used to evaluate the stability of various rotary drill bit designs for the same given set of downhole drilling conditions. The graph shown in FIG. 11 is based on a given rate of penetration, a given RPM and a given set of downhole formation data.

For some applications steerability of a rotary drill bit may be evaluated using the following steps. Design data for the associated drilling equipment may be inputted into a three dimensional model incorporating teachings of the present disclosure. For example design parameters associated with a drill bit may be inputted into a computer system (see for example FIG. 1C) having a software application such as shown and described in FIGS. 17A-17G. Alternatively, rotary drill bit design parameters may be read into a computer program from a bit design file or drill bit design parameters such as International Association of Drilling Contractors (IADC) data may be read into the computer program.

Drilling equipment operating data such as RPM, ROP, and tilt rate for an associated rotary drill bit may be selected or defined for each simulation. A tilt rate or DLS may be defined for one or more formation layers and an associated inclination angle for adjacent formation layers. Formation data such as rock compressive strength, transition layers and inclination angle of each transition layer may also be defined or selected.

Total run time, total number of bit rotations and/or respective time intervals per the simulation may also be defined or selected for each simulation. 3D simulations or modeling using a system such as shown in FIG. 1C and software or computer programs as outlined in FIGS. 17A-17G may then be conducted to calculate or estimate various forces including side forces acting on an associated rotary drill bit or other associated downhole drilling equipment.

The preceding steps may be conducted by changing DLS or tilt rate and repeated to develop a curve of bit side forces corresponding with each value of DLS. A curve of side force versus DLS may then be plotted (See FIG. 11) and bit steerability calculated. Another set of rotary drill bit operating parameters may then be inputted into the computer and steps 3 through 7 repeated to provide additional curves of side force ($F_s$) versus dogleg severity (DLS). Bit steerability may then be defined by the set of curves showing side force versus DLS.

Figure 13A:
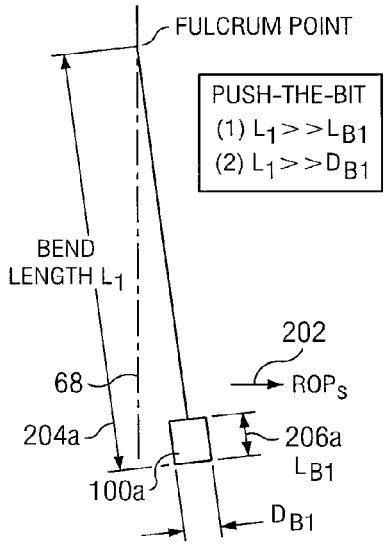
FIG. 13A is a graphical representation of various dimensions associated with a push-the-bit directional drilling system.

FIG. 13A may be described as a graphical representation showing portions of a bottom hole assembly and rotary drill bit 100*a* associated with a push-the-bit directional drilling system. A push-the-bit directional drilling system may be sometimes have a bend length greater than 20 to 35 times an associated bit size or corresponding bit diameter in inches. Bend length 204*a* associated with a push-the-bit directional drilling system is generally much greater than length 206*a* of rotary drill bit 100*a*. Bend length 204*a* may also be much greater than or equal to the diameter $D_{B1}$ of rotary drill bit 100*a*.

Figure 13B:
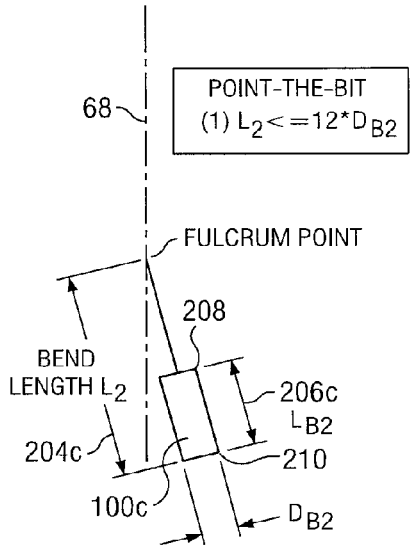
FIG. 13B is a graphical representation of various dimensions associated with a point-the-bit directional drilling system.

FIG. 13B may be generally described as a graphical representation showing portions of a bottom hole assemble and rotary drill bit 100*c* associated with a point-the-bit directional drilling system. A point-the-bit directional drilling system may sometimes have a bend length less than or equal to 12 times the bit size. For the example shown in FIG. 13B, bend length 204*c* associated with a point-the-bit directional drilling system may be approximately two or three times greater than length 206*c* of rotary drill bit 100*c*. Length 206*c* of rotary drill bit 100*c* may be significantly greater than diameter $D_{B2}$ of rotary drill bit 100*c*. The length of a rotary drill bit used with a push-the-bit drilling system will generally be less than the length of a rotary drill bit used with a point-the-bit directional drilling system.

Due to the combination of tilting and axial penetration, rotary drill bits may have side cutting motion. This is particularly true during kick off drilling. However, the rate of side cutting is generally not a constant for a drill bit and is changed along drill bit axis. The rate of side penetration of rotary drill bits 100*a* and 100*c* is represented by arrow 202. The rate of side penetration is generally a function of tilting rate and associated bend length 204*a* and 204*d*. For rotary drill bits having a relatively long bit length and particularly a relatively long gage length such as shown in FIG. 5C, the rate of side penetration at point 208 may be much less than the rate of side penetration at point 210. As the length of a rotary drill bit increases the side penetration rate decreases from the shank as compared with the extreme end of the rotary drill bit. The difference in rate of side penetration between point 208 and 210 may be small, but the effects on bit steerability may be very large.

Simulations conducted in accordance with teachings of the present disclosure may be used to calculate bit walk rate. Walk force ($F_W$) may be obtained by simulating forming a directional wellbore as a function of drilling time. Walk force ($F_W$) corresponds with the amount of force which is applied to a rotary drill bit in a plane extending generally perpendicular to an associated azimuth plane or tilt plane. A model such as shown in FIGS. 17A-17G may then be used to obtain the total bit lateral force ($F_{lat}$) as a function of time.

FIGS. 14A, 14B and 14C are schematic drawings showing representations of various interactions between rotary drill bit 100 and adjacent portions of first formation 221 and second formation layer 222. Software or computer programs such as outlined in FIGS. 17A-17G may be used to simulate or model interactions with multiple or laminated rock layers forming a wellbore.

For some applications first formation layer may have a rock compressibility strength which is substantially larger than the rock compressibility strength of second layer 222. For embodiments such as shown in FIGS. 14A, 14B and 14C first layer 221 and second layer 222 may be inclined or disposed at inclination angle 224 (sometimes referred to as a "transition angle") relative to each other and relative to vertical. Inclination angle 224 may be generally described as a positive angle relative associated vertical axis 74.

Three dimensional simulations may be performed to evaluate forces required for rotary drilling bit 100 to form a substantially vertical wellbore extending through first layer 221 and second layer 222. See FIG. 14A. Three dimensional simulations may also be performed to evaluate forces which must be applied to rotary drill bit 100 to form a directional wellbore extending through first layer 221 and second layer 222 at various angles such as shown in FIGS. 14B and 14C. A simulation using software or a computer program such as outlined in FIG. 17A-17G may be used calculate the side forces which must be applied to rotary drill bit 100 to form a wellbore to tilt rotary drill bit 100 at an angle relative to vertical axis 74.

Figure 14D:
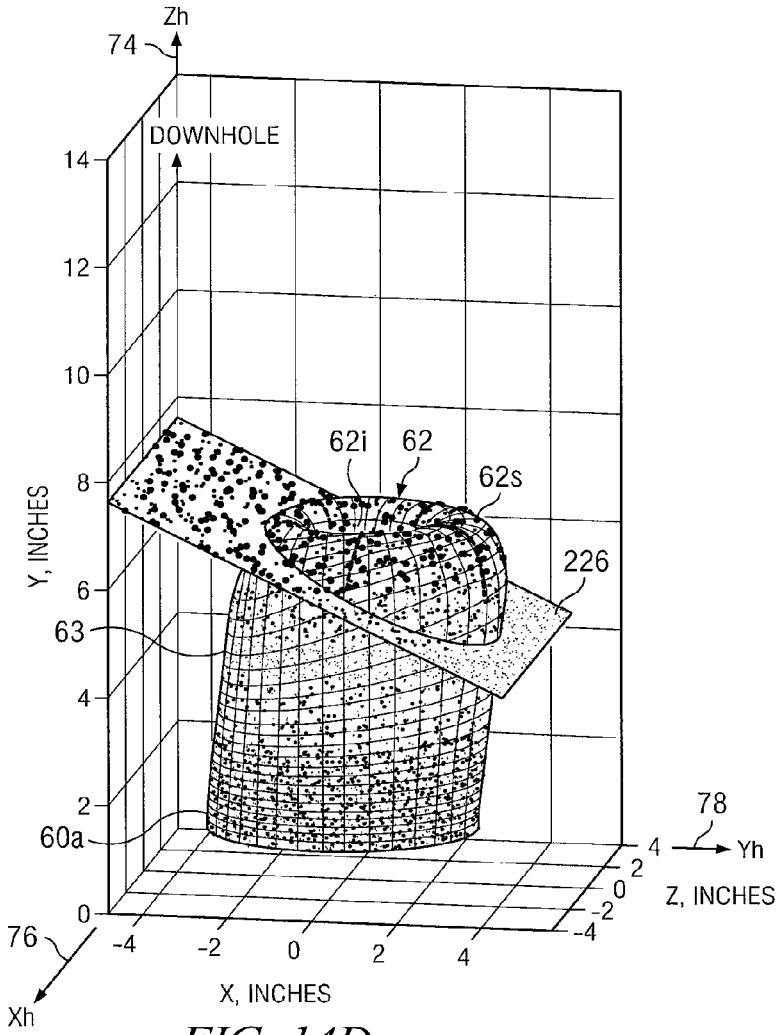
FIG. 14D shows one example of a three dimensional graphical simulation incorporating teachings of the present disclosure of a rotary drill bit penetrating a first rock layer and a second rock layer.

FIG. 14D is a schematic drawing showing a three dimensional meshed representation of the bottom hole or end of wellbore segment 60*a* corresponding with rotary drill bit 100 forming a generally vertical or horizontal wellbore extending therethrough as shown in FIG. 14A. Transition plane 226 as shown in FIG. 14D represents a dividing line or boundary between rock formation layer and rock formation layer 222. Transition plane 226 may extend along inclination angle 224 relative to vertical.

The terms "meshed" and "mesh analysis" may describe analytical procedures used to evaluate and study complex structures such as cutters, active and passive gages, other portions of a rotary drill bit, other downhole tools associated with drilling a wellbore, bottom hole configurations of a wellbore and/or other portions of a wellbore. The interior surface of end 62 of wellbore 60*a* may be finely meshed into many small segments or "mesh units" to assist with determining interactions between cutters and other portions of a rotary drill bit and adjacent formation materials as the rotary drill bit removes formation materials from end 62 to form wellbore 60. See FIG. 14D. The use of mesh units may be particularly helpful to analyze distributed forces and variations in cutting depth of respective mesh units or cutlets as an associated cutter interacts with adjacent formation materials.

Three dimensional mesh representations of the bottom of a wellbore and/or various portions of a rotary drill bit and/or other downhole tools may be used to simulate interactions between the rotary drill bit and adjacent portions of the wellbore. For example cutting depth and cutting area of each cutting element or cutlet during one revolution of the associated rotary drill bit may be used to calculate forces acting on each cutting element. Simulation may then update the configuration or pattern of the associated bottom hole and forces acting on each cutter. For some applications the nominal configuration and size of a unit such as shown in FIG. 14D may be approximately 0.5 mm per side. However, the actual configuration size of each mesh unit may vary substantially due to complexities of associated bottom hole geometry and respective cutters used to remove formation materials.

Systems and methods incorporating teachings of the present disclosure may also be used to simulate or model forming a directional wellbore extending through various combinations of soft and medium strength formation with multiple hard stringers disposed within both soft and/or medium strength formations. Such formations may sometimes be referred to as "interbedded" formations. Simulations and associated calculations may be similar to simulations and calculations as described with respect to FIGS. 14A-14D.

Figure 15B:
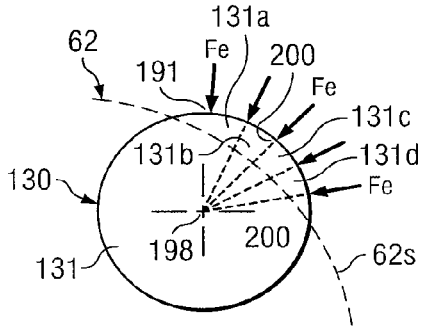
FIG. 15B is a schematic drawing showing forces operating on a rotary drill bit against the bottom and/or the sidewall of a bore hole in a spherical coordinate system.
Figure 15C:
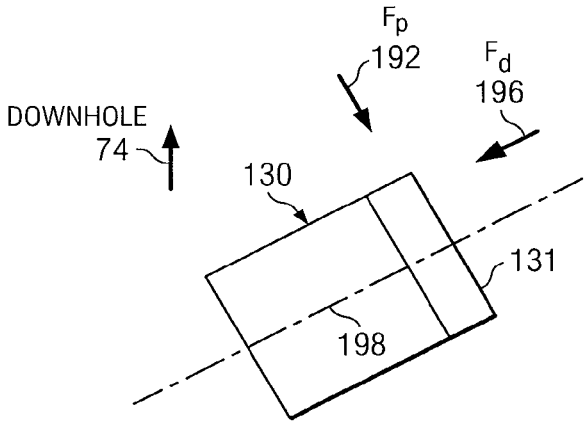
FIG. 15C is a schematic drawing showing forces acting on a cutter of a rotary drill bit in a cutter local coordinate system.

Spherical coordinate systems such as shown in FIGS. 15A-15C may be used to define the location of respective cutlets, gage elements and/or mesh units of a rotary drill bit and adjacent portions of a wellbore. The location of each mesh unit of a rotary drill bit and associated wellbore may be represented by a single valued function of angle phi ($\phi$), angle theta ($\theta$) and radius rho ($\rho$) in three dimensions (3D) relative to Z axis 74. The same Z axis 74 may be used in a three dimensional Cartesian coordinate system or a three dimensional spherical coordinate system.

The location of a single point such as center 198 of cutter 130 may be defined in the three dimensional spherical coordinate system of FIG. 15A by angle $\phi$ and radius $\rho$. This same location may be converted to a Cartesian hole coordinate system of $X_h$, $Y_h$, $Z_h$ using radius r and angle theta ($\theta$) which corresponds with the angular orientation of radius r relative to X axis 76. Radius r intersects Z axis 74 at the same point radius $\rho$ intersects Z axis 74. Radius r is disposed in the same plane as Z axis 74 and radius $\rho$. Various examples of algorithms and/or matrices which may be used to transform data in a Cartesian coordinate system to a spherical coordinate system and to transform data in a spherical coordinate system to a Cartesian coordinate system are discussed later in this application.

As previously noted, a rotary drill bit may generally be described as having a "bit face profile" which includes a plurality of cutters operable to interact with adjacent portions of a wellbore to remove formation materials therefrom. Examples of a bit face profile and associated cutters are shown in FIGS. 2A, 2B, 4C, 5C, 5D, 7A and 7B. The cutting edge of each cutter on a rotary drill bit may be represented in three dimensions using either a Cartesian coordinate system or a spherical coordinate system.

FIGS. 15B and 15C show graphical representations of various forces associated with portions of cutter 130 interacting with adjacent portions of bottom hole 62 of wellbore 60. For examples such as shown in FIG. 15B cutter 130 may be located on the shoulder of an associated rotary drill bit.

FIGS. 15B and 15C also show one example of a local cutter coordinate system used at a respective time step or interval to evaluate or interpolate interaction between one cutter and adjacent portions of a wellbore. A local cutter coordinate system may more accurately interpolate complex bottom hole geometry and bit motion used to update a 3D simulation of a bottom hole geometry such as shown in FIG. 14D based on simulated interactions between a rotary drill bit and adjacent formation materials. Numerical algorithms and interpolations incorporating teachings of the present disclosure may more accurately calculate estimated cutting depth and cutting area of each cutter.

In a local cutter coordinate system there are two forces, drag force ($F_d$) and penetration force ($F_p$), acting on cutter 130 during interaction with adjacent portions of wellbore 60. When forces acting on each cutter 130 are projected into a bit coordinate system there will be three forces, axial force ($F_a$), drag force ($F_d$) and penetration force ($F_r$). The previously described forces may also act upon impact arrestors and gage cutters.

For purposes of simulating cutting or removing formation materials adjacent to end 62 of wellbore 60 as shown in FIG. 15B, cutter 130 may be divided into small elements or cutlets 131*a*, 131*b*, 131*c* and 131*d*. Forces represented by arrows $F_e$ may be simulated as acting on cutlet 131*a*-131*d* at respective points such as 191 and 200. For example, respective drag forces may be calculated for each cutlet 131*a*-131*d* acting at respective points such as 191 and 200. The respective drag forces may be summed or totaled to determine total drag force ($F_d$) acting on cutter 130. In a similar manner, respective penetration forces may also be calculated for each cutlet 131*a*-131*d* acting at respective points such as 191 and 200. The respective penetration forces may be summed or totaled to determine total penetration force ($F_p$) acting on cutter 130.

FIG. 15C shows cutter 130 in a local cutter coordinate system defined in part by cutter axis 198. Drag force ($F_d$) represented by arrow 196 corresponds with the summation of respective drag forces calculated for each cutlet 131*a*-131*d*. Penetration force ($F_p$) represented by arrow 192 corresponds with the summation of respective penetration forces calculated for each cutlet 131*a*-131*d*.

FIG. 16 shows portions of bottom hole 62 in a spherical hole coordinate system defined in part by Z axis 74 and radius $R_h$. The configuration of a bottom hole generally corresponds with the configuration of an associated bit face profile used to form the bottom hole. For example, portion 62*i* of bottom hole 62 may be formed by inner cutters 130*i*. Portion 62*s* of bottom hole 62 may be formed by shoulder cutters 130*s*. Side wall 63 may be formed by gage cutters 130*g*.

Single point 200 as shown in FIG. 16 is located on the exterior of cutter 130*s*. In the hole coordinate system, the location of point 200 is a function of angle $\phi_h$ and radius $\rho_h$. FIG. 16 also shows the same single point 200 on the exterior of cutter 130*s* in a local cutter coordinate system defined by vertical axis $Z_c$ and radius $R_c$. In the local cutter coordinate system, the location of point 200 is a function of angle $\phi_c$ and radius $\rho_c$. Cutting depth 212 associated with single point 200 and associated removal of formation material from bottom hole 62 corresponds with the shortest distance between point 200 and portion 62*s* of bottom hole 62.

Simulating Straight Hole Drilling (Path B, Algorithm A)

The following algorithms may be used to simulate interaction between portions of a cutter and adjacent portions of a wellbore during removal of formation materials proximate the end of a straight hole segment. Respective portions of each cutter engaging adjacent formation materials may be referred to as cutting elements or cutlets. Note that in the following steps y axis represents the bit rotational axis. The x and z axes are determined using the right hand rule. Drill bit kinematics in straight hole drilling is fully defined by ROP and RPM.

Given ROP, RPM, current time t, dt, current cutlet position ($x_i$, $y_i$, $z_i$) or ($\theta_i$, $\phi_i$, $\rho_i$)

(1) Cutlet position due to penetration along bit axis Y may be obtained $$x_p=x_i;\ y_p=y_i+\text{rop}*d_r;\ z_p=z_i$$

(2) Cutlet position due to bit rotation around the bit axis may be obtained as follows:

$$\text{N_rot}=\{0\ 1\ 0\}$$

Accompany matrix:

$$M_{rot}=\begin{matrix} 0 & -\text{N_rot}(3) & \text{N_rot}(2) \\ \text{N_rot}(3) & 0 & -\text{N_rot}(1) \\ -\text{N_rot}(2) & \text{N_rot}(1) & 0 \end{matrix}$$

The transform matrix is:

$$R_\text{rot}=\cos\omega\, t\, I+(1-\cos\omega t)N_\text{rot}\, N_\text{rot}'+\sin\omega t\, M_\text{rot},$$

where I is 3×3 unit matrix and ω is bit rotation speed.

New cutlet position after bit rotation is:

$$\begin{matrix} x_{i+1} \\ y_{i+1} \\ z_{i+1} \end{matrix} = R_{rot} \begin{matrix} x_p \\ y_p \\ z_p \end{matrix}$$

(3) Calculate the cutting depth for each cutlet by comparing ($x_{i+1}$, $y_{i+1}$, $z_{i+1}$) of this cutlet with hole coordinate ($x_h$, $y_h$, $z_h$) where $X_h=x_{i+1}$ & $z_h=z_{i+1}$, and $d_p=y_{i+1}-y_h$;

(4) Calculate the cutting area of this cutlet $$A\ \text{cutlet}=d_p*d_r$$

where $d_r$ is the width of this cutlet.

(5) Determine which formation layer is cut by this cutlet by comparing $y_{i+1}$ with hole coordinate $y_h$, if $y_{i+1}<y_h$ then layer A is cut. $y_h$ may be solved from the equation of the transition plane in Cartesian coordinate:

$$l(x_h-x_1)+m(y_h-y_1)+n(z_h-z_1)=0$$

where ($x_1$, $y_1$, $z_1$) is any point on the plane and {l,m,n} is normal direction of the transition plane.

(6) Save layer information, cutting depth and cutting area into 3D matrix at each time step for each cutlet for force calculation.

(7) Update the associated bottom hole matrix removed by the respective cutlets or cutters.

Simulating Kick Off Drilling (Path C)

The following algorithms may be used to simulate interaction between portions of a cutter and adjacent portions of a wellbore during removal of formation materials proximate the end of a kick off segment. Respective portions of each cutter engaging adjacent formation materials may be referred to as cutting elements or cutlets. Note that in the following steps, y axis is the bit axis, x and z are determined using the right hand rule. Drill bit kinematics in kick-off drilling is defined by at least four parameters: ROP, RPM, DLS and bend length.

Given ROP, RPM, DLS and bend length, $L_{bend}$, current time t, dt, current cutlet position $(x_i, y_i, z_i)$ or $(\theta_i, \phi_i, \rho_i)$ (1) Transform the current cutlet position to bend center:

$$x_i = x_i;$$

$$y_i = y_i - L_{bend}$$

$$z_i = z_i;$$

(2) New cutlet position due to tilt may be obtained by tilting the bit around vector N_tilt an angle γ:

$$N_tilt = \{\sin\alpha 0.0 \cos\alpha\}$$

Accompany matrix:

$$M_{tilt} = \begin{matrix} 0 & -N_tilt(3) & N_tilt(2) \\ N_tilt(3) & 0 & -N_tilt(1) \\ -N_tilt(2) & N_tilt(1) & 0 \end{matrix}$$

The transform matrix is:

$$R_tilt = \cos\gamma\, I + (1-\cos\gamma) N_tilt\, N_tilt' + \sin\gamma\, M_tilt$$

where I is the 3×3 unit matrix.

New cutlet position after tilting is:

$$\begin{matrix} x_t \\ y_t \\ z_t \end{matrix} = R_{Tilt} \begin{matrix} x_i \\ y_i \\ z_i \end{matrix}$$

(3) Cutlet position due to bit rotation around the new bit axis may be obtained as follows:

$$N_rot = \{\sin\gamma \cos\theta \cos\gamma \sin\gamma \sin\theta\}$$

Accompany matrix:

$$M_{rot} = \begin{matrix} 0 & -N_rot(3) & N_rot(2) \\ N_rot(3) & 0 & -N_rot(1) \\ -N_rot(2) & N_rot(1) & 0 \end{matrix}$$

The transform matrix is:

$$R_rot = \cos\omega t\, I + (1-\cos\omega t) N_rot\, N_rot' + \sin\omega t\, M_rot,$$

I is 3×3 unit matrix and ω is bit rotation speed

New cutlet position after tilting is:

$$\begin{matrix} x_r \\ y_r \\ z_r \end{matrix} = R_{rot} \begin{matrix} x_t \\ y_t \\ z_t \end{matrix}$$

(4) Cutlet position due to penetration along new bit axis may be obtained $$d_p = \text{rop} \times dt;$$

$$x_{i+1} = x_r + d_p_x$$

$$y_{i+1} = y_r + d_p_y$$

$$z_{i+1} = z_r + d_p_z$$

With $d_p$_x, $d_p$_y and $d_p$_z being projection of $d_p$ on X, Y, Z.

(5) Transfer the calculated cutlet position after tilting, rotation and penetration into spherical coordinate and get $(\theta_{i+1}, \phi_{i+1}, \rho_{i+1})$ (6) Determine which formation layer is cut by this cutlet by comparing $Y_{i+1}$ with hole coordinate $y_h$, if $y_{i+1} < y_h$ first layer is cut (this step is the same as Algorithm A).

(7) Calculate the cutting depth of each cutlet by comparing $(\theta_{i+1}, \phi_{i+1}, \rho_{i+1})$ of the cutlet and $(\theta_h, \phi_h, \rho_h)$ of the hole where $\theta_h = \theta_{i+1} \& \phi_h = \phi_{i+1}$. Therefore $d_p = \rho_{i+1} - \rho_h$. It is usually difficult to find point on hole $(\theta_h, \phi_h, \rho_h)$, an interpretation is used to get an approximate $\rho_h$:

$$\rho_h = \text{interp2}(\theta_h, \phi_h, \rho_h, \theta_{i+1}, \phi_{i+1})$$

where $\theta_h$, $\phi_h$, $\rho_h$ is sub-matrices representing a zone of the hole around the cutlet. Function interp2 is a MATLAB function using linear or nonlinear interpolation method.

(8) Calculate the cutting area of each cutlet using dϕ, dρ in the plane defined by $\rho_i$, $\rho_{i+1}$. The cutlet cutting area is $$A = 0.5 * d\phi * (\rho_{i+1}\hat{}2 - (\rho_{i+1} - d\rho)\hat{}2)$$

(9) Save layer information, cutting depth and cutting area into 3D matrix at each time step for each cutlet for force calculation.

(10) Update the associated bottom hole matrix removed by the respective cutlets or cutters.

Simulating Equilibrium Drilling (Path D)

The following algorithms may be used to simulate interaction between portions of a cutter and adjacent portions of a wellbore during removal of formation materials in an equilibrium segment. Respective portions of each cutter engaging adjacent formation materials may be referred to as cutting elements or cutlets. Note that in the following steps, y represents the bit rotational axis. The x and z axes are determined using the right hand rule. Drill bit kinematics in equilibrium drilling is defined by at least three parameters: ROP, RPM and DLS.

Given ROP, RPM, DLS, current time t, selected time interval dt, current cutlet position $(x_i, y_i, z_i)$ or $(\theta_i, (\phi_i, \rho_i)$, (1) Bit as a whole is rotating around a fixed point $O_w$, the radius of the well path is calculated by $$R = 5730 * 12/\text{DLS(inch)}$$

and angle $$\gamma = \text{DLS} * \text{rop}/100.0/3600(\text{deg/sec})$$

(2) The new cutlet position due to rotation y may be obtained as follows:

$$\text{Axis: } N_1 = \{0\ 0\ -1\}$$

Accompany matrix:

$$M_1 = \begin{matrix} 0 & -N_1(3) & N_1(2) \\ N_1(3) & 0 & -N_1(1) \\ -N_1(2) & N_1(1) & 0 \end{matrix}$$

The transform matrix is:

$$R_1=\cos\gamma\, I+(1-\cos\gamma)N_1\, N_1'+\sin\gamma\, M1$$

where I is 3×3 unit matrix

New cutlet position after rotating around $O_w$ is:

$$\begin{matrix} x_t \\ y_t \\ z_t \end{matrix} = R_1 \begin{matrix} x_i \\ y_i \\ z_i \end{matrix}$$

(3) Cutlet position due to bit rotation around the new bit axis may be obtained as follows:

$$N_rot=\{\sin\gamma\cos\alpha\ \cos\gamma\ \sin\gamma\ \sin\alpha\}$$

where $\alpha$ is the azimuth angle of the well path

Accompany matrix:

$$M_{rot} = \begin{matrix} 0 & -N_rot(3) & N_rot(2) \\ N_rot(3) & 0 & -N_rot(1) \\ -N_rot(2) & N_rot(1) & 0 \end{matrix}$$

The transform matrix is:

$$R_rot=\cos\theta\, I+(1-\cos\theta)N_rot\, N_rot'+\sin\theta\, M_rot,$$

where I is 3×3 unit matrix

New cutlet position after bit rotation is:

$$\begin{matrix} x_{i+1} \\ y_{i+1} \\ z_{i+1} \end{matrix} = R_{rot} \begin{matrix} x_t \\ y_t \\ z_t \end{matrix}$$

(4) Transfer the calculated cutlet position into spherical coordinate and get $(\theta_{i+1}, \phi_{i+1}, \rho_{i+1})$.

(5) Determine which formation layer is cut by this cutlet by comparing $y_{i+1}$ with hole coordinate $y_h$, if $y_{i+1}<y_h$ first layer is cut (this step is the same as Algorithm A).

(6) Calculate the cutting depth of each cutlet by comparing $(\theta_{i+1}, \phi_{i+1}, \rho_{i+1})$ of the cutlet and $(\theta_h, \phi_h, \rho_h)$ of the hole where $\theta_h=\theta_{i+1}$ & $\phi_h=\phi_{i+1}$. Therefore $d_\rho=\rho_{i+1}-\rho_h$. It is usually difficult to find point on hole $(\theta_h, \phi_h, \rho_h)$, an interpretation is used to get an approximate $\rho_h$:

$$\rho_h=\text{interp2}(\theta_h, \phi_h, \rho_h, \theta_{i+1}, \phi_{i+1})$$

where $\theta_h$, $\phi_h$, $\rho_h$ is sub-matrices representing a zone of the hole around the cutlet. Function interp2 is a MATLAB function using linear or nonlinear interpolation method.

(7) Calculate the cutting area of each cutlet using $d\phi$, $d\rho$ in the plane defined by $\rho_i$, $\rho_{i+1}$. The cutlet cutting area is:

$$A=0.5*d\phi*(\rho_{i+1}\hat{}2-(\rho_{i+1}-d\rho)\hat{}2)$$

(8) Save layer information, cutting depth and cutting area into 3D matrix at each time step for each cutlet for force calculation.

(9) Update the associated bottom hole matrix for portions removed by the respective cutlets or cutters.

An Alternative Algorithm to Calculate Cutting Area of A Cutter

The following steps may also be used to calculate or estimate the cutting area of the associated cutter. See FIGS. 15C and 16.

(1) Determine the location of cutter center $O_c$ at current time in a spherical hole coordinate system, see FIG. 16.

(2) Transform three matrices $\phi_H$, $\theta_H$ and $\rho_H$ to Cartesian coordinate in hole coordinate system and get $X_h$, $Y_h$ and $Z_h$;

(3) Move the origin of $X_h$, $Y_h$ and $Z_h$ to the cutter center $O_c$ located at ($\phi_c$, $\theta_c$ and $\rho_c$);

(4) Determine a possible cutting zone on portions of a bottom hole interacted by a respective cutlet for this cutter and subtract three sub-matrices from $X_h$, $Y_h$ and $Z_h$ to get $x_h$, $y_h$ and $z_h$;

(5) Transform $x_h$, $y_h$ and $z_h$ back to spherical coordinate and get $\phi_h$, $\theta_h$ and $\rho_h$ for this respective subzone on bottom hole;

(6) Calculate spherical coordinate of cutlet B: $\phi_B$, $\theta_B$ and $\rho_B$ in cutter local coordinate;

(7) Find the corresponding point C in matrices $\phi_h$, $\theta_h$ and $\rho_h$ with condition $\phi_C=\phi_B$ and $\theta_C=\theta_B$;

(8) If $\rho_B>\rho_C$, replacing $\rho_C$ with $\rho_B$ and matrix $\rho_h$ in cutter coordinate system is updated;

(9) Repeat the steps for all cutlets on this cutter;

(10) Calculate the cutting area of this cutter;

(11) Repeat steps 1-10 for all cutters;

(12) Transform hole matrices in local cutter coordinate back to hole coordinate system and repeat steps 1-12 for next time interval.

Force Calculations in Different Drilling Modes

The following algorithms may be used to estimate or calculate forces acting on all face cutters of a rotary drill bit.

(1) Summarize all cutlet cutting areas for each cutter and project the area to cutter face to get cutter cutting area, $A_c$ (2) Calculate the penetration force ($F_p$) and drag force ($F_d$) for each cutter using, for example, AMOCO Model (other models such as SDBS model, Shell model, Sandia Model may be used).

$$F_p=\sigma*A_c*(0.16*abs(\beta e)-1.15))$$

$$F_d=F_d*F_p+\sigma*A_c*(0.04*abs(\beta e)+0.8))$$

where $\sigma$ is rock strength, $\beta e$ is effective back rake angle and $F_d$ is drag coefficient (usually $F_d$=0.3)

(3) The force acting point M for this cutter is determined either by where the cutlet has maximal cutting depth or the middle cutlet of all cutlets of this cutter which are in cutting with the formation. The direction of $F_p$ is from point M to cutter face center $O_c$. $F_d$ is parallel to cutter axis. See for example FIGS. 15B and 15C.

One example of a computer program or software and associated method steps which may be used to simulate forming various portions of a wellbore in accordance with teachings of the present disclosure is shown in FIGS. 17A-17G. Three dimensional (3D) simulation or modeling of forming a wellbore may begin at step 800. At step 802 the drilling mode, which will be used to simulate forming a respective segment of the simulated wellbore, may be selected from the group consisting of straight hole drilling, kick off drilling or equilibrium drilling. Additional drilling modes may also be used depending upon characteristics of associated downhole formations and capabilities of an associated drilling system.

At step 804*a* bit parameters such as rate of penetration and revolutions per minute may be inputted into the simulation if straight hole drilling was selected. If kickoff drilling was selected, data such as rate of penetration, revolutions per minute, dogleg severity, bend length and other characteristics of an associated bottom hole assembly may be inputted into the simulation at step 804*b*. If equilibrium drilling was selected, parameters such as rate of penetration, revolutions per minute and dogleg severity may be inputted into the simulation at step 804*c*.

At steps 806, 808 and 810 various parameters associated with configuration and dimensions of a first rotary drill bit design and downhole drilling conditions may be inputted into the simulation. Appendix A provides examples of such data.

At step 812 parameters associated with each simulation, such as total simulation time, step time, mesh size of cutters, gages, blades and mesh size of adjacent portions of the wellbore in a spherical coordinate system may be inputted into the model. At step 814 the model may simulate one revolution of the associated drill bit around an associated bit axis without penetration of the rotary drill bit into the adjacent portions of the wellbore to calculate the initial (corresponding to time zero) hole spherical coordinates of all points of interest during the simulation. The location of each point in a hole spherical coordinate system may be transferred to a corresponding Cartesian coordinate system for purposes of providing a visual representation on a monitor and/or print out.

At step 816 the same spherical coordinate system may be used to calculate initial spherical coordinates for each cutlet of each cutter and each gage portions which will be used during the simulation.

At step 818 the simulation will proceed along one of three paths based upon the previously selected drilling mode. At step 820*a* the simulation will proceed along path A for straight hole drilling. At step 820*b* the simulation will proceed along path B for kick off hole drilling. At step 820*c* the simulation will proceed along path C for equilibrium hole drilling.

Steps 822, 824, 828, 830, 832 and 834 are substantially similar for straight hole drilling (Path A), kick off hole drilling (Path B) and equilibrium hole drilling (Path C). Therefore, only steps 822*a*, 824*a*, 828*a*, 830*a*, 832*a* and 834*a* will be discussed in more detail.

At step 822*a* a determination will be made concerning the current run time, the ET for each run and the total maximum amount of run time or simulation which will be conducted. At step 824*a* a run will be made for each cutlet and a count will be made for the total number of cutlets used to carry out the simulation.

At step 826*a* calculations will be made for the respective cutlet being evaluated during the current run with respect to penetration along the associated bit axis as a result of bit rotation during the corresponding time interval. The location of the respective cutlet will be determined in the Cartesian coordinate system corresponding with the time the amount of penetration was calculated. The information will be transferred from a corresponding hole coordinate system into a spherical coordinate system.

At step 828*a* the model will determine which layer of formation material has been cut by the respective cutlet. A calculation will be made of the cutting depth, cutting area of the respective cutlet and saved into respective matrices for rock layer, depth and area for use in force calculations.

At step 830*a* the hole matrices in the hole spherical coordinate system will be updated based on the recently calculated cutlet position at the corresponding time. At step 832*a* a determination will be made to determine if the current cutter count is less than or equal to the total number of cutlets which will be simulated. If the number of the current cutter is less than the total number, the simulation will return to step 824*a* and repeat steps 824*a* through 832*a*.

If the cutlet count at step 832*a* is equal to the total number of cutlets, the simulation will proceed to step 834*a*. If the current time is less than the total maximum time selected, the simulation will return to step 822*a* and repeat steps 822*a* through 834*a*. If the current time is equal to the previously selected total maximum amount of time, the simulation will proceed to steps 840 and 860.

Figure 17A:
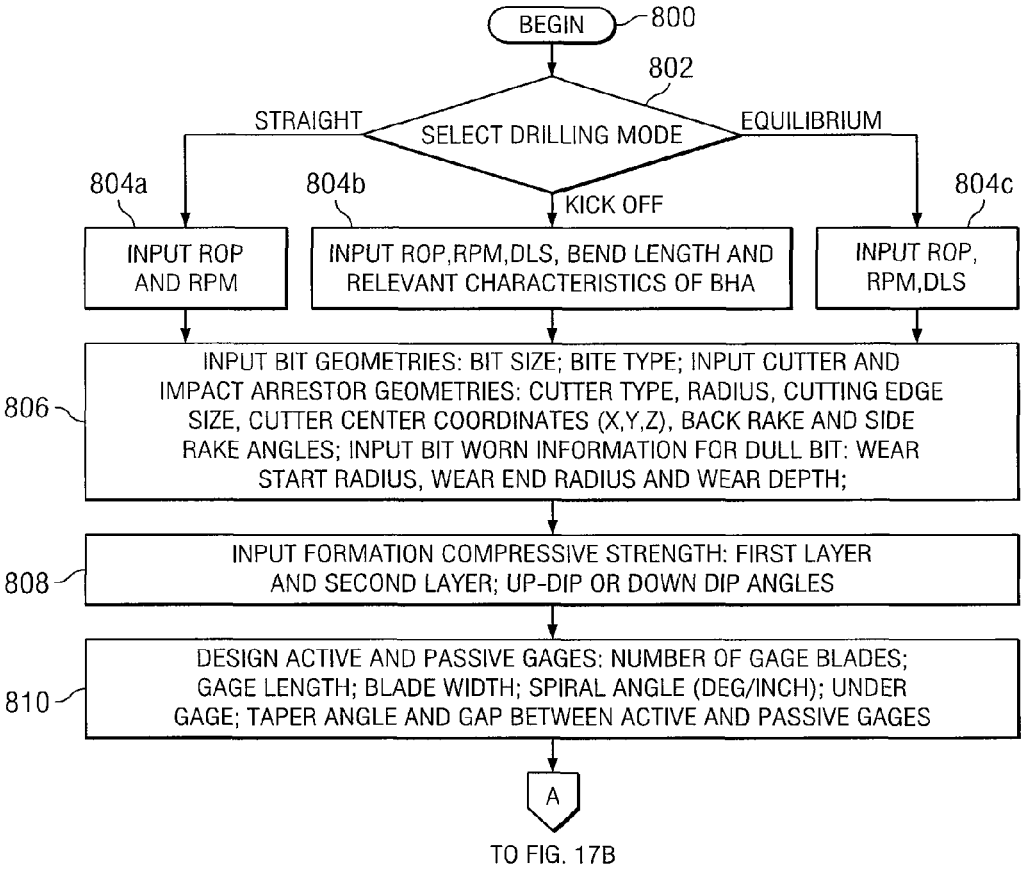
FIGS. 17A-17G is a block diagram showing one example of a method for simulating or modeling drilling of a directional wellbore using a rotary drill bit in accordance with teachings of the present disclosure.
Figure 17B:
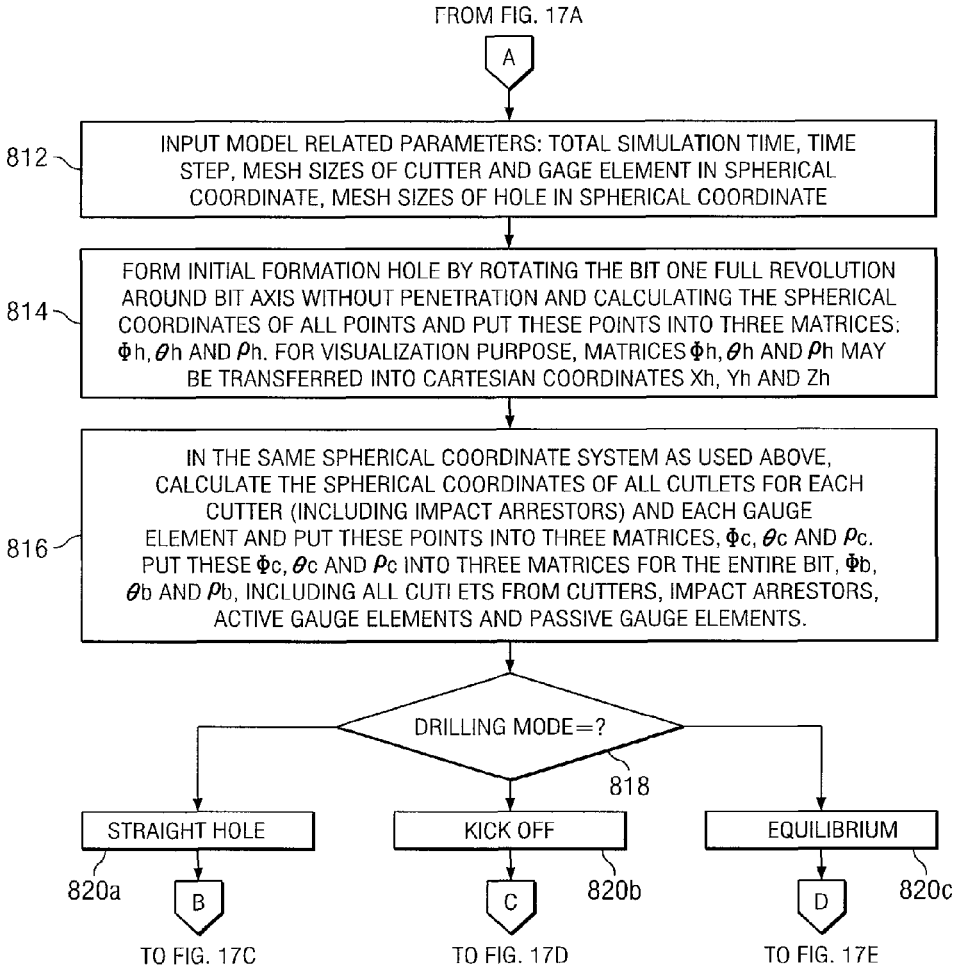
Figure 17C:
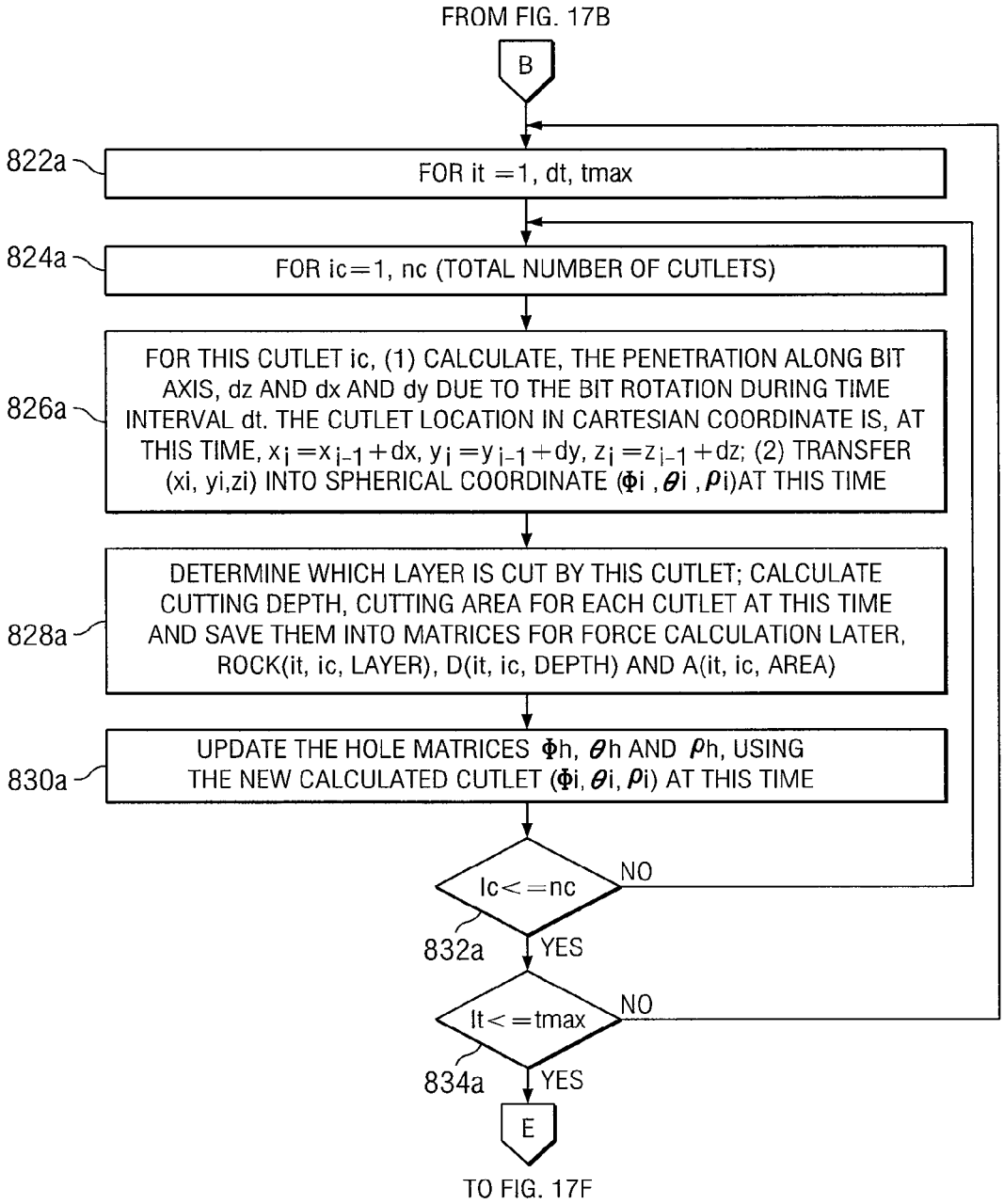
Figure 17D:
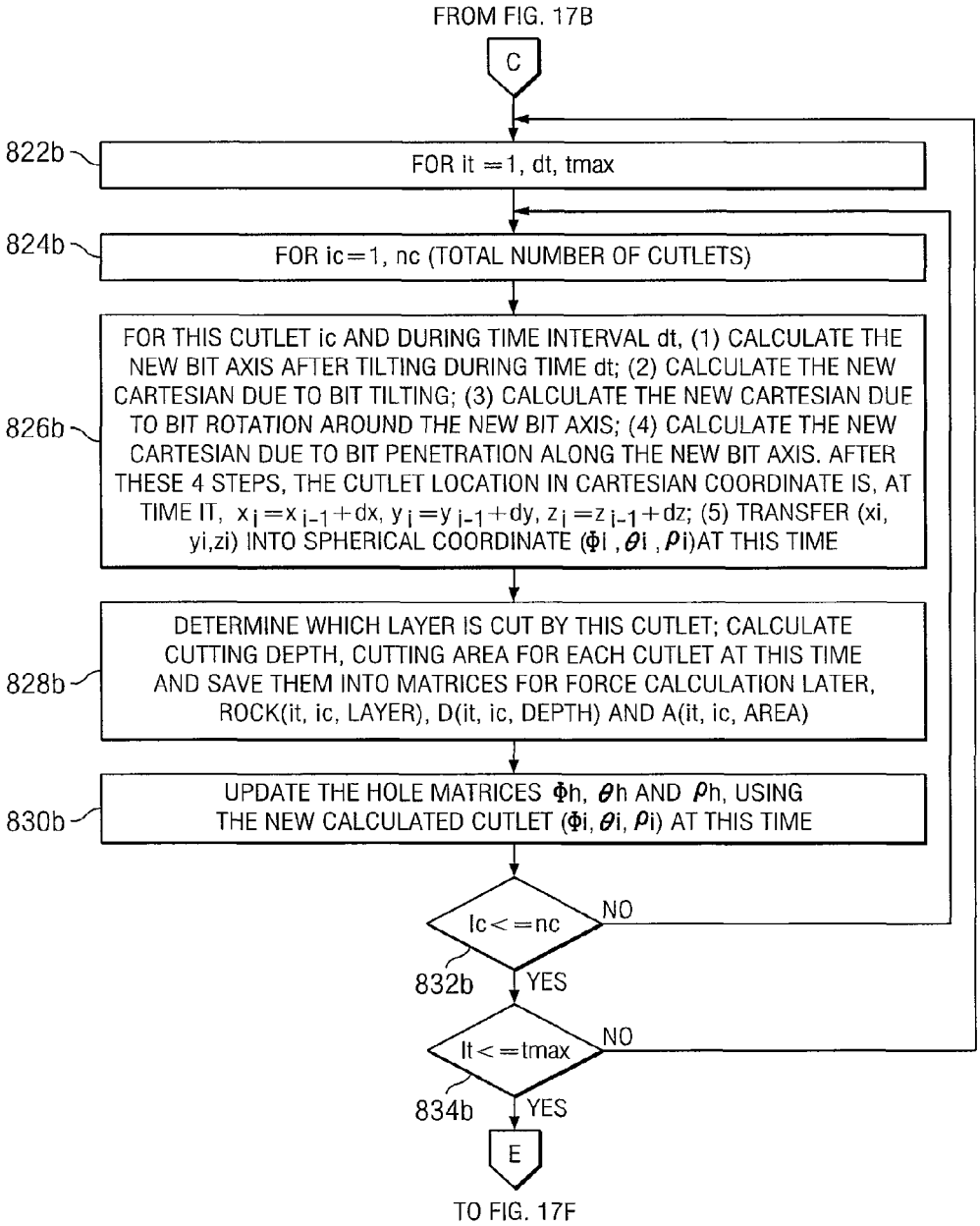

As previously noted, if a simulation proceeds along path C as shown in FIG. 17D corresponding with kick off hole drilling, the same steps will be performed as described with respect to path B for straight hole drilling except for step 826*b*. As shown in FIG. 17D, calculations will be made at step 826*b* corresponding with location and orientation of the new bit axis after tilting which occurred during respective time interval dt.

A calculation will be made for the new Cartesian coordinate system based upon bit tilting and due to bit rotation around the location of the new bit axis. A calculation will also be made for the new Cartesian coordinate system due to bit penetration along the new bit axis. After the new Cartesian coordinate systems have been calculated, the cutlet location in the Cartesian coordinate systems will be determined for the corresponding time interval. The information in the Cartesian coordinate time interval will then be transferred into the corresponding spherical coordinate system at the same time. Path C will then proceed through steps 828*b*, 830*b*, 832*b* and 834*b* as previously described with respect to path B.

Figure 17E:
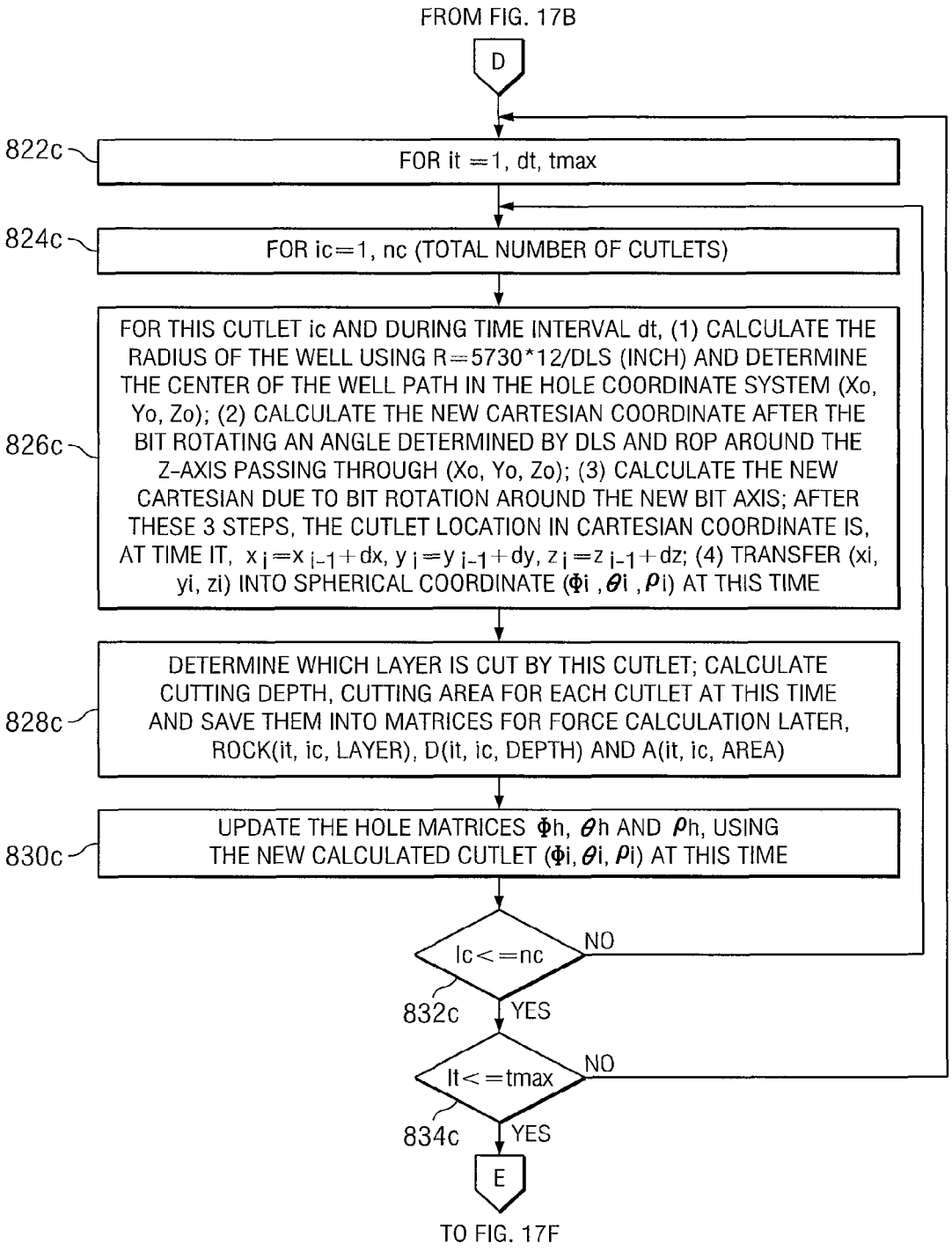
Figure 17F:
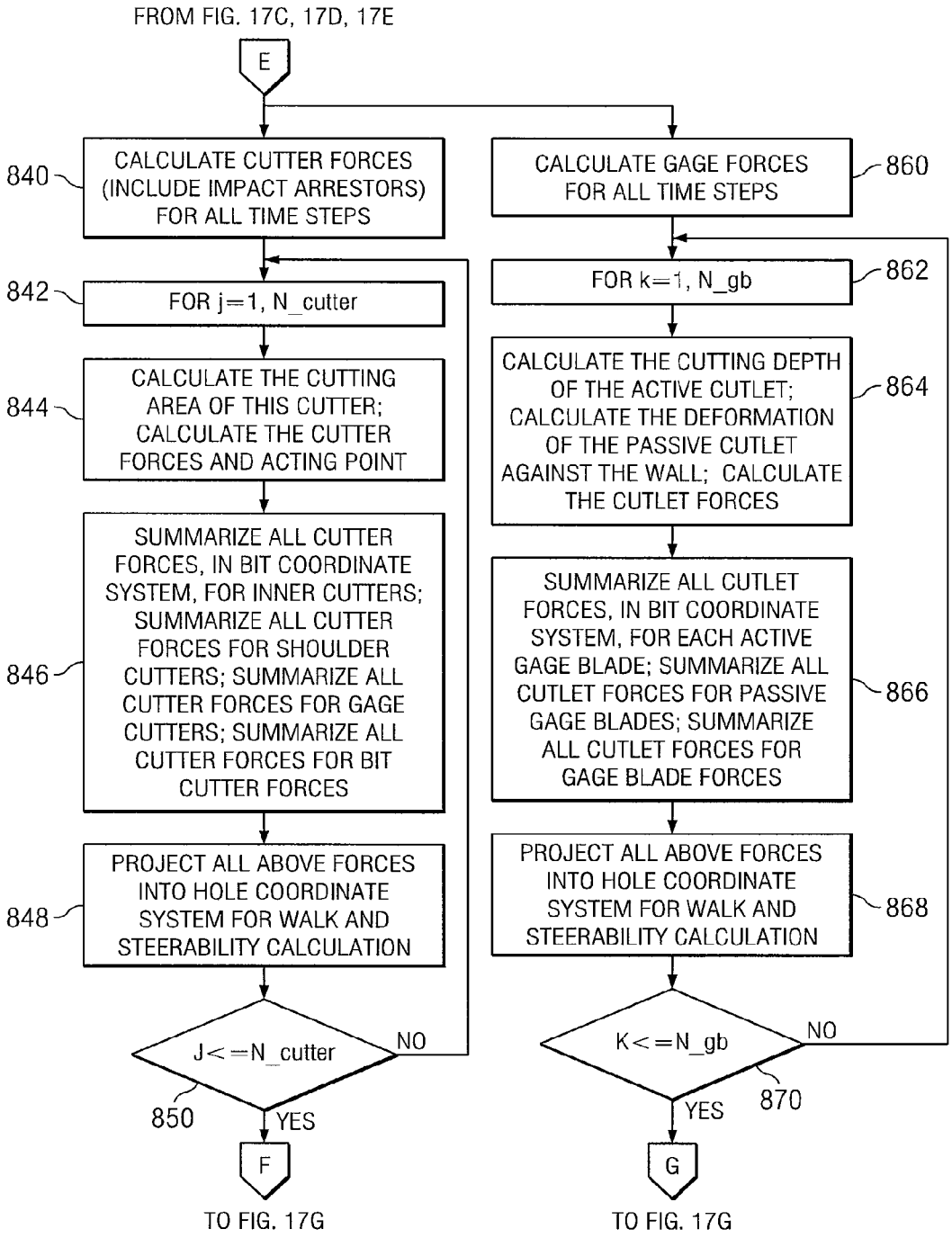
Figure 17G:
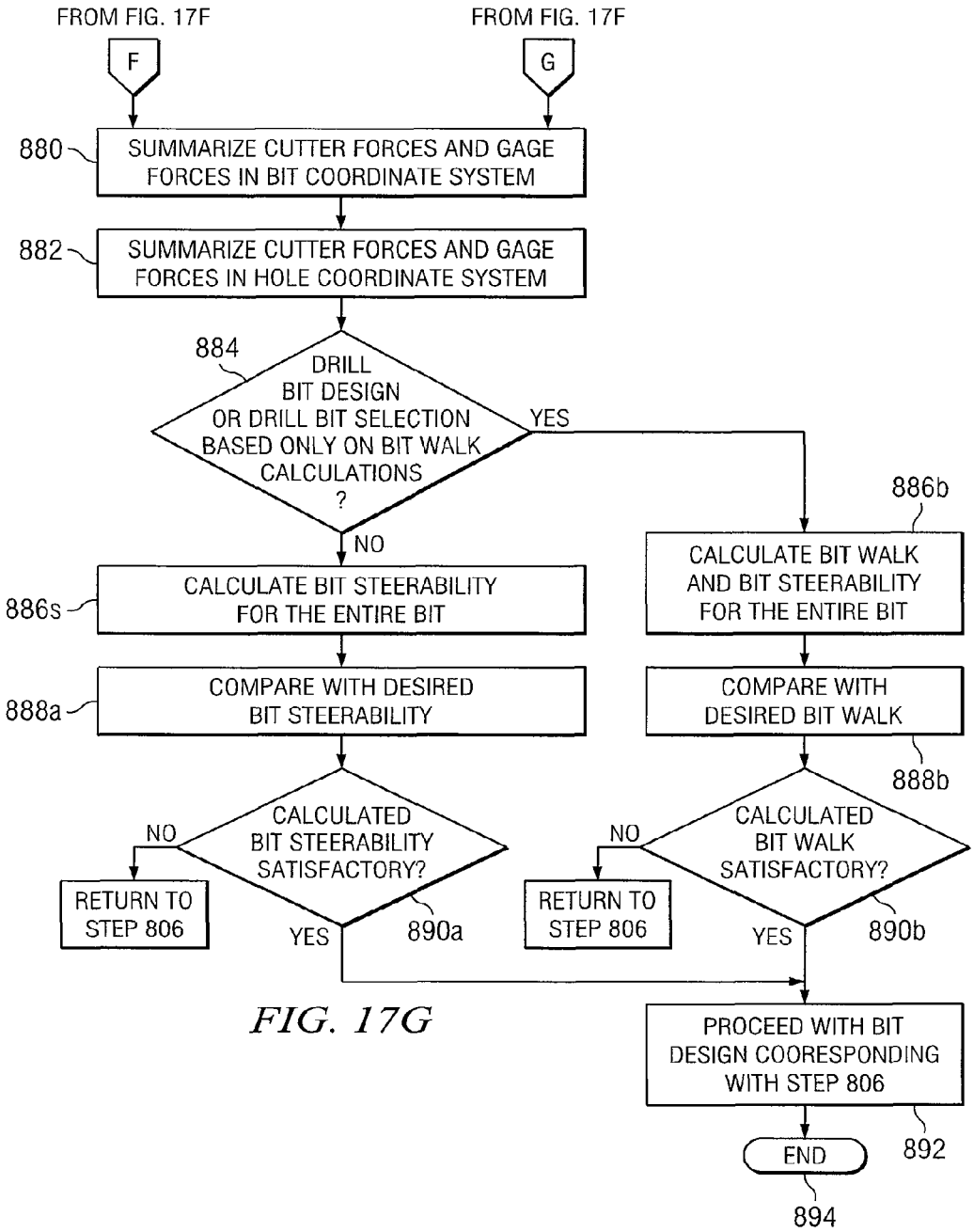

If equilibrium drilling is being simulated, the same functions will occur at steps 822*c* and 824*c* as previously described with respect to path B. For path D as shown in FIG. 17E, the simulation will proceed through steps 822*c* and 824*c* as previously described with respect to steps 822*a* and 824*a* of path B. At step 826*a* a calculation will be made for the respective cutlet during the respective time interval based upon the radius of the corresponding wellbore segment. A determination will be made based on the center of the path in a hole coordinate system. A new Cartesian coordinate system will be calculated after bit rotation has been entered based on the amount of DLS and rate of penetration along the Z axis passing through the hole coordinate system. A calculation of the new Cartesian coordinate system will be made due to bit rotation along the associated bit axis. After the above three calculations have been made, the location of a cutlet in the new Cartesian coordinate system will be determined for the appropriate time interval and transferred into the corresponding spherical coordinate system for the same time interval. Path D will continue to simulate equilibrium drilling using the same functions for steps 828*c*, 830*c*, 832*c* and 834*c* as previously described with respect to Path B straight hole drilling.

When selected path B, C or D has been completed at respective step 834*a*, 834*b* or 834*c* the simulation will then proceed to calculate cutter forces including impact arrestors for all step times at step 840 and will calculate associated gage forces for all step times at step 860. At step 842 a respective calculation of forces for a respective cutter will be started.

At step 844 the cutting area of the respective cutter is calculated. The total forces acting on the respective cutter and the acting point will be calculated.

At step 846 the sum of all the cutting forces in a bit coordinate system is summarized for the inner cutters and the shoulder cutters. The cutting forces for all active gage cutters may be summarized. At step 848 the previously calculated forces are projected into a hole coordinate system for use in calculating associated bit walk rate and steerability of the associated rotary drill bit.

At step 850 the simulation will determine if all cutters have been calculated. If the answer is NO, the model will return to step 842. If the answer is YES, the model will proceed to step 880.

At step 880 all cutter forces and all gage blade forces are summarized in a three dimensional bit coordinate system. At step 882 all forces are summarized into a hole coordinate system.

At step 884 a determination will be made concerning using only bit walk calculations or only bit steerability calculations.

If bit walk rate calculations will be used, the simulation will proceed to step 886*b* and calculate bit steer force, bit walk force and bit walk rate for the entire bit. At step 888*b* the calculated bit walk rate will be compared with a desired bit walk rate. If the bit walk rate is satisfactory at step 890*b*, the simulation will end and the last inputted rotary drill bit design will be selected. If the calculated bit walk rate is not satisfactory, the simulation will return to step 806.

If the answer to the question at step 884 is NO, the simulation will proceed to step 886*a* and calculate bit steerability using associated bit forces in the hole coordinate system. At step 888*a* a comparison will be made between calculated steerability and desired bit steerability. At step 890*a* a decision will be made to determine if the calculated bit steerability is satisfactory. If the answer is YES, the simulation will end and the last inputted rotary drill bit design at step 806 will be selected. If the bit steerability calculated is not satisfactory, the simulation will return to step 806.

Figure 18:
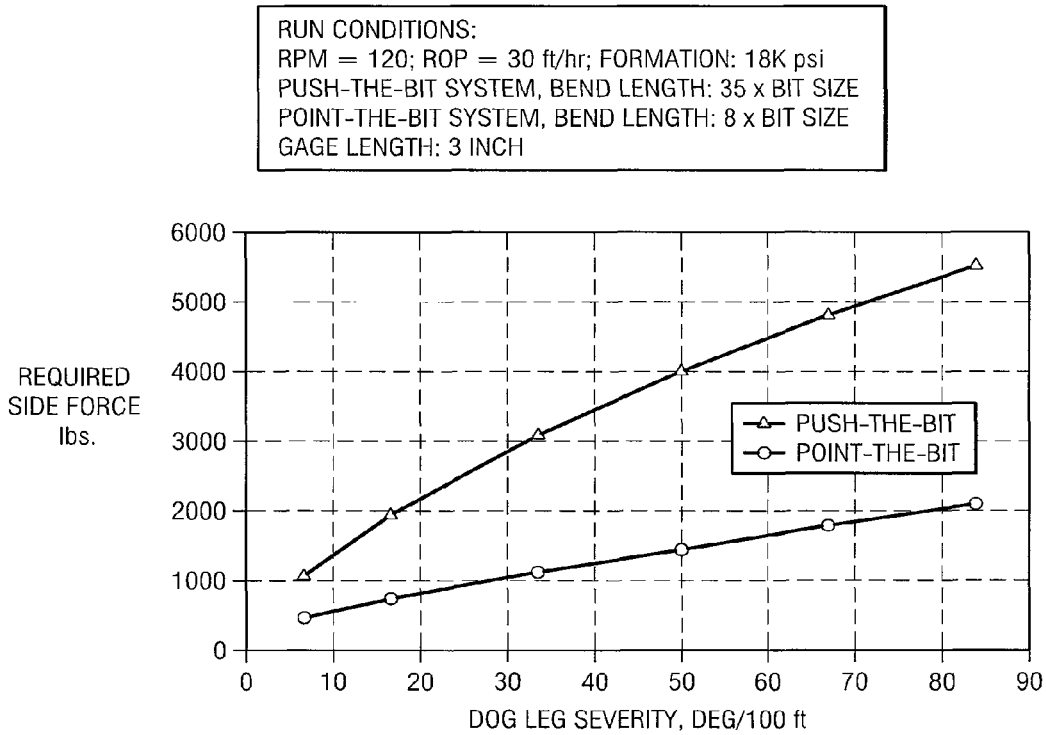
FIG. 18 is a graphical representation showing examples of the results of multiple simulations incorporating teachings of the present disclosure of using a rotary drill bit and associated downhole equipment to form a wellbore.

FIG. 18 is a schematic drawing showing one comparison of bit steerability versus tilt rate for a rotary drill bit when used with point-the-bit drilling system and push-the-bit drilling system, respectively. The curves shown in FIG. 18 are based upon a constant rate of penetration of thirty feet per hour, a constant RPM of 120 revolutions per minute, and a uniform rock strength of 18000 PSI. The simulations used to form the graphs shown in FIG. 18 along with other simulations conducted in accordance with teachings of the present disclosure indicates that bit steerability or required steer force is generally a nonlinear function of the DLS or tilt rate. The drilling bit when used in point-the-bit drilling system required much less steer force than with the push-the-bit drilling system. The graphs shown in FIG. 18 provide a similar result with respect to evaluating steerability as calculations represented by bit steer force as a function of bit tilt rate. The effect of downhole drilling conditions on varying the steerability of a rotary drill bit have previously been generally unnoticed by the prior art.

Bit Steerability Evaluation

The steerability of a rotary drill may be evaluated using the following steps.

(1) Input bit geometry parameters or read bit file from bit design software such as UniGraphics or Pro-E;

(2) Define bit motion: a rotation speed (RPM) around bit axis, an axial penetration rate (ROP, ft/hr), DLS or tilting rate (deg/100 ft) at an azimuth angle (to define the bit tilt plane);

(3) Define formation properties: rock compressive strength, rock transition layer, inclination angle;

(4) Define simulation time or total number of bit rotations and time interval;

(5) Run 3D PDC bit drilling simulator and calculate bit forces including bit side force;

(6) Change DLS and repeat step 5 to get bit side force corresponding to the given DLS;

(7) Plot a curve using (DLS, $F_s$) and calculate bit steerability; The steerability may be represented by the slop of the curve if the curve is close to a line, or the steerability may be represented by the first derivative of the nonlinear curve.

(8) Giving another set of bit operational parameters (ROP, RPM) and repeat step 3 to 7 to get more curves;

(9) Bit steerability is defined by a set of curves or their first derivative or slop.

The steerability of various rotary drill bit designs may be compared and evaluated by calculating a steering difficulty for each rotary drill bit.

Steering Difficulty Index may be defined using steer force as follows:

$$SD_{index}=F_{steer}/\text{Tilt Rate}$$

Steering Difficulty Index may also be defined using steer moment as follows:

$$SD_{index}=M_{steer}/\text{Steer Rate}$$

$$\text{Steer Rate}=\text{Tilt Rate}$$

A steering difficulty index may also be calculated for any zone of part on the drill bit. For example, when the steer force, $F_{steer}$, is contributed only from the shoulder cutters, then the associated $SD_{index}$ represents the difficulty level of the shoulder cutters. In accordance with teachings of the present disclosure, the steering difficulty index for each zone of the drilling bit may be evaluated. By comparing the steering difficulty index of each zone, a bit designer may more easily identify which zone or zones are more difficult to steer and design modifications may be focused on the difficult zone or zones.

The calculation of steerability index for each zone may be repeated and design changes made until the calculation of steerability for each zone is satisfactory and/or the steerability index for the overall drill bit design is satisfactory.

Bit Walk Rate Evaluation

Bit walk rate may be calculated using bit steer force, tilt rate and walk force:

$$\text{Walk Rate}=(\text{Steer Rate}/F_{steer})*F_{walk}$$

Bit walk rate may also be calculated using bit steer moment, tilt rate and walk moment:

$$\text{Walk Rate}=(\text{Steer Rate}/M_{steer})*M_{walk}$$

The walk rate may be applied to any zone of part on the drill bit. For example, when the steer force, $F_{steer}$ and walk force, $F_{walk}$, are contributed only from the shoulder cutters, then the associated walk rate represents the walk rate of the shoulder cutters. In accordance with teachings of the present disclosure, the walk rate for each zone of the drilling bit can be evaluated. By comparing the walk rate of each zone, the bit designer can easily identify which zone is the easiest zone to walk and modifications may be focused on that zone.

Although the present disclosure and its advantages have been described in detail, it should be understood that various changes, substitutions and alternations may be made herein without departing from the spirit and scope of the disclosure as defined by the following claims.

APPENDIX A

| EXAMPLES OF DRILLING EQUIPMENT DATA | | EXAMPLES OF | EXAMPLES OF |
|---|---|---|---|
| Design Data | Operating Data | WELLBORE DATA | FORMATION DATA |
| active gage | axial bit penetration rate | azimuth angle | compressive strength |
| bend (tilt) length | bit ROP | bottom hole configuration | down dip angle |
| bit face profile | bit rotational speed | bottom hole pressure | first layer |
| bit geometry | bit RPM | bottom hole temperature | formation plasticity |

APPENDIX A-continued

| | | | |
|---|---|---|---|
| blade (length, number, spiral, width) | bit tilt rate | directional wellbore | formation strength |
| bottom hole assembly | equilibrium drilling | dogleg severity (DLS) | inclination |
| cutter (type, size, number) | kick off drilling | equilibrium section | lithology |
| cutter density | lateral penetration rate | horizontal section | number of layers |
| cutter location (inner, outer, shoulder) | rate of penetration (ROP) | inside diameter | porosity |
| cutter orientation (back rake, side rake) | revolutions per minute (RPM) | kick off section | rock pressure |
| cutting area | side penetration azimuth | profile | rock strength |
| cutting depth | side penetration rate | radius of curvature | second layer |
| cutting structures | steer force | side azimuth | shale plasticity |
| drill string | steer rate | side forces | up dip angle |
| fulcrum point | straight hole drilling | slant hole | |
| gage gap | tilt rate | straight hole | |
| gage length | tilt plane | tilt rate | |
| gage radius | tilt plane azimuth | tilting motion | |
| gage taper | torque on bit (TOB) | tilt plane azimuth angle | |
| IADC Bit Model | walk angle | trajectory | |
| impact arrestor (type, size, number) | walk rate | vertical section | |
| passive gage | weight on bit (WOB) | | |
| worn (dull) bit data | | | |

| | EXAMPLES OF MODEL PARAMETERS FOR SIMULATING DRILLING A DIRECTIONAL WELLBORE |
|---|---|
| | Mesh size for portions of downhole equipment interacting with adjacent portions of a wellbore. |
| | Mesh size for portions of a wellbore. |
| | Run time for each simulation step. |
| | Total simulation run time. |
| | Total number of revolutions of a rotary drill bit per simulation. |

What is claimed is:

1. A method for determining bit walk rate of a rotary drill bit comprising:

applying a set of drilling conditions to the bit including at least bit rotational speed, rate of penetration along a bit rotational axis, and at least one characteristics of an earth formation;

applying a steer rate to the bit;

simulating, for a time interval, drilling of the earth formation by the bit under the set of drilling conditions, including calculating a steer force applied to the bit and an associated walk force;

calculating a walk rate based on the bit steer rate, the steer force, and the walk force;

repeating simulating drilling the earth formation for another time interval, and recalculating the steer force, the walk force and walk rate;

repeating the simulating successively for a predefined number of time intervals; and calculating an average walk rate of the bit using an average steer force and an average walk force over the simulated time interval.

2. A method for determining bit walk rate of a rotary drill bit comprising:

applying a set of drilling conditions to the bit including at least bit rotational speed, rate of penetration along a bit rotational axis, and at least one characteristics of an earth formation;

applying a steer rate to the bit;

simulating, for a time interval, drilling of the earth formation by the bit under the set of drilling conditions, including calculating a steer moment applied to the bit and an associated walk moment;

calculating a walk rate based on the bit steer rate, the steer moment, and the walk moment;

repeating simulating drilling the earth formation for another time interval, and recalculating the steer moment, the walk moment and walk rate;

repeating the simulating successively for a predefined number of time intervals; and calculating an average walk rate of the bit using an average steer moment and an average walk moment over the simulated time interval.

3. The method of claim 2 wherein applying the steer rate further comprises applying the steer rate in a vertical plane passing through the bit rotational axis.

* * * * *